US008630862B2

(12) United States Patent
Geiger et al.

(10) Patent No.: US 8,630,862 B2
(45) Date of Patent: Jan. 14, 2014

(54) AUDIO SIGNAL ENCODER/DECODER FOR USE IN LOW DELAY APPLICATIONS, SELECTIVELY PROVIDING ALIASING CANCELLATION INFORMATION WHILE SELECTIVELY SWITCHING BETWEEN TRANSFORM CODING AND CELP CODING OF FRAMES

(75) Inventors: Ralf Geiger, Erlangen (DE); Markus Schnell, Nuremberg (DE); Jeremie Lecomte, Fuerth (DE); Konstantin Schmidt, Nuremberg (DE); Guillaume Fuchs, Erlangen (DE); Nikolaus Rettelbach, Nuremberg (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 13/450,792

(22) Filed: Apr. 19, 2012

(65) Prior Publication Data

US 2012/0265541 A1 Oct. 18, 2012

Related U.S. Application Data

(63) Continuation of application No. PCT/EP2010/065753, filed on Oct. 19, 2010.

(60) Provisional application No. 61/253,450, filed on Oct. 20, 2009.

(51) Int. Cl.
*G10L 19/02* (2013.01)
*G10L 19/04* (2013.01)

(52) U.S. Cl.
USPC ..... 704/500; 704/219

(58) Field of Classification Search
None
See application file for complete search history.

(56) References Cited

U.S. PATENT DOCUMENTS

| | | | | |
|---|---|---|---|---|
| 6,134,518 | A * | 10/2000 | Cohen et al. | 704/201 |
| 6,658,383 | B2 * | 12/2003 | Koishida et al. | 704/229 |
| 6,785,645 | B2 * | 8/2004 | Khalil et al. | 704/216 |
| 7,286,982 | B2 * | 10/2007 | Gersho et al. | 704/223 |
| 7,315,815 | B1 * | 1/2008 | Gersho et al. | 704/223 |
| 7,596,486 | B2 * | 9/2009 | Ojala et al. | 704/201 |

(Continued)

FOREIGN PATENT DOCUMENTS

| | | |
|---|---|---|
| CN | 1312660 | 9/2001 |
| CN | 1485849 | 3/2004 |
| EP | 1 278 184 | 1/2003 |

OTHER PUBLICATIONS

3GPP TS 26.090.

(Continued)

*Primary Examiner* — Talivaldis Ivars Smits
(74) *Attorney, Agent, or Firm* — Michael A. Glenn; Perkins Coie LLP

(57) ABSTRACT

An audio signal encoder includes a transform-domain path which obtains spectral coefficients and noise-shaping information on the basis of a portion of the audio content, and which windows a time-domain representation of the audio content and applies a time-domain-to-frequency-domain conversion. The audio signal decoder includes a CELP path to obtain a code-excitation information and a LPC parameter information. A converter applies a predetermined asymmetric analysis window in both if a current portion is followed by a subsequent portion to be encoded in the transform-domain mode or in the CELP mode. Aliasing cancellation information is selectively provided in the latter case.

28 Claims, 32 Drawing Sheets

(56) References Cited

U.S. PATENT DOCUMENTS

| | | | | |
|---|---|---|---|---|
| 7,739,120 | B2 * | 6/2010 | Makinen | 704/501 |
| 7,747,430 | B2 * | 6/2010 | Makinen | 704/219 |
| 7,876,966 | B2 * | 1/2011 | Ojanpera | 382/232 |
| 7,979,271 | B2 * | 7/2011 | Bessette | 704/219 |
| 7,987,089 | B2 * | 7/2011 | Krishnan et al. | 704/214 |
| 8,069,034 | B2 * | 11/2011 | Makinen et al. | 704/201 |
| 8,392,179 | B2 * | 3/2013 | Yu et al. | 704/214 |

OTHER PUBLICATIONS

3GPP TS 26.190.
3GPP TS 26.290.
Chang-Chia Ming et al; "Compression Artifacts in Perceptual Audio Coding" AES Convention 121; Oct. 2006, AES, 60 East 42 nd Street, Room 2520 New York 10165-2520, USA XP040507795, p. 5, paragraph 3.3.3; figures 9-13.
Lecomte Jeremie et al; "Efficient Cross-Fade Windows for Transitions between LPC-Based and Non-LPC Based Audio Coding" AES Convention 126; May 2009, AES, 60 East 42$^{nd}$ Street, Room 2520 New York 10165-2520, USA, May 1, 2009, XP040508994, the whole document.
Peter Noll: MPEG Digital Audio Coding—Setting the Standard for High-Quality Audio Compression, 19970901; 19970900. Sep. 1, 1997, pp. 59-81, XP011089788 abstract; figure Fig. 15 p. 66, right hand column, p. 72, right-hand column.

* cited by examiner

Comparison of sine window (dotted line) and G.718 analysis window (solid line).

Comparison of sine window (dotted line) and G.718 synthesis window (solid line).

First option for Low Delay USAC: Sequence of G.718 analysis windows (——), ACELP (—•—•—), and FAC (·····).

Sequence for the synthesis corresponding to the previous figure.

Second option for Low Delay USAC: Sequence of G.718 analysis windows (——), ACELP (—•—•—), FAC (·····).

Sequence for the synthesis corresponding to the previous figure.

Transition from AAC to AMR-WB+

Analysis window of LD-MDCT in AAC-ELD

Synthesis window of LD-MDCT in AAC-ELD

Analysis window for transition from time-domain codec to AAC-ELD

Analysis window for transition from time-domain codec to AAC-ELD (solid line) compared to normal AAC-ELD analysis window (dashed line)

Synthesis window for transition from AAC-ELD to time-domain codec

Synthesis window for transition from AAC-ELD to time-domain codec (solid line) compared to normal AAC-ELD synthesis window (dashed line)

AUDIO SIGNAL ENCODER/DECODER FOR USE IN LOW DELAY APPLICATIONS, SELECTIVELY PROVIDING ALIASING CANCELLATION INFORMATION WHILE SELECTIVELY SWITCHING BETWEEN TRANSFORM CODING AND CELP CODING OF FRAMES

CROSS-REFERENCE TO RELATED APPLICATIONS

This application is a continuation of copending International Application No. PCT/EP2010/065753, filed Oct. 19, 2010, which is incorporated herein by reference in its entirety, and additionally claims priority from U.S. Application No. 61/253,450 filed Oct. 20, 2009, which is also incorporated herein by reference in its entirety.

BACKGROUND OF THE INVENTION

Embodiments according to the invention are related to an audio signal encoder for providing an encoded representation of an audio content on the basis of an input representation of the audio content.

Embodiments according to the invention are related to an audio signal decoder for providing a decoded representation of an audio content on the basis of an encoded representation of the audio content.

Embodiments according to the invention are related to a method for providing an encoded representation of an audio content on the basis of an input representation of the audio content.

Embodiments according to the invention are related to a method for providing a decoded representation of an audio content on the basis of an encoded representation of the audio content.

Embodiments according to the invention are related to computer programs for performing said methods.

Embodiments according to the invention are related to a new coding scheme for a unified speech and audio coding with low delay.

In the following, the background of the invention will be briefly explained in order to facilitate the understanding of the invention and the advantages thereof.

During the past decade, big effort has been put on creating the possibility to digitally store and distribute audio contents with good bitrate efficiency. One important achievement on this way is the definition of the International Standard ISO/IEC 14496-3. Part 3 of the Standard is related to encoding and decoding of audio contents, and subpart 4 of part 3 is related to general audio coding. ISO/IEC 14496 part 3, subpart 4 defines a concept for encoding and decoding of general audio content. In addition, further improvements have been proposed in order to improve the quality and/or to reduce the necessitated bitrate.

Moreover, audio coders and audio decoders have been developed which are specifically adapted for encoding and decoding speech signals. Such speech-optimized audio coders are described, for example, in the technical specifications "3GPP TS 26.090", "3GPP TS 26.190" and "3GPP TS 26.290" of the Third Generation Partnership Project.

It has been found that there are a number of applications in which a low encoding and decoding delay is desirable. For example, low delay is desired in real time multimedia applications, because noticeable delays result in an unpleasant user impression in such applications.

However, it has also been found that a good tradeoff between quality and bitrate sometimes necessitates a switching between different coding modes, depending on the audio content. It has been found that variations of the audio content bring along the desire to change between coding modes like, for example, between a transform-coded-excitation-linear-prediction-domain mode and an code-excitation-linear-prediction-domain mode (like, for example, an algebraic-code-excitation-linear-prediction-domain mode), or between a frequency domain mode and a coded-excitation-linear-prediction-domain mode. This is due to the fact that some audio contents (or some portions of a contiguous audio content) can be encoded with a higher coding efficiency in one of the modes, while other audio contents (or other portions of the same contiguous audio content) can be encoded with better coding efficiency in a different of the modes.

In view of this situation, it has been found that it is desirable to switch between different of the modes without necessitating a large bitrate overhead for the switching and also without significantly compromising the audio quality (for example, in the form of a switching "click"). In addition, it has been found that the switching between different of the modes should be compatible with the objective to have a low encoding and decoding delay.

In view of this situation, it is an objective of the invention to create a concept for a multimode audio coding which brings along a good tradeoff between bitrate efficiency, audio quality and delay when switching between different of the coding modes.

SUMMARY

According to an embodiment, an audio signal encoder for providing an encoded representation of an audio content on the basis of an input representation of the audio content may have: a transform-domain path configured to obtain a set of spectral coefficients and noise-shaping information on the basis of a time-domain representation of a portion of the audio content to be encoded in a transform-domain mode, such that the spectral coefficients describe a spectrum of a noise-shaped version of the audio content; wherein the transform-domain path includes a time-domain-to-frequency-domain converter configured to window a time-domain representation of the audio content, or a pre-processed version thereof, to obtain a windowed representation of the audio content, and to apply a time-domain-to-frequency-domain conversion, to derive a set of spectral coefficients from the windowed time-domain representation of the audio content; and an code-excited linear-prediction-domain path (CELP path) configured to obtain an code-excitation information and a linear-prediction-domain parameter information on the basis of a portion of the audio content to be encoded in an code-excited linear-prediction-domain mode (CELP mode); wherein the time-domain-to-frequency-domain converter is configured to apply a predetermined asymmetric analysis window for a windowing of a current portion of the audio content to be encoded in the transform-domain mode and following a portion of the audio content encoded in the transform-domain mode both if the current portion of the audio content is followed by a subsequent portion of the audio content to be encoded in the transform-domain mode and if the current portion of the audio content is followed by a subsequent portion of the audio content to be encoded in the CELP mode; and wherein the audio signal encoder is configured to selectively provide an aliasing cancellation information, which represents aliasing cancellation signal components which would be represented by a transform-domain mode representation of the subsequent portion of the audio content, if the current portion of the audio content is followed by a subsequent portion of the audio content to be encoded in the CELP mode.

According to another embodiment, an audio signal decoder for providing a decoded representation of an audio content on the basis of an encoded representation of the audio content may have: a transform-domain path configured to obtain a time-domain-representation of a portion of the audio content encoded in the transform-domain mode on the basis of a set of spectral coefficients and a noise-shaping information; wherein the transform domain path includes a frequency-domain-to-time-domain converter configured to apply a frequency-domain-to-time-domain conversion and a windowing, to derive a windowed time-domain representation of the audio content from the set of spectral coefficients or from a pre-processed version thereof; an code-excited linear-prediction-domain path configured to obtain a time-domain representation of the audio content encoded in an code-excited linear-prediction-domain mode (CELP mode) on the basis of an code-excitation information and a linear-prediction-domain parameter information; and wherein the frequency-domain-to-time-domain converter is configured to apply a predetermined asymmetric synthesis window for a windowing of a current portion of the audio content encoded in the transform-domain mode and following a previous portion of the audio content encoded in the transform-domain mode both if the current portion of the audio content is followed by a subsequent portion of the audio content encoded in the transform-domain mode and if the current portion of the audio content is followed by a subsequent portion of the audio content encoded in the CELP mode; and wherein the audio signal decoder is configured to selectively provide an aliasing cancellation signal on the basis of an aliasing cancellation information, which is included in the encoded representation of the audio content, and which represents aliasing cancellation signal components which would be represented by a transform-domain mode representation of the subsequent portion of the audio content, if the current portion of the audio content encoded in the transform-domain mode is followed by a subsequent portion of the audio content encoded in the CELP mode.

According to another embodiment, a method for providing an encoded representation of an audio content on the basis of an input representation of the audio content may have the steps of: obtaining a set of spectral coefficients and a noise-shaping information on the basis of a time-domain representation of a portion of the audio content to be encoded in the transform-domain mode, such that the spectral coefficients describe a spectrum of a noise-shaped version of the audio content, wherein a time-domain representation of the audio content to be encoded in the transform-domain mode, or a pre-processed version thereof, is windowed, and wherein a time-domain-to-frequency-domain conversion is applied to derive a set of spectral coefficients from the windowed time-domain representation of the audio content; obtaining an code-excitation information and a linear-prediction-domain information on the basis of a portion of the audio content to be encoded in an code-excited linear-prediction-domain mode (CELP mode); wherein a predetermined asymmetric analysis window is applied for the windowing of a current portion of the audio content to be encoded in the transform-domain mode and following a portion of the audio content encoded in the transform-domain mode both if the current portion of the audio content is followed by a subsequent portion of the audio content to be encoded in the transform-domain mode and if the current portion of the audio content is followed by a subsequent portion of the audio content to be encoded in the CELP mode; and wherein an aliasing cancellation information, which represents aliasing cancellation signal components which would be represented by a transform-domain mode representation of the subsequent portion of the audio content, is selectively provided if the current portion of the audio content is followed by a subsequent portion of the audio content to be encoded in the CELP mode.

According to another embodiment, a method for providing a decoded representation of an audio content on the basis of an encoded representation of the audio content may have the steps of: obtaining a time-domain representation of a portion of the audio content encoded in a transform-domain mode on the basis of a set of spectral coefficients and a noise-shaping information, wherein a frequency-domain-to-time-domain conversion and a windowing are applied to derive a windowed time-domain-representation of the audio content from the set of spectral coefficients or from a pre-processed version thereof; and obtaining a time-domain representation of the audio content encoded in an code-excited linear-prediction-domain mode on the basis of an code-excitation information and a linear-prediction-domain parameter information; wherein a predetermined asymmetric synthesis window is applied for a windowing of a current portion of the audio content encoded in the transform-domain mode and following a previous portion of the audio content encoded in the transform-domain mode both if the current portion of the audio content is followed by a subsequent portion of the audio content encoded in the transform-domain mode and if the current portion of the audio content is followed by a subsequent portion of the audio content encoded in the CELP mode; and wherein an aliasing cancellation signal is selectively provided on the basis of an aliasing cancellation information, which is included in the encoded representation of the audio content, and which represents aliasing cancellation signal components which would be represented by a transform-domain mode representation of the subsequent portion of the audio content, if the current portion of the audio content is followed by a subsequent portion of the audio content encoded in the CELP mode.

Another embodiment may have a computer program for performing an inventive method when the computer program runs on a computer.

An embodiment according to the invention creates an audio signal encoder for providing and encoded representation of an audio content on the basis of an input representation of the audio content. The audio signal encoder comprises a transform-domain path configured to obtain a set of spectral coefficients and a noise shaping information (for example, a scale factor information or a linear-prediction-domain parameter information) on the basis of a time-domain representation of a portion of the audio content to be encoded in a transform-domain mode, such that the spectral coefficients describe a spectrum of a noise-shaped (for example, scale-factor-processed or linear-prediction-domain noise-shaped) version of the audio content. The transform-domain path comprises a time-domain-to-frequency-domain converter configured to window a time-domain representation of the audio content, or a preprocessed version thereof, to obtain a windowed representation of the audio content, and to apply a time-domain-to-frequency-domain-conversion, to derive a set of spectral coefficients from the windowed time-domain representation of the audio content. The audio signal encoder also comprises a code-excited linear-prediction-domain path (briefly designated as ACELP path) configured to obtain an code-excitation information (like, for example, an algebraic code excitation information) and a linear-prediction-domain information on the basis of a portion of the audio content to be encoded in an code-excited linear-prediction-domain mode (also briefly designated as CELP mode) (like, for example, an algebraic code-excited linear prediction-domain mode). The time-domain-to-frequency-domain converter is configured to apply a predetermined asymmetric analysis window for a windowing of a current portion of the audio content to be encoded in the transform-domain mode and following a portion of the audio content encoded in the transform-domain mode both if the current portion of the audio content is followed by a subsequent portion of the audio content to be encoded in the transform-domain mode and if the current portion of the audio content is followed by a subsequent portion of the audio content to be encoded in the CELP mode. The audio signal encoder is configured to selectively provide an aliasing cancellation information if the current portion of the audio content (which is encoded in the transform-domain mode) is followed by a subsequent portion of the audio content to be encoded in the CELP mode.

This embodiment according to the invention is based on the finding that a good tradeoff between coding efficiency (for example, in terms of average bitrate), audio quality and coding delay can be obtained by switching between a transform-domain mode and a CELP mode, wherein a windowing of a portion of the audio content to be encoded in the transform-domain mode is independent from a mode in which a subsequent portion of the audio content is encoded, and wherein a reduction or cancellation of aliasing artifacts, which result from the usage of a windowing which is not specifically adapted to a transition towards a portion of the audio content encoded in the CELP mode, is made possible by the selective provision of the aliasing cancellation information. Thus, by the selective provision of the aliasing cancellation information, it is possible to use a window for the windowing of portions (for example, frames or subframes) of the audio content encoded in the transform-domain mode which windows comprises a temporal overlap (or even an aliasing cancellation overlap) with subsequent portions of the audio content. This allows for a good coding efficiency for a sequence of subsequent portions of the audio content encoded in the transform-domain mode, because the usage of such windows, which bring along a temporal overlap between subsequent portions of the audio content, creates the possibility to have a particularly efficient overlap-and-add on the decoder side. Moreover, delays are kept low by using the same window for the windowing of a portion of the audio content to be encoded in the transform-domain mode and following a portion of the audio content encoded in the transform-domain mode both if the current portion of the audio content is followed by a subsequent portion of the audio content to be encoded in the transform-domain mode and if the current portion of the audio content is followed by a subsequent portion of the audio content to be encoded in the CELP mode. In other words, a knowledge about the mode in which the subsequent portion of the audio content is encoded, is not necessitated for the selection of a window for the windowing of the current portion of the audio content. Thus, the coding delay is kept small, because the windowing of the current portion of the audio content can be performed before an encoding mode for an encoding of the subsequent portion of the audio content is known. Nevertheless, artifacts which would be introduced by the usage of a window, which is not perfectly suited for a transition from a portion of the audio content encoded in the transform-domain to a portion of the audio content encoded in the CELP mode, can be canceled at the decoder side using the aliasing cancellation information.

Thus, a good average coding efficiency is obtained, even though some additional aliasing cancellation information is necessitated at the transition from the portion of the audio content encoded in the transform-domain mode to a portion of the audio content encoded in the CELP mode. The audio quality is kept at a high level by the provision of the aliasing cancellation information, and delays are kept small by making the selection of a window independent from a mode in which the subsequent portion of the audio content is encoded.

To summarize, an audio encoder as discussed above combines a good bitrate efficiency with a low coding delay and still allows for a good audio quality.

In an embodiment, the time-domain-to-frequency-domain converter is configured to apply the same window for a windowing of a current portion of the audio content to be encoded in the transform-domain mode and following a portion of the audio content encoded in the transform-domain mode both if the current portion of the audio content is followed by a subsequent portion of the audio content to be encoded in the transform-domain mode and if the current portion of the audio content is followed by a subsequent portion of the audio content to be encoded in the CELP mode.

In an embodiment, the predetermined asymmetric window comprises a left window half and a right window half, wherein the left window half comprises a left-sided transition slope, in which the window values monotonically increase from zero to a window center value (a value at the center of the window), and an overshoot portion in which the window values are larger than the window center value and in which the window comprises a maximum. The right window half comprises a right-sided transition slope, in which the window values monotonically decrease from the window center value to zero, and a right-sided zero portion. By using such an asymmetric window, the coding delay can be kept particularly small. Also, by emphasizing the left window half using an overshoot portion, aliasing artifacts at a transition towards a portion of the audio content encoded in the CELP mode are kept comparatively small. Accordingly, the aliasing cancellation information can be encoded in a bitrate-efficient manner.

In an embodiment, the left window half comprises no more than 1% of zero window values, and the right-sided zero portion comprises a length of at least 20% of the window values of the right window half. It has been found that such a window is particularly well-suited for the application in an audio coder switching between a transform-domain mode and a CELP mode.

In an embodiment, the window values of the right window half of the predetermined asymmetric analysis window are smaller than the window center value, such that there is no overshoot portion in the right window half of the predetermined asymmetric analysis window. It has been found that such a window shape brings along comparatively small aliasing artifacts at a transition towards a portion of the audio content encoded in the CELP mode.

In an embodiment, a non-zero portion of the predetermined asymmetric analysis window is shorter, at least by 10%, than a frame length. Accordingly, the delay is kept particularly small.

In an embodiment, the audio signal encoder is configured such that subsequent portions of the audio content to be encoded in the transform-domain mode comprise a temporal overlap of at least 40%. In this case the signal encoder is also configured such that a current portion of the audio content to be encoded in the transform-domain mode and a subsequent portion of the audio content to be encoded in the code-excited linear-prediction-domain mode comprise a temporal overlap.

The audio signal encoder is configured to selectively provide the aliasing cancellation information, such that the aliasing cancellation information allows for a provision of an aliasing cancellation signal for canceling aliasing artifacts at a transition from a portion of the audio content encoded in the transform-domain mode to a portion of the audio content encoded in the CELP mode in an audio signal decoder. By providing a significant overlap between subsequent portions (for example, frames or subframes) of the audio content to be encoded in the transform-domain mode, it is possible to use a lapped transform, like, for example, a modified discrete cosine transform, for the time-domain-to-frequency-domain conversion, wherein a time domain aliasing of such a lapped transform is reduced or even canceled entirely by the overlap between subsequent frames encoded in the transform-domain mode. However, at the transition from a portion of the audio content encoded in the transform-domain mode to a portion of the audio content encoded in the CELP mode, there is also a certain temporal overlap which, however, does not result in a perfect aliasing cancellation (or does not even result in any aliasing cancellation). The temporal overlap is used to avoid an excessive modification of the framing at a transition between portions of the audio content encoded in different of the modes. However, for reducing or canceling aliasing artifacts which arise from the overlap at a transition between portions of the audio content encoded in different of the modes, the aliasing cancellation information is provided. Moreover, the aliasing is kept comparatively small due to the asymmetry of the predetermined asymmetric analysis window, such that the aliasing cancellation information can be encoded in a bitrate-efficient manner.

In an embodiment, the audio signal encoder is configured to select a window for a windowing of a current portion of the audio content (which is encoded in the transform-domain mode) independent from a mode which is used for an encoding of a subsequent portion of the audio content which overlaps temporally with a current portion of the audio content, such that the windowed representation of the current portion of the audio content (which is encoded in the transform-domain mode) overlaps with a subsequent portion of the audio content even if the subsequent portion of the audio content is encoded in the CELP mode. The audio signal encoder is configured to provide, in response to a detection that the next portion of the audio content is to be encoded in a CELP mode, an aliasing cancellation information, wherein the aliasing cancellation information represents aliasing cancellation signal components which would be represented by (or included in) a transform-domain mode representation of the subsequent portion of the audio content. Accordingly, the aliasing cancellation, which is (alternatively, i.e. in the presence of subsequent portions of the audio content encoded in the transform-domain mode) achieved by overlapping and adding time domain representations of two portions of the audio content encoded in the transform-domain mode, is achieved on the basis of the aliasing cancellation information at a transition from a portion of the audio content encoded in the transform-domain mode to a portion of the audio content encoded in the CELP mode. Thus, by using a dedicated aliasing cancellation information, the windowing of the portion of the audio content preceding the mode switching can be left unaffected, which helps to reduce the delay.

In an embodiment, the time-domain-to-frequency-domain converter is configured to apply the predetermined asymmetric window for a windowing of a current portion of the audio content to be encoded in the transform-domain mode and following a portion of the audio content encoded in the CELP mode, such that portions of the audio content to be encoded in the transform-domain mode are windowed using the same predetermined asymmetric analysis window independent from a mode in which a previous portion of the audio content is encoded and independent from a mode in which a subsequent portion of the audio content is encoded. The windowing is also applied such that a windowed representation of a current portion of the audio content to be encoded in the transform-domain mode temporally overlaps with the previous portion of the audio content encoded in the CELP mode. Accordingly, a particularly simple windowing scheme can be obtained, wherein portions of the audio content encoded in the transform-domain mode are (for example, throughout a piece of audio content) encoded using the same predetermined asymmetric analysis window. Thus, it is not necessitated to signal which type of analysis window is used, which increases the bitrate efficiency. Also, the encoder complexity (and the decoder complexity) can be kept very small. It has been found that an asymmetric analysis window, as discussed above, is well-suited both for transitions from the transform-domain mode to the CELP mode and back from the CELP mode to the transform-domain mode.

In an embodiment, the audio signal encoder is configured to selectively provide an aliasing cancellation information if the current portion of the audio content follows a previous portion of the audio content encoded in the CELP mode. It has been found that the provision of an aliasing cancellation information is also useful at such a transition and allows to ensure a good audio quality.

In an embodiment, the time-domain-to-frequency-domain converter is configured to apply a dedicated asymmetric transition analysis window, which is different from the predetermined asymmetric analysis window, for a windowing of a current portion of the audio content to be encoded in the transform-domain and following a portion of the audio content encoded in the CELP mode. It has been found that use of a dedicated window after the transition may help to reduce the bitrate overhead at a transition. Also, it has been found that use of a dedicated asymmetric transition analysis window after the transition does not bring along a significant additional delay, because the decision that the dedicated asymmetric transition analysis window should be used can be made on the basis of information which is already available at the time the decision is necessitated. Accordingly, the amount of aliasing cancellation information can be reduced, or the need for any aliasing cancellation information can even be eliminated in some cases.

In an embodiment, the code-excited linear-prediction-domain path (CELP path) is an algebraic-code-excited-linear-prediction-domain path (ACELP path) configured to obtain an algebraic code-excitation information and a linear-prediction-domain parameter information on the basis of a portion of the audio content to be encoded in an algebraic-code-excited linear-prediction-domain mode (ACELP mode) (which is used as the code-excited linear-prediction-domain mode). By using an algebraic-code-excited linear-prediction-domain path as the code-excited linear-prediction-domain path, a particularly high coding efficiency can be achieved in many cases.

An embodiment according to the invention creates an audio signal decoder for providing a decoded representation of an audio content on the basis of an encoded representation of the audio content. The audio signal decoder comprises a transform domain path configured to obtain a time domain representation of a portion of the audio content encoded in the transform-domain mode on the basis of a set of spectral coefficients and noise shaping information. The transform domain path comprises a frequency-domain-to-time-domain converter configured to apply a frequency-domain-to-time-domain conversion and a windowing, to derive a windowed time-domain representation of the audio content from the set of spectral coefficients or from a preprocessed version thereof. The audio signal decoder also comprises a code-excited linear-prediction-domain path configured to obtain a time-domain representation of a portion of the audio content encoded in a code-excited linear-prediction-domain mode on the basis of a code-excitation information and a linear-prediction-domain parameter information. The frequency-domain-to-time-domain converter is configured to apply a predetermined asymmetric synthesis window for a windowing of a current portion of the audio content encoded in the transform-domain mode and following a previous portion of the audio content encoded in the transform-domain mode both if the current portion of the audio content is followed by a subsequent portion of the audio content encoded in the transform-domain mode and if the current portion of the audio content is followed by a subsequent portion of the audio content encoded in the CELP mode. The audio signal decoder is configured to selectively provide an aliasing cancellation signal on the basis of an aliasing cancellation information if the current portion of the audio content is followed by a subsequent portion of the audio content encoded in the CELP mode.

This audio signal decoder is based on the finding that a good tradeoff between coding efficiency, audio quality and coding delay can be obtained by using the same predetermined asymmetric synthesis window for a windowing of a portion of the audio content encoded in the transform-domain mode irrespective of whether the subsequent portion of the audio content is encoded in the transform-domain mode or in the CELP mode. By using an asymmetric synthesis window, the low delay characteristics of the audio signal decoder can be improved. The coding efficiency can be kept high by having an overlap between the windows applied to subsequent portions of the audio content encoded in the transform-domain mode. Nevertheless, aliasing artifacts which result from an overlap in the case of transitions between portion of the audio content encoded in different modes are canceled by the aliasing cancellation signal, which is selectively provided at a transition from a portion (for example, frame or subframe) of the audio content encoded in the transform-domain mode to a portion of the audio content encoded in the CELP mode. Moreover, it should be pointed out that the audio signal decoder described here comprises the same advantages as the audio signal encoder described above and that the audio signal decoder described here is well-suited for cooperation with the audio signal encoder discussed above.

In an embodiment, the frequency-domain-to-time-domain converter is configured to apply the same window for a windowing of a current portion of the audio content encoded in the transform-domain mode and following a previous portion of the audio content encoded in the transform-domain mode both if the current portion of the audio content is followed by a subsequent portion of the audio content encoded in the transform-domain mode and if the current portion of the audio content is followed by a subsequent portion of the audio content encoded in the CELP mode.

In an embodiment, the predetermined asymmetric window comprises a left window half and a right window half. The left window half comprises a left-sided zero portion and a left-sided transition slope, in which the window values monotonically increase from zero to a window center value. The right window half comprises an overshoot portion in which the window values are larger than the window center value and in which the window comprises a maximum. The right window half also comprises a right-sided transition slope in which the window values monotonically decrease from the window center value to zero. It has been found that such a choice of the predetermined asymmetric synthesis window results in a particularly low delay because the presence of the left-sided zero portion allows for a reconstruction of an audio signal (of a previous portion of the audio content) up to the (right-sided) end of said zero portion independent from the time domain audio signal of the current portion of the audio content. Thus, an audio content can be rendered with a comparatively small delay.

In an embodiment, the left-sided zero portion comprises a length of at least 20% of the window values of the left window half, and the right window half comprises no more than 1% of zero window values. It has been found that such an asymmetric window is well-suited for low delay applications, and that such a predetermined asymmetric synthesis window is also well-suited for cooperation with the above-mentioned advantageous predetermined asymmetric analysis window.

In an embodiment, the window values of the left window half of the of the predetermined asymmetric window are smaller than the window center value, such that there is no overshoot portion in the left window half of the predetermined asymmetric synthesis window. Accordingly, a good low delay reconstruction of the audio content can be achieved in combination with the above mentioned asymmetric analysis window. Also, the window comprises a good frequency response.

In an embodiment, a non-zero portion of the predetermined asymmetric window is shorter, at least by 10%, than a frame length.

In an embodiment, the audio signal decoder is configured such that subsequent portions of the audio content encoded in the transform-domain mode comprise a temporal overlap of at least 40%. The audio signal decoder is also configured such that a current portion of the audio content encoded in the transform-domain mode and a subsequent portion of the audio content encoded in the CELP mode comprise a temporal overlap. The audio signal decoder is configured to selectively provide the aliasing cancellation signal on the basis of the aliasing cancellation information, such that the aliasing cancellation signal reduces or cancels aliasing artifacts at a transition from the current portion of the audio content (encoded in the transform domain mode) to a subsequent portion of the audio content encoded in the CELP mode. By having a significant overlap between subsequent portions of the audio content encoded in the transform-domain mode, smooth transitions can be obtained and aliasing artifacts, which may result from the usage of a lapped transform (like, for example, an inverse modified discrete cosine transform) are canceled. Thus, by using a significant overlap, it is possible to enhance the coding efficiency and the smoothing of transitions between subsequent portions (for example, frames or subframes) for a sequence of portions of the audio content encoded in the transform-domain mode. In order to avoid inconstancies in the framing and in order to allow for the use of the predetermined asymmetric synthesis window independent from the encoding mode of the subsequent portion of the audio content, the presence of a temporal overlap between the current portion of the audio content encoded in the transform-domain mode and the subsequent portion of the audio content encoded in the CELP mode is accepted. Nevertheless, artifacts arising at such a transition are canceled by the aliasing cancellation signal. Thus, a good audio quality at the transitions can be obtained while maintaining low coding delay and having a high average coding efficiency.

In an embodiment, the audio signal decoder is configured to select a window for a windowing of a current portion of the audio content independent from a mode which is used for an encoding of a subsequent portion of the audio content which overlaps temporally with the current portion of the audio content, such that the windowed representation of the current portion of the audio content overlaps with (a representation of) a subsequent portion of the audio content even if the subsequent portion of the audio content is encoded in the CELP mode. The audio signal decoder is also configured to provide, in response to a detection that the next portion of the audio content is encoded in the CELP mode, an aliasing cancellation signal to reduce or cancel aliasing artifacts at a transition from the current portion of the audio content encoded in the transform-domain mode to the next (subsequent) portion of the audio content encoded in the CELP mode. Accordingly, such aliasing artifacts, which could be canceled by a time-domain representation of a subsequent audio frame encoded in the transform-domain mode if the current portion of the audio content was followed by a portion of the audio content encoded in the transform-domain mode, are canceled using the aliasing cancellation signal if the current portion of the audio content is indeed followed by a portion of the audio content encoded in the CELP mode. Due to this mechanism, a degradation of the quality of the transition is avoided even if the subsequent portion of the audio content is encoded in the CELP mode.

In an embodiment, the frequency-domain-to-time-domain converter is configured to apply the predetermined asymmetric synthesis window for a windowing of a current portion of the audio content encoded in the transform mode and following a portion of the audio content encoded in the CELP mode, such that portions of the audio content encoded in the transform-domain mode are windowed using the same predetermined asymmetric synthesis window independent from a mode in which a previous portion of the audio content is encoded and also independent from a mode from in which a subsequent portion of the audio content is encoded. The predetermined asymmetric synthesis window is applied such that a windowed time domain representation of the current portion of the audio content encoded in the transform-domain mode temporally overlaps with a time-domain representation of the previous portion of the audio content encoded in the CELP mode. Thus, the same predetermined asymmetric synthesis window is used for a portion of the audio content encoded in the transform-domain mode independent from modes in which the adjacent previous and subsequent portions of the audio content are encoded. Accordingly, a particularly simple audio signal decoder implementation is possible. Also, it is unnecessary to use any signaling of the type of synthesis window, which reduces the bitrate demand.

In an embodiment, the audio signal decoder is configured to selectively provide an aliasing cancellation signal on the basis of an aliasing cancellation information if the current portion of the audio content follows a previous portion of the audio content encoded in the CELP mode. It has been found that it is sometimes desirable to also handle an aliasing at a transition from a portion of the audio content encoded in the CELP mode to a portion of the audio content encoded in the transform-domain mode using an aliasing cancellation information. It has been found that this concept brings along a good tradeoff between bitrate efficiency and delay characteristics.

In another embodiment, the frequency-domain-to-time-domain converter is configured to apply a dedicated asymmetric transition synthesis window, which is different from the predetermined asymmetric synthesis window, for a windowing of a current portion of the audio content encoded in the transform-domain mode and following a portion of the audio content encoded in the CELP mode. It has been found that the presence of aliasing artifacts may be avoided by such a concept. Also, it has been found that usage of a dedicated window after a transition does not severely compromise the low delay characteristics, because the information necessitated for the selection of such a dedicated window is already available at the time when such a dedicated synthesis window is applied.

In an embodiment, the code-excited linear-prediction-domain path (CELP path) is an algebraic-code-excited linear-prediction-domain path (ACELP path) configured to obtain a time-domain representation of the audio content encoded in an algebraic-code-excited linear-prediction-domain mode (ACELP mode) (which is used as the code-excited linear-prediction-domain mode) on the basis of an algebraic-code-excitation information and a linear-prediction-domain parameter information. By using an algebraic-code-excited linear-prediction-domain path as the code-excited linear-prediction-domain path, a particularly high coding efficiency can be achieved in many cases.

Further embodiments according to the invention create a method for providing an encoded representation of an audio content on the basis of an input representation of the audio content and a method for providing a decoded representation of an audio content on the basis of an encoded representation of the audio content. Further embodiments according to the invention create a computer program for performing at least one of said methods.

Said methods and said computer programs are based on the same findings as the above described audio signal encoder and the above described audio signal decoder and can be supplemented by any of the features and functionalities discussed with respect to the audio signal encoder and the audio signal decoder.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
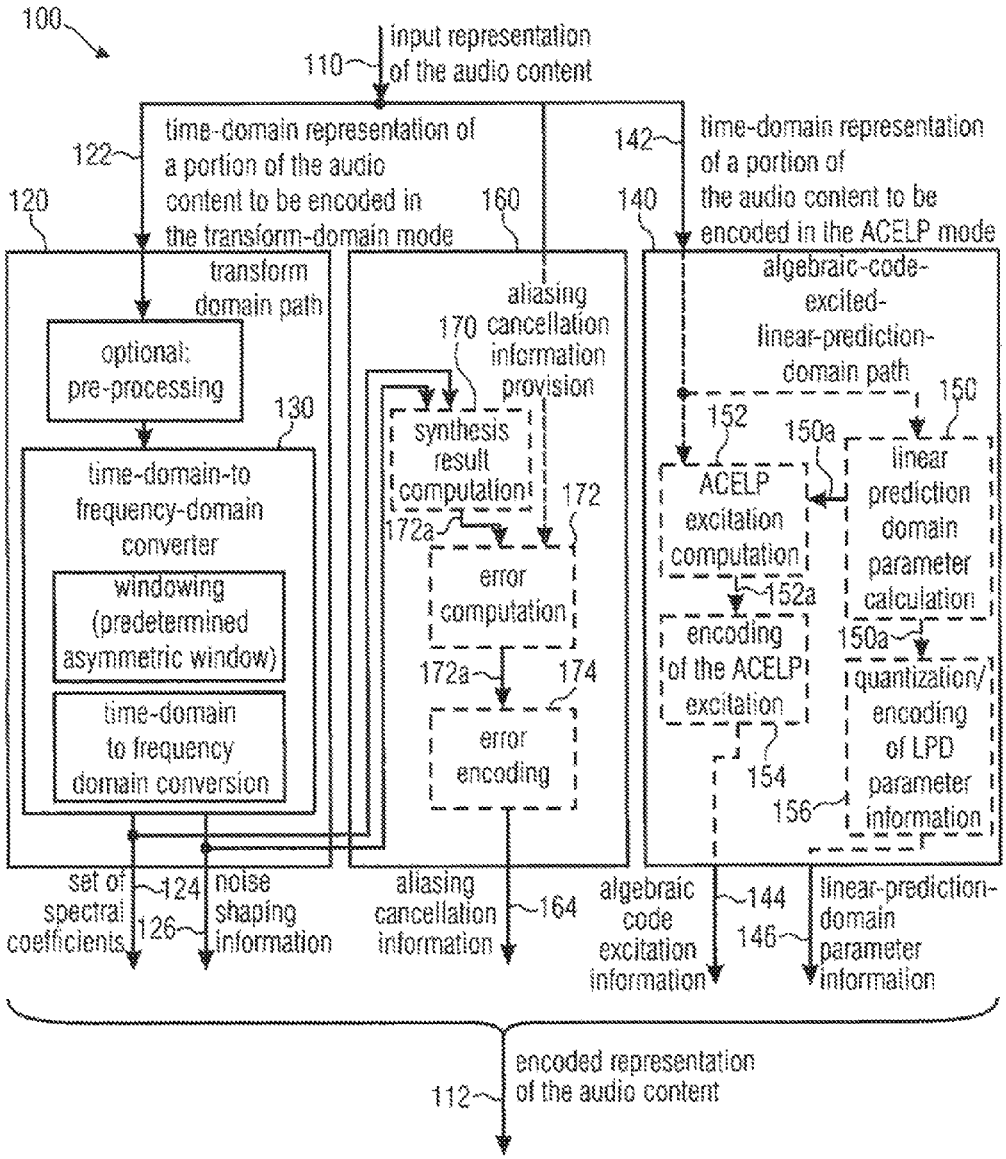
FIG. 1 shows a block schematic diagram of an audio signal encoder, according to an embodiment of the invention.

In the following, several embodiments according to the invention will be described.

It should be noted here that in the embodiments described in the following, an algebraic-code-excited linear-prediction-domain path (ACELP path) will be described as an example of a code-excited linear-prediction-domain path (CELP path), and that an algebraic-code-excited linear-prediction-domain mode (ACELP mode) will be described as a example of a code-excited linear-prediction-domain mode (CELP mode). Also, an algebraic-code excitation information will be described as an example of a code excitation information.

Nevertheless, different types of code-excited linear-prediction-domain paths may be used instead of the ACELP paths described herein. For example, instead of an ACELP path, any other variant of a code-excited linear-prediction-domain path may be used, like, for example, an RCELP path, a LD-CELP path or a VSELP path.

To summarize, different concepts may be used for to implement the code-excited linear-prediction-domain path, which have in common that a source filter model of speech production through linear prediction is used both at the side of the audio encoder and at the side of the audio decoder, and that a code excitation information is derived at the encoder side by directly encoding, without performing a transform into the frequency domain, an excitation signal (also designated as a stimulus signal) adapted to excite (or stimulate) a linear-prediction model (for example, a linear-prediction synthesis filter) for a reconstruction of the audio content to be encoded in the CELP mode, and that the excitation signal is derived directly, without performing a frequency-domain-to-time-domain conversion, from the code-excitation information at the side of the audio decoder to reconstruct the excitation signal (also designated as a stimulus signal) adapted to excite (or stimulate) a linear-prediction model (for example, a linear-prediction synthesis filter) for a reconstruction of the audio content encoded in the CELP mode.

In other words, the CELP paths in the audio signal encoder and in the audio signal decoder typically combine a usage of a linear-prediction-domain model (or filter) (which model or filter may be configured to model a vocal tract) with a "time-domain" encoding or decoding of an excitation signal (or stimulus signal, or residual signal). In said "time-domain" encoding or decoding, the excitation signal (or stimulus signal, or residual signal) may be encoded or decoded directly (without performing a time-domain-to-frequency-domain conversion of the excitation signal, or without performing a frequency-domain-to-time-domain conversion of the excitation signal) using appropriate codewords. For the encoding and decoding of the excitation signal, different types of codewords may be used. For example, Huffmann-codewords (or a Huffmann encoding scheme, or a Huffmann decoding scheme) may be used for encoding or decoding the samples of the excitation signal (such that Huffmann codewords may form the code excitation information). Alternatively, however, different adaptive and/or fixed codebooks may be used for the encoding and decoding of the excitation signal, optionally in combination with a vector quantization or vector encoding/decoding (such that these codewords form the code excitation information). In some embodiments, algebraic codebooks may be used for the encoding and decoding of the excitation signal (ACELP), but different codebook types are also applicable.

To summarize, many different concepts for the "direct" encoding of the excitation signal exist, which may all be used in the CELP path. The encoding and decoding using the ACELP concept, which will be described below, should therefore only be considered as an example out of a wide variety of possibilities for the implementation of the CELP path.

1. Audio Signal Encoder According to FIG. 1

In the following, an audio signal encoder 100 according to an embodiment of the invention will be described taking reference to FIG. 1, which shows a block schematic diagram of such an audio signal encoder 100. The audio signal encoder 100 is configured to receive an input representation 110 of an audio content and to provide, on the basis thereof, an encoded representation 112 of the audio content. The audio signal encoder 100 comprises a transform domain path 120 which is configured to receive a time domain representation 122 of a portion (for example, frame or sub-frame) of the audio content to be encoded in the transform-domain mode and to obtain a set of spectral coefficients 124 (which may be provided in an encoded form) and a noise shaping information 126 on the basis of the time domain representation 122 of the portion of the audio content to be encoded in a transform-domain mode. The transform path 120 is configured to provide the spectral coefficients 124 such that the spectral coefficients describe a spectrum of a noise-shaped version of the audio content.

The audio signal encoder 100 also comprises an algebraic-code-excited-linear-prediction-domain path (briefly designated as ACELP path) 140 which is configured to receive a time domain representation 142 of a portion of the audio content to be encoded the ACELP mode and to obtain an algebraic-code-excitation information 144 and a linear-prediction-domain parameter information 146 on the basis of a portion of the audio content to be encoded in an algebraic-code-excited linear-prediction-domain mode (also briefly designated as ACELP mode). The audio signal encoder 100 also comprises an aliasing cancellation information provision 160, which is configured to provide an aliasing cancellation information 164.

The transform domain path comprises a time-domain-to-frequency-domain converter 130, which is configured to window a time domain representation 122 of the audio content (or, more precisely a time domain representation of a portion of the audio content to be encoded in the transform-domain mode), or a preprocessed version thereof, to obtain a windowed representation of the audio content (or, more precisely, a windowed version of a portion of the audio content to be encoded in the transform-domain mode), and to apply a time-domain-to-frequency-domain conversion to derive a set 124 of spectral coefficients from the windowed (time domain) representation of the audio content. The time-domain-to-frequency-domain converter 130 is configured to apply a predetermined asymmetric analysis window for a windowing of a current portion of the audio content to be encoded in the transform-domain mode and following a previous portion of the audio content encoded in the transform-domain mode both if the current portion of the audio content is followed by a subsequent portion of the audio content to be encoded in the transform-domain mode and if the current portion of the audio content is followed by a subsequent portion of the audio content to be encoded in the ACELP mode.

The audio signal encoder, or, more precisely, the aliasing cancellation information provision 160, is configured to selectively provide an aliasing cancellation information if the current portion of the audio content (which is assumed to be encoded in the transform domain mode) is followed by a subsequent portion of the audio content to be encoded in the ACELP mode. In contrast, no aliasing cancellation information may be provided if the current portion of the audio content (which is encoded in the transform-domain mode) is followed by another portion of the audio content to be encoded in the transform domain mode.

Accordingly, the same predetermined asymmetric analysis window is used for a windowing of a portion of the audio content to be encoded in the transform-domain mode irrespective of whether the subsequent portion of the audio content is to be encoded in the transform-domain mode or in the ACELP mode. The predetermined asymmetric analysis window typically provides for an overlap between subsequent portions (for example, frames or subframes) of the audio content, which typically results in a good coding efficiency and the possibility to perform an efficient overlap-and-add operation in the audio signal decoder to thereby avoid blocking artifacts. However, it is typically also possible to cancel aliasing artifacts at the encoder side by an overlap-and-add operation if two subsequent (and partly overlapping) portions of the audio content are coded in the transform domain mode. In contrast, the usage of the predetermined asymmetric analysis window even at a transition between a portion of the audio content encoded in the transform-domain mode and a subsequent portion of the audio content to be encoded in the ACELP mode brings along the challenge that the overlap-and-add aliasing cancellation, which works well for transitions between subsequent portions of the audio content encoded in the transform-domain mode, is no longer effective because, typically only temporally sharply limited blocks of samples without an overlap (and, in particular, without a fade-in windowing or a fade-out windowing) are encoded the ACELP mode.

However, it has been found that it is possible to use the same asymmetric analysis window, which is used at transitions between subsequent portions of the audio content encoded in the transform-domain mode, even at a transition between a portion of the audio content encoded in the transform-domain mode and a subsequent portion of the audio content encoded in the ACELP mode if an aliasing cancellation information is selectively provided at such a transition.

Accordingly, the time-domain-to-frequency-domain converter 130 does not necessitate any knowledge of the mode in which a subsequent portion of the audio content is encoded in order to decide which analysis window should be used for the analysis of the current time portion of the audio content. Consequently, a delay can be kept very small while still using asymmetric analysis windows which provide for a sufficient overlap to allow for an efficient overlap-and-add operation at the side of a decoder. In addition, it is possible to switch from a transform-domain mode to an ACELP mode without significantly compromising the audio quality, because aliasing cancellation information 164 is provided at such a transition to account for the fact that the predetermined asymmetric analysis window is not perfectly adapted for such a transition.

In the following, some more details of the audio signal encoder 100 will be explained.

1.1. Details Regarding the Transform Domain Path 1.1.1. Transform Domain Path According to FIG. 2*a*

Figure 2A:
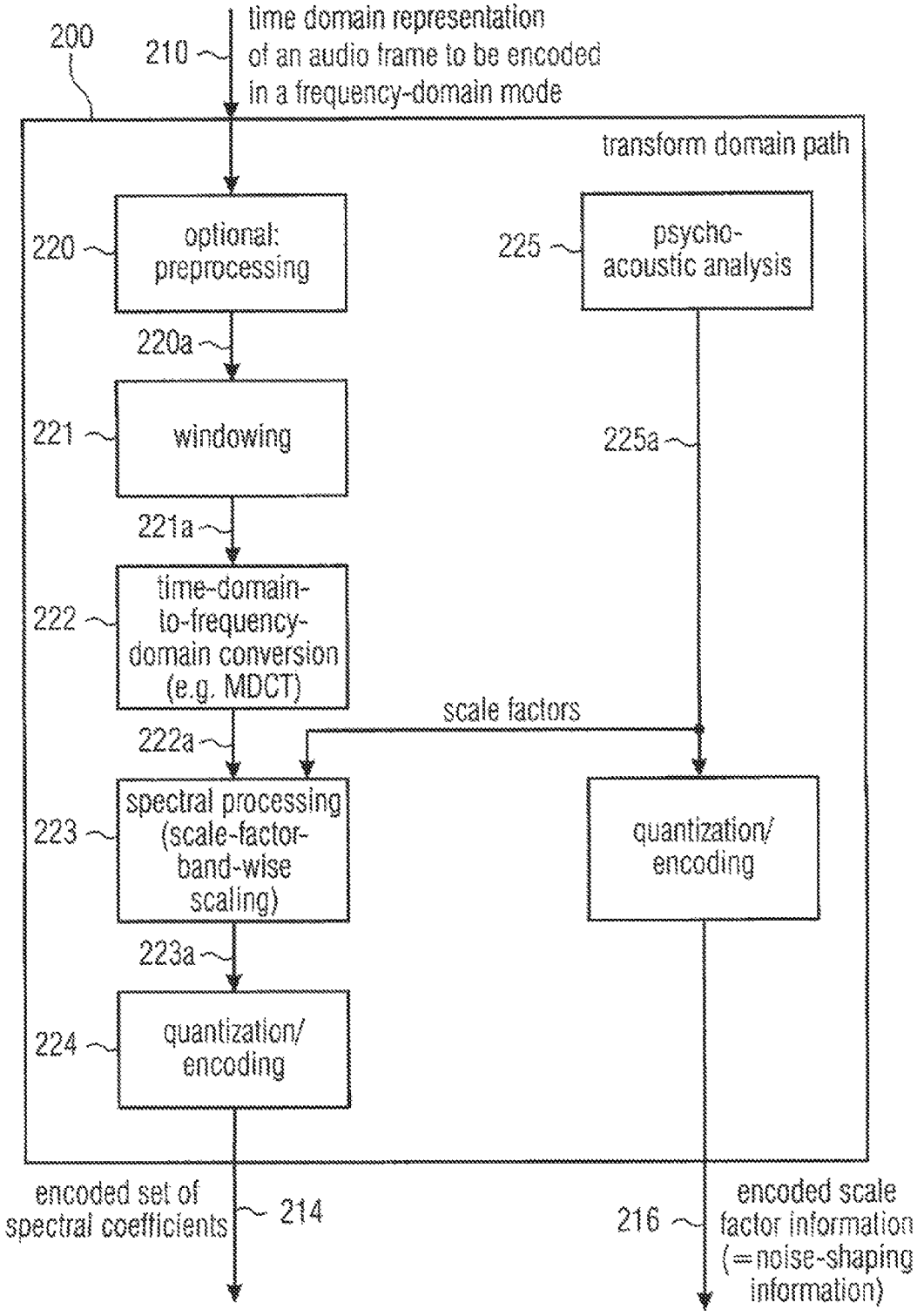
FIGS. 2*a*-2*c* show block schematic diagrams of transform domain paths for use in the audio signal encoder according to FIG. 1.

FIG. 2*a* shows a block schematic diagram of a transform domain path 200, which may take the place of the transform domain path 120, and which may be considered as a frequency-domain path.

The transform domain path 200 receives a time domain representation 210 of an audio frame to be encoded in a frequency-domain mode, wherein a frequency-domain mode is an example for a transform-domain mode. The transform domain path 200 is configured to provide an encoded set of spectral coefficients 214 and an encoded scale factor information 216 on the basis of the time domain representation 210. The transform domain path 200 comprises an optional preprocessing 220 of the time domain representation 210, to obtain a preprocessed version 220*a* of the time domain representation 210. The transform domain path 200 also comprises a windowing 221, in which the predetermined asymmetric analysis window (as described above) is applied to the time domain representation 210 or to the preprocessed version 220*a* thereof, to obtain a windowed time domain representation 221*a* of a portion of the audio content to be encoded in the frequency-domain mode. The transform domain path 200 also comprises a time-domain-to-frequency-domain conversion 222, in which a frequency domain representation 222*a* is derived from the windowed time domain representation 221 of a portion of the audio content to be encoded in the frequency-domain mode. The transform domain path 200 also comprises a spectral processing 223 in which a spectral shaping is applied to the frequency domain coefficients or spectral coefficients which form the frequency domain representation 222*a*. Accordingly, a spectrally scaled frequency domain representation 223*a* is obtained, for example, in the form of a set of frequency domain coefficients or spectral coefficients. A quantization and an encoding 224 is applied to the spectrally scaled (i.e. spectrally shaped) frequency domain representation 223*a*, to obtain the encoded set of spectral coefficients 240.

The transform domain path 200 also comprises a psychoacoustic analysis 225, which is configured to analyze the audio content, for example, with respect to frequency masking effects and temporal masking effects, to determine which components of the audio content (for example, which spectral coefficients) should be encoded with higher resolution and for which components (for example, for which spectral coefficients) an encoding with comparatively lower resolution is sufficient. Accordingly, the psychoacoustic analysis 225 may, for example, provide scale factors 225*a* which describe, for example, a psychoacoustic relevance of a plurality of scale factor bands. For example, (comparatively) large scale factors may be associated with scale factor bands of (comparatively) high psychoacoustic relevance, while (comparatively) small scale factors may be associated with scale factor bands of (comparatively) lower psychoacoustic relevance.

In the spectral processing 223, spectral coefficients 222*a* are weighted in accordance with the scale factors 225*a*. For example, spectral coefficients 222*a* of the different scale factor bands are weighted in accordance with scale factors 225*a* associated to said respective scale factor bands. Accordingly, spectral coefficients of a scale factor band having a high psychoacoustic relevance are weighted higher than spectral coefficients of scale factor bands having a lower psychoacoustic relevance in the spectrally shaped frequency domain representation 223*a*. Accordingly, spectral coefficients of scale factor bands having a higher psychoacoustic relevance are effectively quantized with higher quantization accuracy by the quantization/encoding 224 due to the higher weighting in the spectral processing 223. Spectral coefficients 222*a* of scale factor bands having a lower psychoacoustic relevance are effectively quantized with lower resolution by the quantization/encoding 224 due to their lower weighting in the spectral processing 223.

The frequency domain branch 200 consequently provides an encoded set of spectral coefficients 214 and an encoded scale factor information 216, which is an encoded representation of the scale factors 225*a*. The encoded scale factor information 216 effectively constitutes a noise shaping information because the encoded scale factor information 216 describes the scaling of the spectral coefficients 222*a* in the spectral processing 223, which effectively determines the distribution of the quantization noise across the different scale factor bands.

For further details, reference is made to the literature regarding the so-called "advanced audio coding", in which an encoding of a time domain representation of an audio frame in a frequency domain mode is described.

Moreover, it should be noted that the transform domain path 200 typically processes temporally overlapping audio frames. The time-domain-to-frequency-domain conversion 222 comprises an execution of a lapped transform like, for example, a modified-discrete-cosine-transform (MDCT). Accordingly, only approximately N/2 spectral coefficients 222*a* are provided for an audio frame having N time domain samples. Accordingly, an encoded set of, for example, N/2 spectral coefficients 214 is not sufficient for perfect (or approximately perfect) reconstruction of a frame of N time domain samples. Rather, an overlap of two subsequent frames is typically necessitated in order to perfectly (or at least approximately perfectly) reconstruct a time domain representation of the audio content. In other words, encoded sets of spectral coefficients 214 of two subsequent audio frames are typically necessitated, at the decoder side, in order to cancel an aliasing in a temporal overlap region of two subsequent frames encoded in the frequency domain mode.

Further details on how the aliasing is canceled at a transition from a frame encoded in the frequency domain mode to a frame encoded in the ACELP mode will be described below, however.

1.1.2. Transform Domain Path According to FIG. 2*b*

Figure 2B:
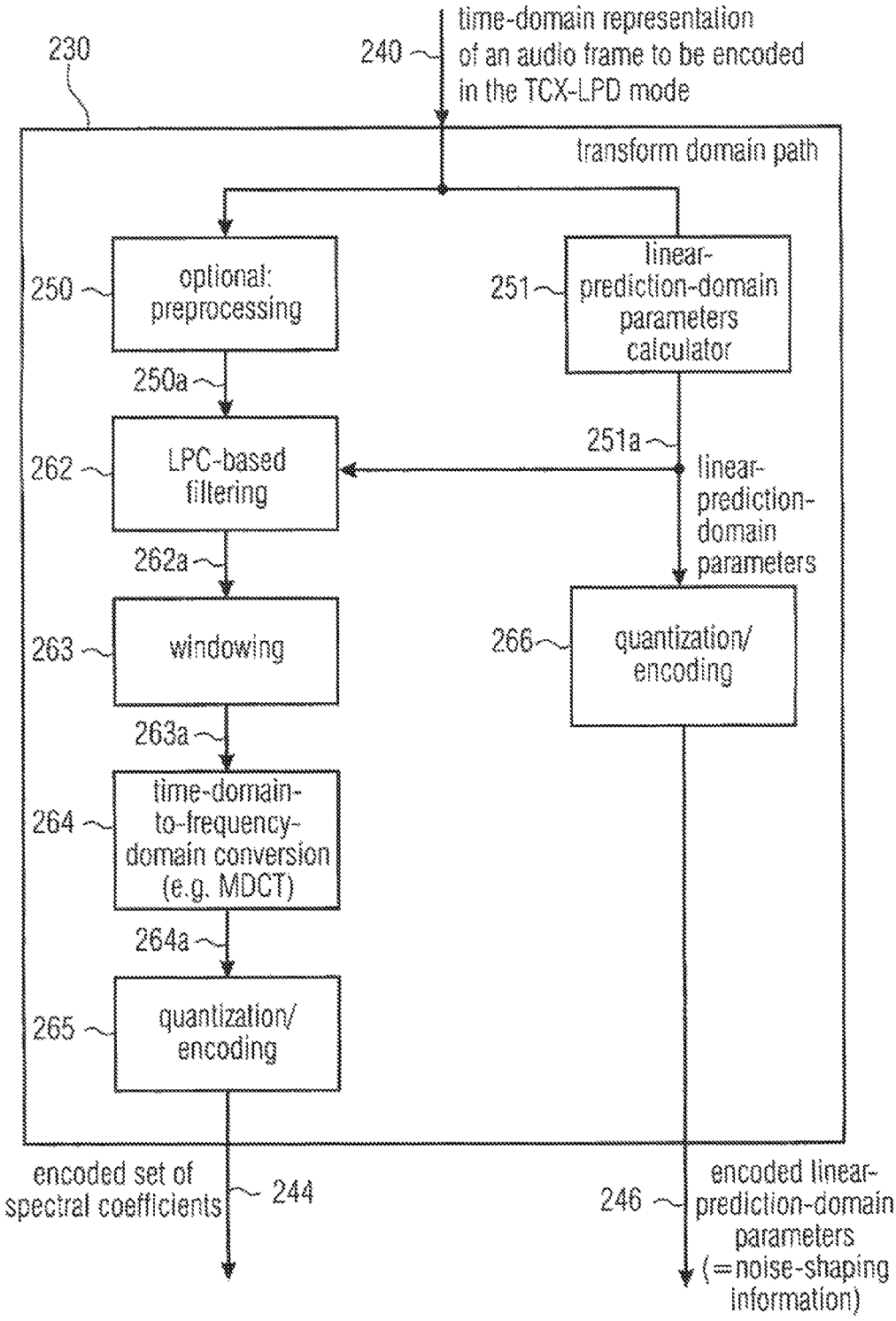

FIG. 2*b* shows a block schematic diagram of a transform domain path 230, which may take the place of the transform domain path 120.

The transform domain path 230, which may be considered as a transform-coded-excitation-linear-prediction-domain path, receives a time domain representation 240 of an audio frame to be encoded in a transform-coded-excitation-linear-prediction-domain mode (also briefly designated as TCX-LPD mode), wherein the TCX-LPD mode is an example of a transform domain mode. The transform domain path 230 is configured to provide an encoded set of spectral coefficients 244 and encoded linear-prediction-domain parameters 246, which may be considered as a noise shaping information. The transform domain path 230 optionally comprises a preprocessing 250, which is configured to provide a preprocessed version 250*a* of the time domain representation 240. The transform domain path also comprises a linear-prediction-domain parameter calculation 251, which is configured to compute linear-prediction-domain filter parameters 251*a* on the basis of the time domain representation 240. The linear prediction domain parameter calculation 251 may, for example, be configured to perform a correlation analysis of the time domain representation 240, to obtain the linear-prediction-domain filter parameters. For example, the linear-prediction-domain parameter calculation 251 may be performed as described in the documents "3GPP TS 26.090", "3GPP TS 26.190" and "3GPP TS 26.290" of the Third Generation Partnership Project.

The transform domain path 230 also comprises an LPC-based filtering 262, in which the time domain representation 240 or the preprocessed version 250*a* thereof, are filtered using a filter which is configured in accordance with the linear-prediction-domain filter parameters 251*a*. Accordingly, a filtered time domain signal 262*a* is obtained by the filtering 262, which is based on the linear-prediction-domain parameters 251*a*. The filtered time domain signal 262*a* is windowed in a windowing 263, to obtain a windowed time domain signal 263*a*. The windowed time domain signal 263*a* is converted into a frequency-domain representation by a time-domain-to-frequency-domain conversion 264, to obtain a set of spectral coefficients 264*a* as a result of the time-domain-to-frequency-domain conversion 264. The set of spectral coefficients 264*a* is subsequently quantized and encoded in a quantization/encoding 265, to obtain the encoded set of spectral coefficients 244.

The transform domain path 230 also comprises a quantization and encoding 266 of the linear-prediction-domain parameters 251*a*, to provide the encoded linear-prediction-domain parameters 246.

Regarding the functionality of the transform domain path 230, it can be said that the linear-prediction-domain parameter calculation 251 provides a linear-prediction-domain filter information 251*a*, which is applied in the filtering 262. The filtered time domain signal 262*a* is a spectrally shaped version of the time domain representation 240 or of the preprocessed version 250*a* thereof. Generally speaking, it can be said that the filtering 262 performs a noise shaping, such that components of the time domain representation 240, which are more important for the intelligibility of the audio signal described by the time domain representation 240, are weighted higher than spectral components of the time domain representation 240 which are less important for the intelligibility of the audio content represented by the time domain representation 240. Accordingly, spectral coefficients 264*a* of spectral components of the time domain representation 240 which are more important for the intelligibility of the audio content are emphasized over spectral coefficients 264*a* of spectral components which are less important for the intelligibility of the audio content.

Consequently, spectral coefficients associated with more important spectral components of the time domain representation 240 will effectively be quantized with higher quantization accuracy than spectral coefficients of spectral components of lower importance. Thus, the quantization noise caused by the quantization/encoding 250 is shaped such that more important (with respect to the intelligibility of the audio content) spectral components are effected less-severely by the quantization noise than less important (with respect to the intelligibility of the audio content) spectral components.

Accordingly, the encoded linear-prediction-domain parameters 246 can be considered as a noise shaping information, which describes, in encoded form, the filtering 262, which has been applied to shape the quantization noise.

In addition, it should be noted that a lapped transform is used for the time-domain-to-frequency-domain conversion 264. For example, a modified-discrete-cosine-transform (MDCT) is used for the time-domain-to-frequency-domain conversion 264. Accordingly, a number of encoded spectral coefficients 244 provided by the transform domain path is smaller than a number of time domain samples of an audio frame. For example, an encoded set of N/2 spectral coefficients 244 may be provided for an audio frame comprising N time domain samples. Accordingly, a perfect (or approximately perfect) reconstruction of the N time domain samples of the audio frame is not possible on the basis of the encoded set of N/2 spectral coefficients 244 associated with said frame. Rather, an overlap-and-add between reconstructed time domain representations of two subsequent audio frames is necessitated to cancel a time domain aliasing, which is caused by the fact that a smaller number of, for example, N/2 spectral coefficients is associated with an audio frame of N time domain samples. Thus, it is typically necessitated to overlap time domain representations of two subsequent audio frames encoded in the TCX-LPD mode at the decoder side in order to cancel aliasing artifacts in the temporal overlap region between said two subsequent frames.

However, mechanisms for the cancellation of aliasing at a transition between an audio frame encoded in the TCX-LPD mode and a subsequent audio frame encoded in the ACELP mode will be described below.

1.1.3. Transform Domain Path According to FIG. 2*c*

Figure 2C:
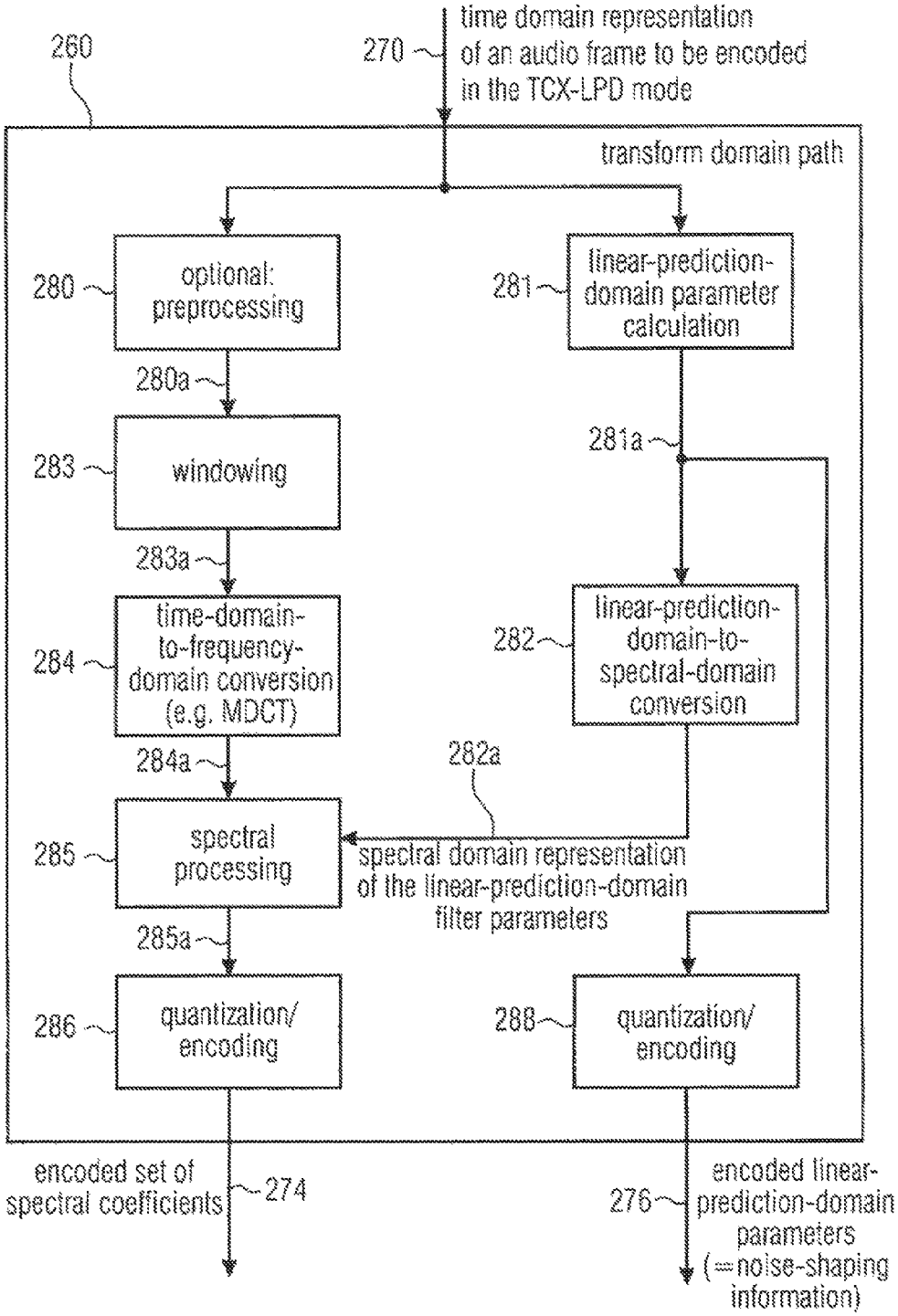

FIG. 2*c* shows a block schematic diagram of a transform domain path 260, which may take the place of the transform domain path 120 in some embodiments, and which may be considered as a transform-coded-excitation-linear-prediction-domain path.

The transform domain path 260 is configured to receive a time domain representation of an audio frame to be encoded in the TCX-LPD mode and provides, on the basis thereof, an encoded set of spectral coefficients 274 and encoded linear-prediction-domain parameters 276, which may be considered as noise shaping information. The transform domain path 260 comprises an optional preprocessing 280, which may be identical to the preprocessing 250 and provide a preprocessed version of the time domain representation 270. The transform domain path 260 also comprises a linear-prediction-domain parameter calculation 281, which may be identical to the linear-prediction-domain parameter calculation 251, and which provides linear-prediction-domain filter parameters 281*a*. The transform domain path 260 also comprises a linear-prediction-domain-to-spectral-domain conversion 282, which is configured to receive the linear-prediction-domain filter parameters 281*a* and to provide, on the basis thereof, a spectral domain representation 282*b* of the linear-prediction-domain filter parameters. The transform domain path 260 also comprises a windowing 283, which is configured to receive the time domain representation 270 or the preprocessed version 280*a* thereof and to provide a windowed time domain signal 283*a* for a time-domain-to-frequency-domain conversion 284. The time-domain-to-frequency-domain conversion 284 provides a set of spectral coefficients 284*a*. The set of spectral coefficients 284 is spectrally processed in a spectral processing 285. For example, each of the spectral coefficients 284*a* is scaled in accordance with an associated value of the spectral domain representation 282*a* of the linear-prediction-domain filter parameters. Accordingly, a set of scaled (i.e. spectrally shaped) spectral coefficients 285*a* is obtained. A quantization and an encoding 286 is applied to the set of scaled spectral coefficients 285*a*, to obtain an encoded set of spectral coefficients 274. Thus, spectral coefficients 284*a*, for which the associated value of the spectral domain representation 282*a* comprises a comparatively large value, are given a comparatively high weight in the spectral processing 285, while spectral coefficients 284*a*, for which the associated value of the spectral domain representation 282*a* comprises a comparatively small value, are given a comparatively smaller weight in the spectral processing 285. Thus, different weights are applied to the spectral coefficients 284*a* when deriving the spectral coefficients 285*a*, wherein the weights are determined by the values of the spectral domain representation 282*a*.

Electively, the transform domain path 260 performs a similar spectral shaping as the transform domain path 230, even though the spectral shaping is performed by the spectral processing 285, rather than by the filter bank 262.

Again, the linear-prediction-domain filter parameters 281*a* are quantized and encoded in a quantization/encoding 288, to obtain the encoded linear-prediction-domain parameters 276. The encoded linear-prediction-domain parameters 276 describe, in an encoded form, the noise shaping which is performed by the spectral processing 285.

Again, it should be noted that the time-domain-to-frequency-domain conversion 284 is performed using a lapped transform, such that the encoded set of spectral coefficients 274 typically comprises a smaller number of, for example, N/2 spectral coefficients when compared to a number of, for example, N time domain samples of an audio frame. Thus, a perfect (or approximately perfect) reconstruction of an audio frame encoded in the TCX-LPD frame is not possible on the basis of a single encoded set of spectral coefficients 274. Rather, time domain representations of two subsequent audio frames encoded in the TCX-LPD mode are typically overlapped-and-added in an audio signal decoder in order to cancel aliasing artifacts.

However, a concept for the cancellation of the aliasing artifacts at a transition from an audio frame encoded in the TCX-LPD mode to an audio frame encoded in the ACELP mode will be described below.

1.2. Details Regarding the Algebraic-Code-Excited Linear-Prediction-Domain Path

In the following, some details regarding the algebraic-code-excited-linear-prediction-domain path 140 will be described.

The ACELP path 140 comprises a linear-prediction-domain parameter calculation 150, which may identical to the linear-prediction-domain parameter calculation 251 and to the linear-prediction-domain parameter calculation 281 in some cases. The ACELP path 140 also comprises an ACELP excitation computation 152, which is configured to provide an ACELP excitation information 152 in dependence on the time domain representation 142 of a portion of the audio content to be encoded in the ACELP mode and also in dependence on the linear-prediction-domain parameters 150*aa* (which may be linear-prediction-domain filter parameters) provided by the linear-prediction-domain parameter calculation 150. The ACELP path 140 also comprises an encoding 154 of the ACELP excitation information 152, to obtain the algebraic-code-excitation information 144. In addition, the ACELP path 140 comprises a quantization and encoding 156 of the linear-prediction-domain parameter information 150*a*, to obtain the encoded linear-prediction-domain parameter information 146. It should be noted that the ACELP path may comprise a functionality which is similar to, or even equal to, the functionality of the ACELP coding described, for example, in the documents "3GPP TS 26.090", "3GPP TS 26.190" and "3GPP TS 26.290" of the Third Generation Partnership Project. However, different concepts for the provision of the algebraic-code-excitation information 144 and the linear-prediction-domain parameter information 146 on the basis of the time domain representation 142 may also be applied in some embodiments.

1.3. Details Regarding the Aliasing Cancellation Information Provision

In the following, some details regarding the aliasing cancellation information provision 160 will be explained, which is used to provide the aliasing cancellation information 164.

It should be noted that the aliasing cancellation information is selectively provided a transition from a portion of the audio content encoded in the transform domain mode (for example in the frequency domain mode or in the TCX-LPD mode) to a subsequent portion of the audio content encoded in the ACELP mode, while the provision of an aliasing cancellation information is omitted at a transition from a portion of the audio content encoded in the transform domain mode to a subsequent portion of the audio content also encoded in the transform domain mode. The aliasing cancellation information 164 may, for example, encode a signal which is adapted to cancel aliasing artifacts which are included in a time domain representation of a portion of the audio content obtained by an individual decoding (without overlap-and add with a time-domain representation of a subsequent portion of the audio content encoded in the transform-domain mode) of the portion of the audio content on the basis of the set of spectral coefficients 124 and the noise shaping information 126.

As described above, a time domain representation obtained by the decoding of a single audio frame on the basis of the set of spectral coefficients 124 and on the basis of the noise shaping information 126 comprises a time domain aliasing, which is caused by the use of a lapped transform in the time-domain-to-frequency-domain conversion and also in the frequency-domain-to-time-domain converter of an audio decoder.

The aliasing cancellation information provision 160 may, for example, comprise a synthesis result computation 170, which is configured to compute a synthesis result signal 170*a* such that the synthesis result signal 170*a* describes a synthesis result which will also be obtained in an audio signal decoder by an individual decoding of the current portion of the audio content on the basis of the set of spectral coefficients 124 and the noise shaping information 126. The synthesis result signal 170*a* may be fed into an error computation 172, which may also receive the input representation 110 of the audio content. The error computation 172 may compare the synthesis result signal 170*a* with the input representation 110 of the audio content and provide an error signal 172*a*. The error signal 172*a* describes a difference between a synthesis result obtainable by an audio signal decoder and the input representation 110 of the audio content. As a main contribution of the error signal 172 is typically determined by a time domain aliasing, the error signal 172 is well-suited for a decoder-sided aliasing cancellation. The aliasing cancellation information provision 160 also comprises an error encoding 174, in which the error signal 172*a* is encoded to obtain the aliasing cancellation information 164. Thus, the error signal 172*a* is encoded in a manner which may, optionally, be adapted to expected signal characteristics of the error signal 172*a*, to obtain the aliasing cancellation information 164 such that the aliasing cancellation information describes the error signal 172*a* in a bitrate-efficient manner. Thus, the aliasing cancellation information 164 allows for a decoder-sided reconstruction of an aliasing cancellation signal, which is adapted to reduce or even eliminate aliasing artifacts at a transition from a portion of the audio content encoded in the transform-domain mode to the subsequent portion of the audio content encoded in the ACELP mode.

Different encoding concepts may be used for the error encoding 174. For example, the error signal 172*a* may be encoded by a frequency domain encoding (which comprises a time-domain-to-frequency-domain conversion, to obtain spectral values, and a quantization and an encoding of said spectral values). Different types of noise shaping of the quantization noise may be applied. Alternatively, however, different audio encoding concepts can be used to encode the error signal 172*a*.

Moreover, additional error cancellation signals, which may be derived in an audio decoder, may be considered in the error computation 172.

2. Audio Signal Decoder According to FIG. 3

Figure 3:
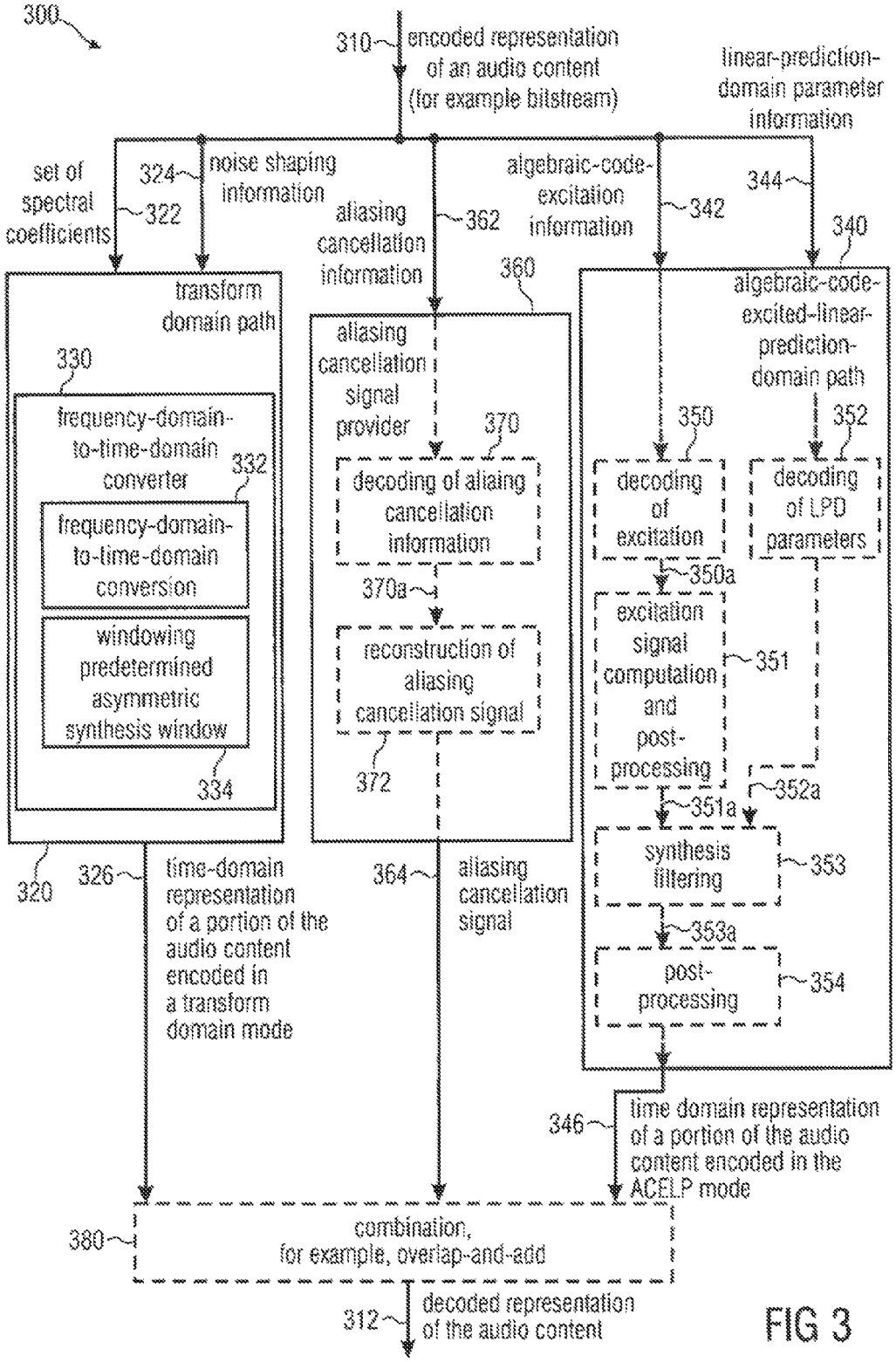
FIG. 3 shows a block schematic diagram of an audio signal decoder, according to an embodiment of the invention.

In the following, an audio signal decoder will be described, which is configured to receive the encoded audio representation 112 provided by the audio signal encoder 100 and to decode said encoded representation of the audio content. FIG. 3 shows a block schematic diagram of such an audio signal decoder 300, according to an embodiment of the invention.

The audio signal decoder 300 is configured to receive an encoded representation 310 of an audio content and to provide, on the basis thereof, a decoded representation 312 of the audio content.

The audio signal decoder 300 comprises a transform domain path 320, which is configured to receive a set of spectral coefficients 322 and a noise shaping information 324. The transform domain path 320 is configured to obtain a time domain representation 326 of a portion of the audio content encoded in a transform domain mode (for example, a frequency domain mode or a transform-coded-excitation-linear-prediction-domain-mode) on the basis of the set of spectral coefficients 322 and the noise shaping information 324. The audio signal decoder 300 also comprises an algebraic-code-excited linear-prediction-domain path 340. The algebraic-code-excited-linear-prediction-domain path 340 is configured to receive an algebraic-code-excitation information 342 and a linear-prediction-domain parameter information 344. The algebraic-code-excited linear-prediction-domain path 340 is configured to obtain a time domain representation 346 of a portion of the audio content encoded in the algebraic-code-excited liner-prediction-domain mode on the basis of the algebraic-code-excitation information 342 and the linear-prediction-domain parameter information 344.

The audio signal decoder 300 further comprises an aliasing cancellation signal provider 360 which is configured to receive an aliasing cancellation information 362 and to provide, on the basis thereof, an aliasing cancellation signal 364.

The audio signal decoder 300 is further configured to combine, for example using a combining 380, the time domain representation 326 of a portion of the audio content encoded in the transform-domain mode and the time domain representation 346 of a portion of the audio content encoded in the ACELP mode, to obtain the decoded representation 312 of the audio content.

The transform domain path 320 comprises a frequency-domain-to-time-domain converter 330 which is configured to apply a frequency-domain-to-time-domain conversion 332 and a windowing 334, to derive a windowed time domain representation of the audio content from the set of spectral coefficients 322 or a preprocessed version thereof. The frequency-domain-to-time-domain converter 330 is configured to apply a predetermined asymmetric synthesis window for a windowing of a current portion of the audio content encoded in the transform-domain mode and following a previous portion of the audio content encoded in the transform-domain mode both if the current portion of the audio content is followed by a subsequent portion of the audio content encoded in the transform-domain mode and if the current portion of the audio content is followed by a subsequent portion of the audio content encoded in the ACELP mode.

The audio signal decoder (or, more precisely, the aliasing cancellation signal provider 360) is configured to selectively provide an aliasing cancellation signal 364 on the basis of an aliasing cancellation information 362 if the current portion of the audio content (which is encoded in the transform-domain mode) is followed by a subsequent portion of the audio content encoded in the ACELP mode.

Regarding the functionality of the audio signal decoder 300, it can be said that the audio signal decoder 300 is capable of providing a decoded representation 312 of an audio content, portions of which are encoded in different modes, namely in a transform-domain mode and an ACELP mode. For a portion (for example, a frame or a subframe) of the audio content encoded in the transform domain mode, the transform domain path 320 provides a time domain representation 326. However, a time domain representation 326 of a frame of the audio content encoded in the transform-domain mode may comprise a time domain aliasing, because the frequency-domain-to-time-domain converter 330 typically uses an inverse lapped transform to provide the time domain representation 326. In the inverse lapped transform, which may, for example, be an inverse modified discrete cosine transform (IMDCT), a set of spectral coefficients 322 may be mapped onto time domain samples of the frame, wherein the number of time domain samples of the frame may be larger than the number of spectral coefficients 322 associated with said frame. For example, there may be N/2 spectral coefficients associated with an audio frame, and N time domain samples may be provided by the transform domain path 320 for said frame. Accordingly, a substantially aliasing-free time domain representation is obtained by overlapping-and-adding (for example in the combination 380) the (time-shifted) time domain representations obtained for two subsequent frames encoded in the transform domain mode.

However, the aliasing cancellation is more difficult at a transition from a portion of the audio content (for example, a frame or a subframe) encoded in the transform-domain mode to a subsequent portion of the audio content encoded in the ACELP mode. The time domain representation for a frame or a subframe encoded in the transform domain mode temporally extends into a time portion (typically in the form of a block) for which (non-zero) time domain samples are provided by the ACELP branch. Further, a portion of the audio content encoded in the transform-domain mode and preceding a subsequent portion of the audio content encoded in the ACELP mode typically comprises some degree of time domain aliasing, which however, cannot be canceled by the time domain samples provided by the ACELP branch for a portion of the audio content encoded in the ACELP mode (while the time domain aliasing would be substantially canceled by a time domain representation provided by the transform-domain branch if the subsequent portion of the audio content was encoded in the transform-domain mode).

However, the aliasing at a transition from a portion of the audio content encoded in the transform domain mode to a subsequent portion of the audio content encoded in the ACELP mode is reduced, or even eliminated, by the aliasing cancellation signal 364 provided by the aliasing cancellation signal provider 360. For this purpose, the aliasing cancellation signal provider 360 evaluates the aliasing cancellation information and provides, on the basis thereof, a time domain aliasing cancellation signal. The aliasing cancellation signal 364 is added, for example, to a right-sided half (or a shorter right-sided portion) of a time domain representation of, for example, N time domain samples provided for a portion of the audio content encoded in the transform-domain mode by the transform domain path to reduce or even eliminate a time domain aliasing. The aliasing cancellation signal 364 may be added both to a time portion in which the (non-zero) time domain representation 346 of a portion of the audio content encoded in the ACELP mode does not overlap a time domain representation of the audio content encoded in the transform domain mode and to a time portion in which the (non-zero) time domain representation of the portion of the audio content encoded in the ACELP mode overlaps a time domain representation of the previous portion of the audio content encoded in the transform-domain mode. Accordingly, a smooth transition (without "click" artifacts) can be obtained between the portion of the time domain representation encoded in the transform-domain mode and the subsequent portion of the audio content encoded in the ACELP mode. Aliasing artifacts can be reduced or even eliminated at such a transition using the aliasing cancellation signal.

Consequently, the audio signal decoder 300 is capable of efficiently handling a sequence of portions (for example, frames) of the audio content encoded in the transform-domain mode. In such a case, the time domain aliasing is canceled by an overlap-and-add of time domain representations (of, for example, N time domain samples) of subsequent (temporally overlapping) frames encoded in the transform-domain mode. Accordingly, smooth transitions are obtained without any additional overlap. For example, by evaluating N/2 spectral coefficients per audio frame and by using a 50% temporal frame overlap, a critical sampling can be used. A very good coding efficiency is obtained for such a sequence of audio frames encoded in the transform-domain mode while avoiding blocking artifacts.

Also, by using the same predetermined asymmetric synthesis window irrespective of whether the current portion of the audio content which is encoded in the transform-domain mode, is followed by a subsequent portion of the audio content encoded in the transform-domain mode or by a subsequent portion of the audio content encoded in the ACELP mode, the delay can be kept reasonably small.

Moreover, an audio quality of transitions between a portion of the audio content encoded in the transform-domain mode and a subsequent portion of the audio content encoded in the ACELP mode can be kept high, even without using a specifically adapted synthesis window, by using the aliasing cancellation signal, which is provided on the basis of the aliasing cancellation information.

Thus, the audio signal decoder 300 provides a good compromise between a coding efficiency, coding delay and audio quality.

2.1. Details Regarding the Transform Domain Path

In the following, details regarding the transform domain path 320 will be given. For this purpose, examples of implementations of the transform path 320 will be described.

2.1.1. Transform Domain Path According to FIG. 4*a*

Figure 4A:
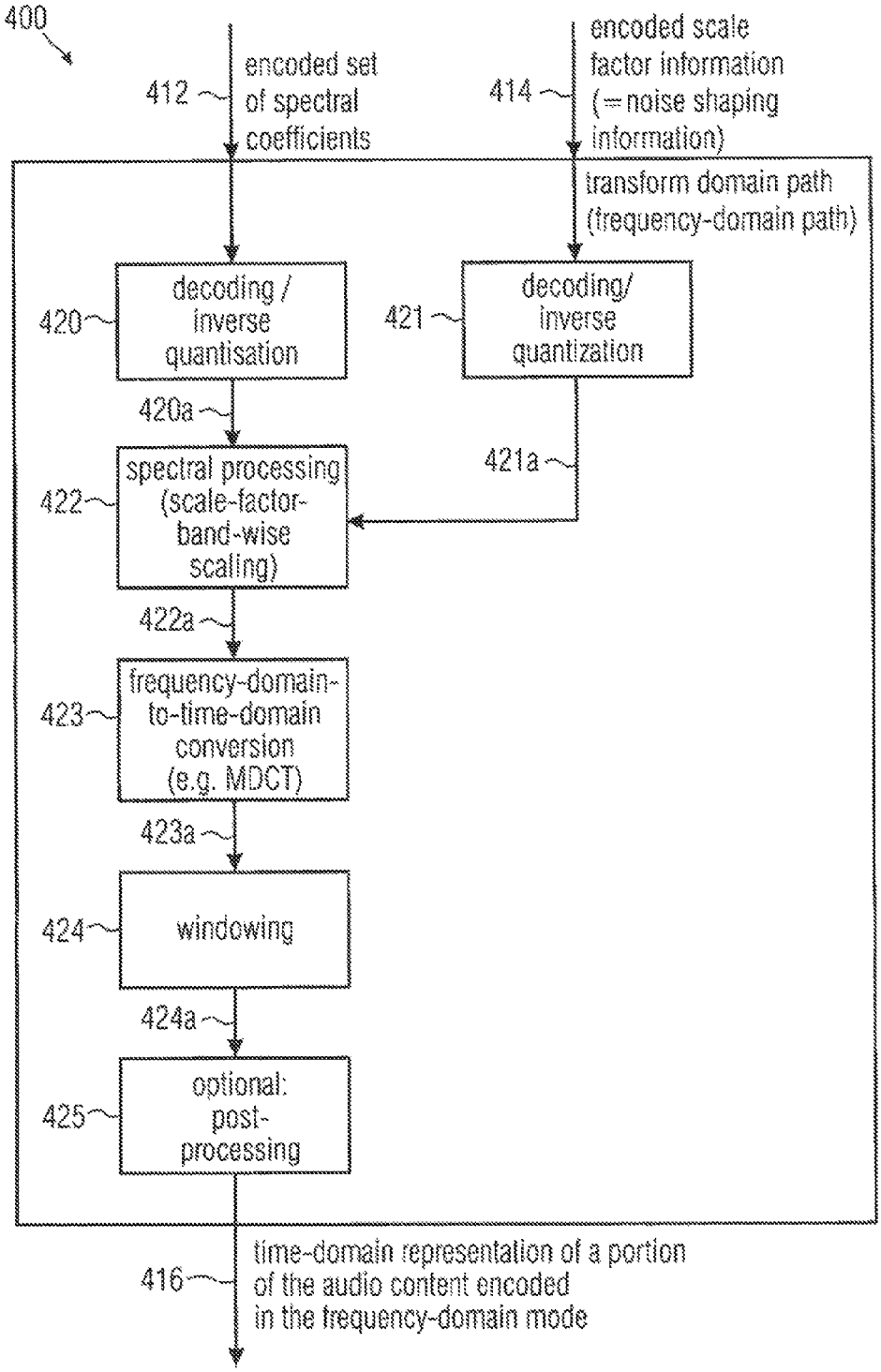
FIGS. 4*a*-4*c* show block schematic diagrams of transform domain paths for use in the audio signal decoder according to FIG. 3

FIG. 4*a* shows a block schematic diagram of a transform domain path 400, which may take the place of the transform domain path 320 in some embodiments according to the invention, and which may be considered as a frequency-domain path.

The transform domain path 400 is configured to receive an encoded set of spectral coefficients 412 and an encoded scale factor information 414. The transform domain path 400 is configured to provide a time domain representation 416 of a portion of the audio content encoded in the frequency domain mode.

The transform domain path 400 comprises a decoding and inverse quantization 420, which receives the encoded set of spectral coefficients 412 and provides, on the basis thereof, a decoded and inversely quantized set of spectral coefficients 420*a*. The transform domain path 400 also comprises a decoding and inverse quantization 421, which receives the encoded scale factor information 414 and provides, on the basis thereof, a decoded and inversely quantized scale factor information 421*a*.

The transform domain path 400 also comprises a spectral processing 422, which spectral processing 422 may, for example, comprise a scale-factor-band-wise scaling of the decoded and inversely quantized spectral coefficients 420*a*. Accordingly, a scaled (i.e. spectrally shaped) set of spectral coefficients 422*a* is obtained. In the spectral processing 422, a (comparatively) small scaling factor may be applied to such scale factor bands which are of comparatively high psychoacoustic relevance, while a (comparatively) large scaling is applied to spectral coefficients of scale factor bands having a comparatively smaller psychoacoustic relevance. Accordingly, it is reached that an effective quantization noise is smaller for spectral coefficients of scale factor bands having a comparatively higher psychoacoustic relevance when compared to an effective quantization noise for spectral coefficients of scale factor bands having a comparatively lower psychoacoustic relevance. In the spectral processing, spectral coefficients 420*a* may be multiplied with respective associated scale factors, to obtain the scaled spectral coefficients 422*a*.

The transform domain path 400 may also comprise a frequency-domain-to-time-domain conversion 423, which is configured to receive the scaled spectral coefficients 422*a* and to provide, on the basis thereof, a time domain signal 423*a*. For example, the frequency-domain-to-time-domain conversion may be an inverse lapped transform, like, for example, an inverse modified discrete cosine transform. Accordingly, the frequency-domain-to-time-domain conversion 423 may provide, for example, a time domain representation 423*a* of N time domain samples on the basis of N/2 scaled (spectrally shaped) spectral coefficients 422*a*. The transform domain path 400 may also comprise a windowing 424, which is applied to the time domain signal 423*a*. For example, a predetermined asymmetric synthesis window, as mentioned above, and as discussed in more detail below, may be applied to the time domain signal 423*a*, to derive therefrom a windowed time domain signal 424*a*. Optionally, a post-processing 425 may be applied to the windowed time domain signal 424*a*, to obtain the time domain representation 426 of a portion of the audio content encoded in the frequency domain mode.

Thus, the transform domain path 420, which may be considered as a frequency domain path, is configured to provide the time domain representation 416 of a portion of the audio content encoded in the frequency domain mode using a scale factor based quantization noise shaping, which is applied in the spectral processing 422. A time domain representation of N time domain samples is provided for a set of N/2 spectral coefficients, wherein the time domain representation 416 comprises some aliasing due to the fact that the number of time domain samples of the time domain representation 416 (for a given frame) is larger (for example, by a factor of 2, or by a different factor) than the number of spectral coefficients of the encoded set of spectral coefficients 412 (for the given frame).

However, as discussed above, the time domain aliasing is reduced or cancelled by an overlap-and-add operation between subsequent portions of the audio content encoded in the frequency domain or by the addition of the aliasing cancellation signal 364 in the case of a transition between a portion of the audio content encoded in the frequency domain mode and a portion of the audio content encoded in the ACELP mode.

2.1.2. Transform Domain Path According to FIG. 4*b*

Figure 4B:
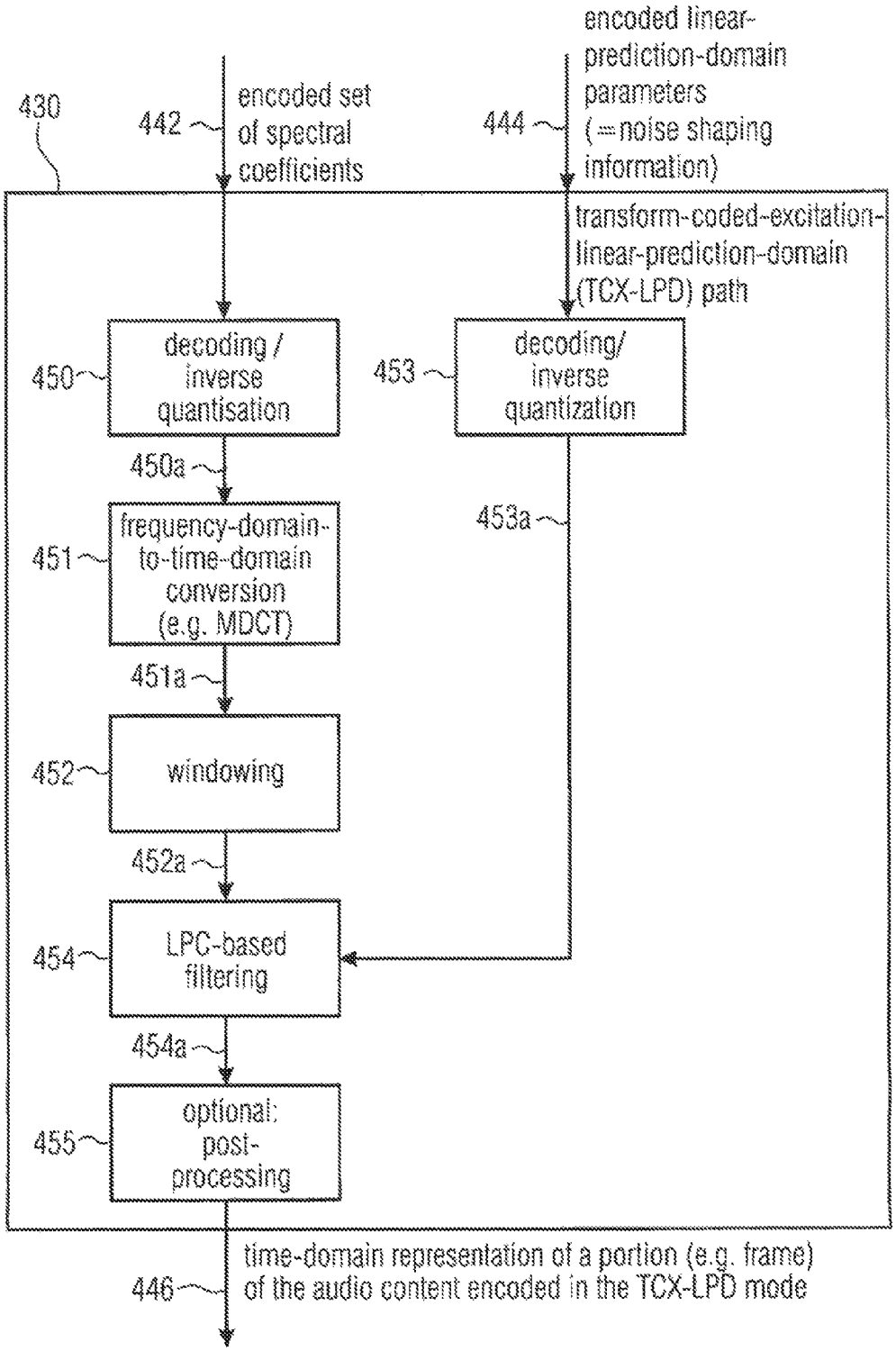

FIG. 4*b* shows a block schematic diagram of a transform-coded-excitation linear-prediction-domain path 430, which is a transform domain path and which may take the place of the transform domain path 320.

The TCX-LPD path 430 is configured to receive an encoded set of spectral coefficients 442 and encoded linear-prediction-domain parameters 444, which may be considered as a noise shaping information. The TCX-LPD path 430 is configured to provide a time domain representation 446 of a portion of the audio content encoded in the TCX-LPD mode on the basis of the encoded set of spectral coefficients 442 and the encoded linear-prediction-domain parameters 444.

The TCX-LPD path 430 comprises a decoding and an inverse quantization 450 of the encoded set of spectral coefficients 442, which provides, as a result of the decoding and inverse quantization, a decoded and inversely quantized set of spectral coefficients 450*a*. The decoded and inversely quantized spectral coefficients 450*a* are input to a frequency-domain-to-time-domain conversion 451, which provides, on the basis of the decoded and inversely quantized spectral coefficients, a time domain signal 451*a*. The frequency-domain-to-time-domain conversion 451 may, for example, comprise the execution of an inverse lapped transform on the basis of the decoded and inversely quantized spectral coefficients 450*a*, in order to provide the time domain signal 451*a* as a result of said inverse lapped transform. For example, an inverse modified discrete cosine transform may be performed to derive the time domain signal 451*a* from the decoded and inversely quantized spectral coefficients 450*a*. A number (for example, N) of time domain samples of the time domain representation 451*a* may be larger than a number (for example, N/2) of spectral coefficients 450*a* input to the frequency-domain-to-time-domain conversion in the case of a lapped transform, such that, for example, N time domain samples of the time domain signal 451*a* may be provided in response to N/2 spectral coefficients 450*a*.

The TCX-LPD path 430 also comprises a windowing 452, in which a synthesis window function is applied for a windowing of the time domain signal 451*a*, to derive a windowed time domain signal 452*a*. For example, a predetermined asymmetric synthesis window may be applied in the windowing 452, to obtain the windowed time domain signal 452*a* as a windowed version of the time domain signal 451*a*. The TCX-LPD path 430 also comprises a decoding and inverse quantization 453, in which a decoded linear-prediction-domain parameter information 453*a* is derived from the encoded linear-prediction-domain parameters 444. The decoded linear-prediction-domain parameter information may, for example, comprise (or describe) filter coefficients for a linear-prediction filter. The filter coefficients may, for example, be decoded as described in the technical specifications "3GPP TS 26.090", "3GPP TS 26.190" and "3GPP TS 26.290" of the Third Generation Partnership Project. Accordingly, the filter coefficients 453*a* may be used in a linear-prediction-coding-based filtering 454, to filter the windowed time domain signal 452*a*. In other words, coefficients of a filter (for example, a finite-impulse-response filter), which is used to derive a filtered time domain signal 454*a* from the windowed time domain signal 452*a*, may be adjusted in accordance with the decoded linear-prediction-domain parameter information 453*a*, which may describe said filter coefficients. Thus, the windowed time domain signal 452*a* may serve as a stimulus signal of a linear-prediction-coding based signal synthesis 454, which is adjusted in accordance with the filter coefficients 453*a*.

Optionally, a post-processing 455 may be applied to derive the time domain representation 446 of a portion of the audio content encoded in the TCX-LPD mode from the filtered time domain signal 454*a*.

To summarize, a filtering 454, which is described by the encoded linear-prediction-domain parameters 444, is applied to derive the time domain representation 446 of a portion of the audio content encoded in the TCX-LPD mode from a filter stimulus signal 452*a*, which is described by the encoded set of the spectral coefficients 442. Accordingly, a good coding efficiency is obtained for such signals which are well-predictable, i.e. which are well adapted to a linear-prediction filter. For such signals, the stimulus can be encoded efficiently by an encoded set of spectral coefficients 442, while the other correlation characteristics of the signal can be considered by the filtering 454, which is determined in dependence on the linear-prediction filter coefficients 453*a*.

However, it should be noted that a time domain aliasing is introduced into the time-domain representation 446 by applying a lapped transform in the frequency-domain-to-time-domain conversion 451. The time domain aliasing can be cancelled by an overlap-and-add of (temporally shifted) time domain representations 446 of subsequent portions of the audio content encoded in the TCX-LPD mode. The time domain aliasing can alternatively be reduced or cancelled using the aliasing cancellation signal 364 at a transition between portions of the audio content encoded in different modes.

2.1.3. Transform Domain Path According to FIG. 4*c*

Figure 4C:
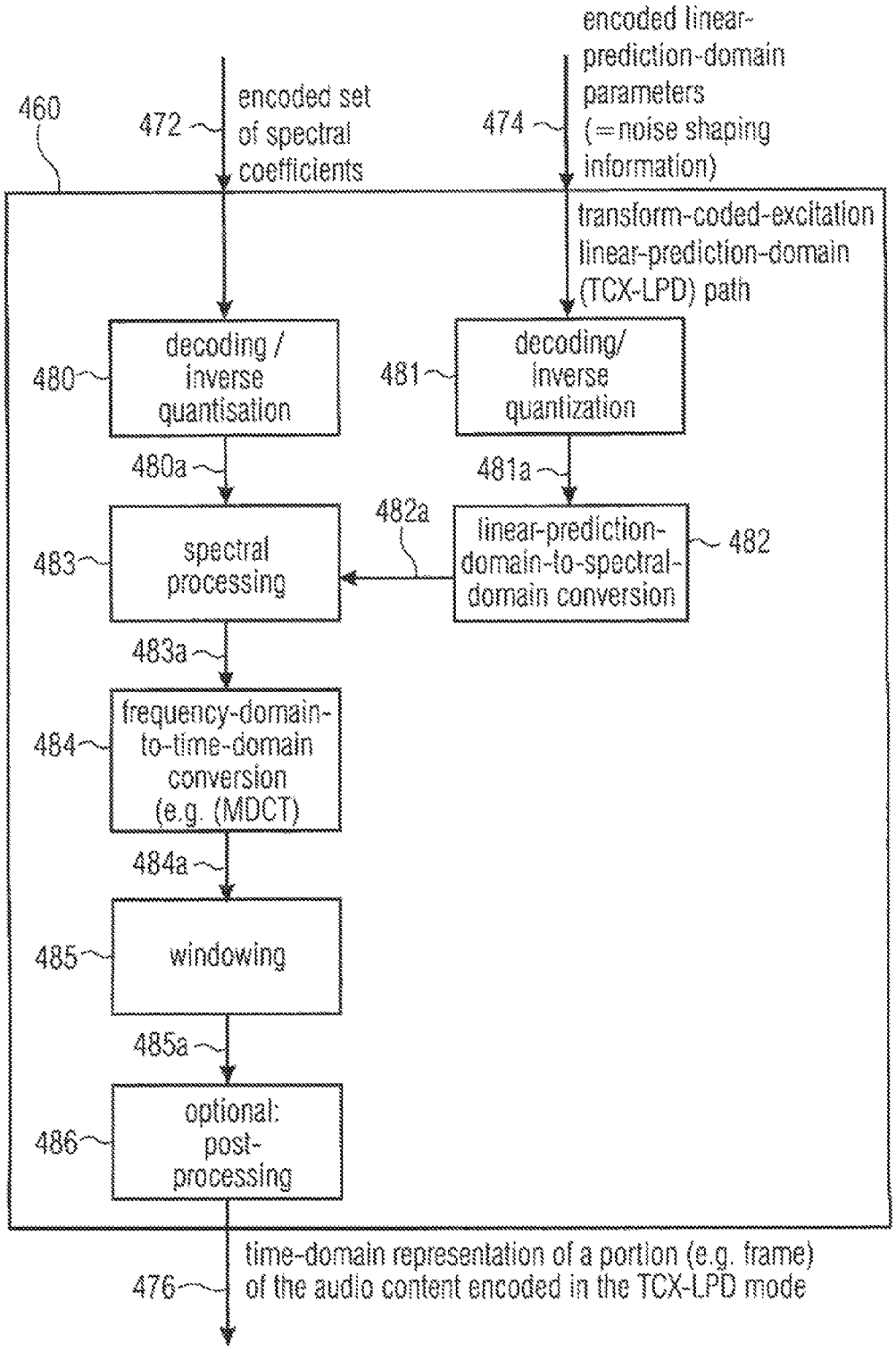

FIG. 4*c* shows a block schematic diagram of a transform domain path 460, which may take the place of the transform domain path 320 in some embodiments according to the invention.

The transform domain path 460 is a transform-coded excitation-linear-prediction-domain path (TCX-LPD path) using a frequency-domain noise shaping. The TCX-LPD path 460 is configured to receive an encoded set of spectral coefficients 472 and encoded linear-prediction-domain parameters 474, which may be considered as a noise-shaping information. The TCX-LPD path 460 is configured to provide, on the basis of the encoded set of spectral coefficients 472 and on the basis of the encoded linear-prediction-domain parameters 472, a time domain representation 476 of a portion of the audio content encoded in the TCX-LPD mode.

The TCX-LPD path 460 comprises a decoding/inverse quantization 480, which is configured to receive the encoded set of spectral coefficients 472 and to provide, on the basis thereof, decoded and inversely quantized spectral coefficients 480*a*. The TCX-LPD path 460 also comprises a decoding and inverse quantization 481 configured to receive the encoded linear-prediction-domain parameters 472 and to provide, on the basis thereof, decoded and inversely quantized linear-prediction-domain parameters 481*a*, like, for example, filter coefficients of a linear-prediction-coding (LPC) filter. The TCX-LPD path 460 also comprises a linear-prediction-domain-to-spectral-domain conversion 482 configured to receive the decoded and inversely quantized linear-prediction-domain parameters 481 and to provide a spectral domain representation 482*a* of the linear-prediction-domain parameters 481*a*. For example, the spectral domain representation 482*a* may be a spectral domain representation of a filter response described by the linear-prediction-domain parameters 481*a*. The TCX-LPD path 460 further comprises a spectral processing 483 which is configured to scale the spectral coefficients 480*a* in dependence on the spectral domain representation 482*a* of the linear prediction domain parameters 481, to obtain a set of scaled spectral coefficients 483*a*. For example, each of the spectral coefficients 480*a* may be multiplied with a scaling factor which is determined in accordance with (or in dependence on) one or more of the spectral coefficients of the spectral domain representation 482*a*. Thus, the weight of the spectral coefficients 480*a* is effectively determined by a spectral response of a linear-prediction-coding filter described by the encoded linear-prediction-domain parameters 472. For example, spectral coefficients 480*a* for frequencies, for which the linear-prediction filter comprises a comparatively large frequency response, may be scaled with a small scaling factor in the spectral processing 483, such that a quantization noise associated with said spectral coefficients

480*a* is reduced. In contrast, spectral coefficients 480*a* for frequencies, for which the linear-prediction filter described by the encoded linear-prediction-domain parameters 472 comprises a comparatively small frequency response, may be scaled with a comparatively higher scaling factor in the spectral processing 483, such that an effective quantization noise is comparatively larger for such spectral coefficients 480*a*. Thus, the spectral processing 483 effectively brings along a shaping of a quantization noise in accordance with the encoded linear-prediction-domain parameters 472.

The scaled spectral coefficients 483*a* are input into a frequency-domain-to-time-domain conversion 484 in order to obtain a time domain signal 484*a*. The frequency-domain-to-time-domain conversion 484 may, for example, comprise a lapped transform, like for example, an inverse modified discrete cosine transform. Accordingly, the time domain representation 484*a* may be the result of the execution of such a frequency-domain-to-time-domain conversion on the basis of the scaled (i.e. spectrally shaped) spectral coefficients 483*a*. It should be noted that a time domain representation 484*a* may comprise a number of time domain samples which is larger than a number of the scaled spectral coefficients 483*a* which are input into the frequency-domain-to-time-domain conversion. Accordingly, the time domain signal 484*a* comprises time domain aliasing components, which are canceled by an overlap-and-add of the time domain representations 476 of subsequent portions (for example, frames or subframes) of the audio content encoded in the TCX-LPD mode, or by the addition of the aliasing cancellation signal 364 in the case of a transition between portions of the audio content encoded in different modes.

The TCX-LPD path 460 also comprises a windowing 485, which is applied to window the time domain signal 484*a* to derive a windowed time domain signal 485*a* therefrom. In the windowing 485, a predetermined asymmetric synthesis window may be used in some embodiments according to the invention, as will be discussed below.

Optionally, a post-processing 486 may be applied to derive the time domain representation 476 from the windowed time domain signal 485*a*.

To summarize the functionality of the TCX-LPD path 460, it can be said that in the spectral processing 483, which is a central part of the TCX-LPD path 460, a noise shaping is applied to the decoded and inversely quantized spectral coefficients 480*a*, wherein the noise shaping is adjusted in dependence on the linear-prediction-domain parameters. Subsequently, a windowed time domain signal 485*a* is provided on the basis of the scaled, noise shaped spectral coefficients 483*a* using the frequency-domain-to-time-domain conversion 484 and the windowing 485, wherein a lapped transform is used which introduces some aliasing.

2.2. Details Regarding the ACELP Path

In the following, some details regarding the ACELP path 340 will be described.

It should be noted that the ACELP path 340 may perform an inverse functionality when compared to the ACELP path 140. The ACELP path 340 comprises a decoding 350 of the algebraic-code-excitation information 342. The decoding 350 provides a decoded algebraic-code-excitation information 350*a* to an excitation signal computation and post-processing 351, which in turn provides an ACELP excitation signal 351*a*. The ACELP path also comprises a decoding 352 of the linear-prediction-domain parameters. The decoding 352 receives the linear-prediction-domain parameter information 344 and provides, on the basis thereof, linear-prediction-domain parameters 352*a*, like, for example, filter coefficients of a linear-prediction filter (also designated as LPC filter). The ACELP path also comprises a synthesis filtering 353, which is configured to filter the excitation signal 351*a* in dependence on the linear-prediction-domain parameters 352*a*. Accordingly, a synthesized time domain signal 353*a* is obtained as a result of the synthesis filtering 353, which is optionally post-processed in a post-processing 354 to derive the time domain representation 346 of a portion of the audio content encoded in the ACELP mode.

The ACELP path is configured to provide a time domain representation of a temporally limited portion of the audio content encoded in the ACELP mode. For example, the time domain representation 346 may self-consistently represent a time domain signal of a portion of the audio content. In other words, the time domain representation 346 may be free from time domain aliasing and may be limited by a block-shaped window. Accordingly, the time domain representation 346 may be sufficient to reconstruct the audio signal of a well-delimited temporal block (having a block-type window shape), even though care has to be taken that there are not blocking artifacts at the boundaries of such a block.

Further details will be described below.

2.3. Details Regarding the Aliasing Cancellation Signal Provider

In the following, some details regarding the aliasing cancellation signal provider 360 will be described. The aliasing cancellation signal provider 360 is configured to receive the aliasing cancellation information 362 and to perform a decoding 370 of the aliasing cancellation information 362, to obtain a decoded aliasing cancellation information 370*a*. The aliasing cancellation signal provider 360 is also configured to perform a reconstruction 372 of the aliasing cancellation signal 364 on the basis of the decoded aliasing cancellation information 370*a*.

The aliasing cancellation information 360 may be encoded in different forms, as described above. For example, the aliasing cancellation information 362 may be encoded in a frequency-domain representation or in a linear-prediction-domain representation. Thus, different quantization noise shaping concepts may be applied in the reconstruction 372 of the aliasing cancellation signal. In some cases, scale factors from a portion of the audio content encoded in the frequency-domain mode may be applied in the reconstruction of the aliasing cancellation signal 364. In some other cases, linear-prediction-domain parameters (for example, linear-prediction filter coefficients) may be applied in the reconstruction 372 of the aliasing cancellation signal 364. Alternatively, or in addition, a noise shaping information may be included in the encoded aliasing cancellation information 362, for example, in addition to a frequency-domain representation. Moreover, additional information from the transform-domain path 320 or from the ACELP branch 340 may optionally be used in the reconstruction 372 of the aliasing cancellation signal 364. Moreover, a windowing may also be used in the reconstruction 372 of the aliasing cancellation signal, as will be described in detail below.

To summarize, different signal decoding concepts may be used to provide the aliasing cancellation signals 364 on the basis of the aliasing cancellation information 362 in dependence on the format of the aliasing cancellation information 362.

3. Windowing and Aliasing Cancellation Concepts

In the following, details regarding a concept of windowing and aliasing cancellation, which may be applied in the audio signal encoder 100 and the audio signal decoder 300, will be described in detail.

In the following, a description of a status of window sequences in a low delay unified-speech-and-audio coding (USAC) will be provided.

In current embodiments of the low delay unified-speech-and-audio coding (USAC) developments, the low delay window from the advanced-audio-coding-enhanced-low-delay (AAC-ELD), which has an extended overlap to the past, is not used. Instead, either a sine window or a low delay window identical or similar to the one used in the ITU-T G.718 standard is used (for example, in the time-domain-to-frequency-domain converter 130 and/or the frequency-domain-to-time-converter 330). This G.718 window has an unsymmetric shape similar to the advanced-audio-coding-enhanced-low-delay window (AAC-ELD window) in order to reduce the delay, but it has only a two-time overlap (2× overlap) i.e. the same overlap as a normal sine window. The following figures (in particular FIGS. 5 to 9) illustrate the differences between a sine window and a G.718 window.

It should be noted that in the following figures, a frame length of 400 samples is assumed in order to make the grid of the figure fit better to the windows. However, in a real system, a frame length of 512 is advantageous.

3.1. Comparison Between a Sine Window and a G.718 Analysis Window (FIGS. 5 to 9)

Figure 5:
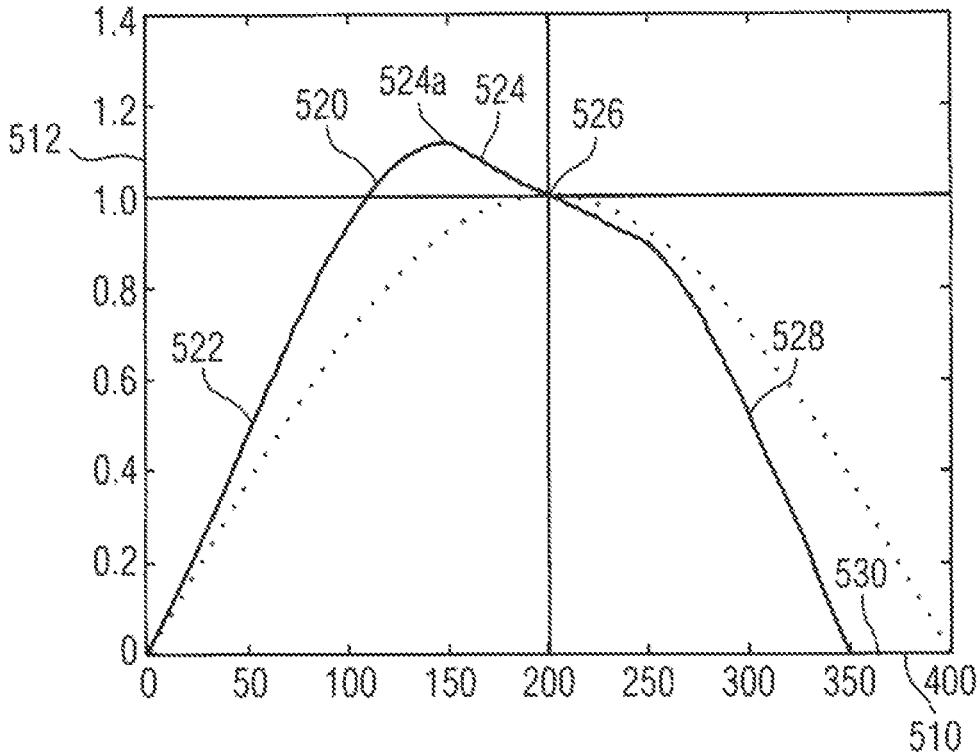
FIG. 5 shows a comparison of a sine window (dotted line) and a G.718 analysis window (solid line), which is used in some embodiments according to the invention.

FIG. 5 shows a comparison of a sine window (represented by a dotted line) and a G.718 analysis window (represented by a solid line). Taking reference to FIG. 5, which shows a graphic representation of the window values of a sine window and a G.718 analysis window, it should be noted that an abscissa 510 describes a time in terms of time domain samples having sample indices between 0 and 400, and that an ordinate 512 describes the window values (which may, for example, be normalized window values).

As can be seen in FIG. 5, the G.718 analysis window, which is represented by a solid line 520, is asymmetric. As can be seen, a left window half (time domain samples 0 to 199) comprises a transition slope 522, in which the window values monotonically increase from 0 to a window center value of 1 and an overshoot portion 524 in which the window values are larger than the window center value of 1. In the overshoot portion 524, the window comprises a maximum 524*a*. The G.718 analysis window 520 also comprises a center value of 1 at a center 526. The G.718 analysis window 520 also comprises a right window half (time domain samples 201 to 400). The right window half comprises a right-sided transition slope 520*a* in which the window values monotonically decrease from the window center value of 1 down to 0. The right window half also comprises a right-sided zero portion 530. It should be noted here that the G.718 analysis window 520 can be used in the time-domain-to-frequency-domain converter 130 in order to window a portion (for example, a frame or subframe) having a frame length of 400 samples, wherein the last 50 samples of said frame may be left unconsidered due to the right-sided zero portion 530 of the G.718 analysis window. Accordingly, the time-domain-to-frequency-domain conversion can be started before all 400 samples of the frame are available. Rather, it is sufficient that 350 samples of the currently analyzed frame are available in order to start the time-domain-to-frequency-domain conversion.

Also, the asymmetric shape of the window 520, which comprises an overshoot portion 524 (only) in the left window half, is well-adapted for a low delay signal reconstruction in an audio signal encoder/audio signal decoder processing chain.

To summarize the above, FIG. 5 shows a comparison of a sine window (dotted line) and a G.718 analysis window (solid line), wherein the 50 samples on the right side of the G.718 window 520 result in a delay reduction of 50 samples in the encoder (when compared to an encoder using the sine window).

Figure 6:
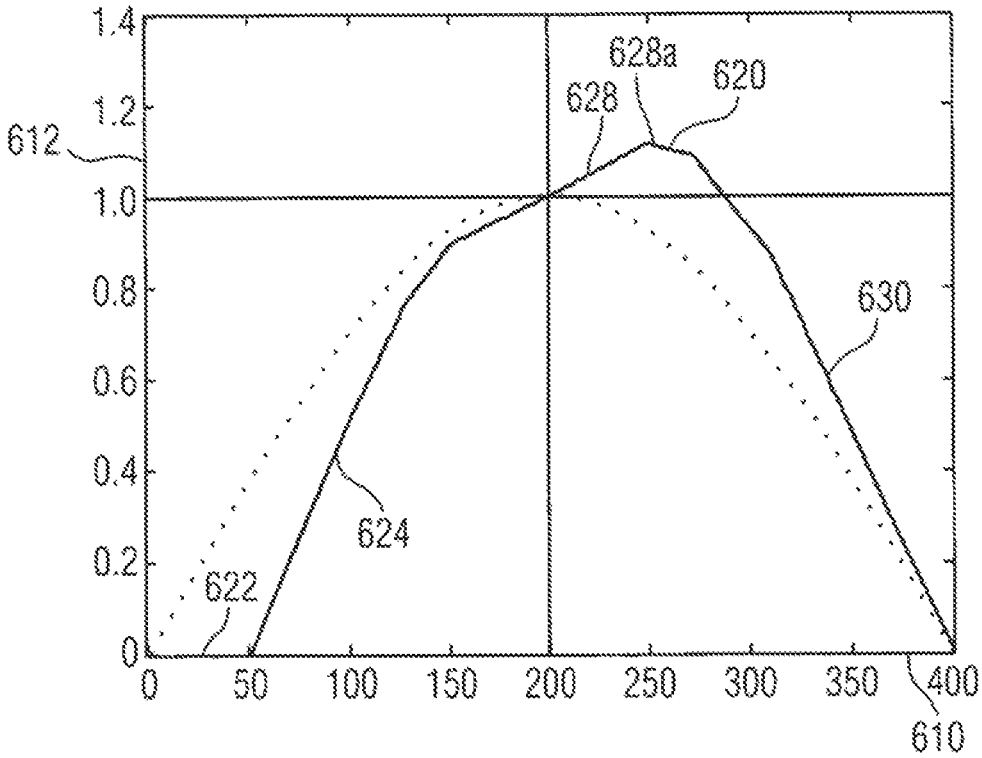
FIG. 6 shows a comparison of a sine window (dotted line) and a G.718 synthesis window (solid line), which is used in some embodiments according to the invention.

FIG. 6 shows a comparison of a sine window (dotted line) and a G.718 synthesis window (solid line). An abscissa 610 describes a time in terms of time domain samples, wherein the time domain samples have sample indices between 0 and 400. An ordinate 612 describes (normalized) window values.

As can be seen, the G.718 synthesis window 620, which may be used for the windowing in the frequency-domain-to-time-domain converter 330, comprises a left window half and a right window half. The left window half (samples 0 to 199) comprises a left-sided zero portion 622 and a left-sided transition slope 624 in which the window values increase monotonically from zero (sample 50) to a window center value of, for example, 1. The G.718 synthesis window 620 also comprises a center window value of 1 (sample 200). A right-sided window portion (samples 201 to 400) comprises an overshoot portion 628, which comprises a maximum 628*a*. The right window half (samples 201 to 400) also comprises a right-sided transition slope 630 in which the window values monotonically decrease from the window center value (1) down to zero.

The G.718 synthesis window 620 may be applied, in a transform-domain path 320, to window the 400 samples of an audio frame encoded in the transform-domain mode. The 50 samples on the left side of the G.718 window (left-sided zero portion 622) result in a delay reduction of another 50 samples in the decoder (for example, when compared to a window comprising a non-zero temporal extension of 400 samples). The delay reduction results from the fact that an audio content of a previous audio frame can be output up to the position of the $50^{th}$ sample of the current portion of the audio content, before the time domain representation of the current portion of the audio content is obtained. Thus, an (non-zero) overlap region between a previous audio frame (or audio subframe) and the current audio frame (or audio subframe) is reduced by the length of the left-sided zero portion 622, which results in a delay reduction when providing a decoded audio representation. However, subsequent frames may be shifted by 50% (for example, by 200 samples). Further details will be discussed below.

To summarize the above, FIG. 6 shows a comparison of a sine window (dotted line) and a G.718 synthesis window (solid line). The 50 samples on the left side of the G.718 window result in a delay reduction of another 50 samples in the decoder. The G.718 synthesis window 620 may be used, for example, in the frequency-domain-to-time-domain converter 330, in the windowing 424, in the windowing 452 or in the windowing 485.

Figure 7:
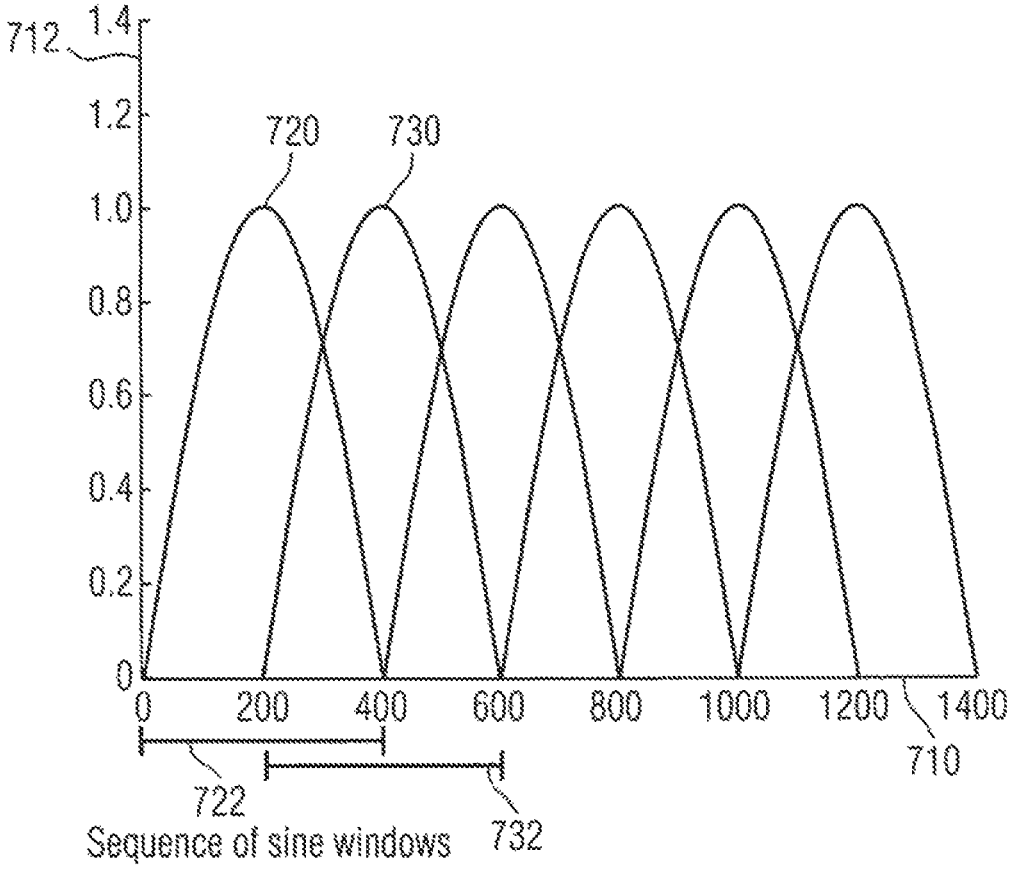
FIG. 7 shows a graphic representation of a sequence of sine windows.

FIG. 7 shows a graphic representation of a sequence of sine windows. An abscissa 710 describes a time in terms of audio sample values, and an ordinate 712 describes normalized window values. As can be seen, a first sine window 720 is associated with a first audio frame 722 having a frame length of, for example, 400 samples (sample indices between 0 and 399). A second sine window 730 is associated with a second audio frame 732 having a length of 400 audio samples (sample indices between 200 and 599). As can be seen, the second audio frame 732 is offset with respect to the first audio frame 722 by 200 samples. Also, the first audio frame 722 and the second audio frame 732 comprise a temporal overlap of, for example, 200 audio samples (sample indices between 200 and 399). In other words, the first audio frame 722 and the second audio frame 732 comprise a temporal overlap of, approximately, 50% (with a tolerance of, for example, +/−1 sample).

Figure 8:
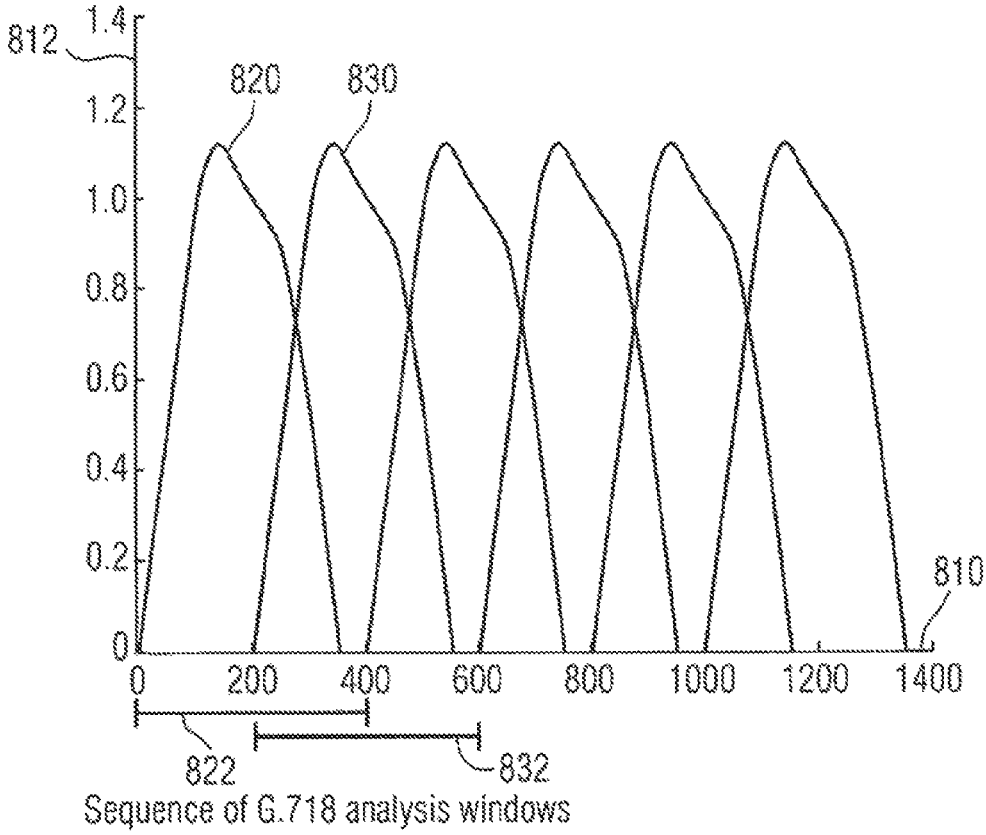
FIG. 8 shows a graphic representation of a sequence of G.718 analysis windows.

FIG. 8 shows a graphic representation of a sequence of G.718 analysis windows. An abscissa 810 describes a time in terms of time domain audio samples, and an ordinate 812 describes normalized window values. A first G.718 analysis window 820 is associated with a first audio frame 822, which extends from sample 0 to sample 399. A second G.718 analysis window 830 is associated with a second audio frame 832, which extends from sample 200 to sample 599. As can be seen, the first G.718 analysis window 820 and the second G.718 analysis window 830 comprise a temporal overlap (when considering only non-zero window values) of, for example, 150 samples (+/−1 sample). Regarding this issue, it should be noted that the first G.718 analysis window 820 is associated with the first frame 822, which extends between samples 0 and 399. However, the first G.718 analysis window 820 comprises a right-sided zero portion of, for example, 50 samples (a right-sided zero portion 530), such that the overlap (measured in terms of non-zero window values) of the analysis windows 820, 830 is reduced to 150 sample values (+/−1 sample value). As can be seen from FIG. 8, there is a temporal overlap between two adjacent audio frames 822, 832 (in total 200 sample values+/−1 sample value) and there is also a temporal overlap (in total 150 samples+/−1 sample) between non-zero portions of two (and no more than two) windows 820, 830.

It should be noted that the sequence of G.718 analysis windows shown in FIG. 8 may be applied by the frequency-domain-to-time-domain converter 130, and by the transform-domain paths 200, 230, 260.

Figure 9:
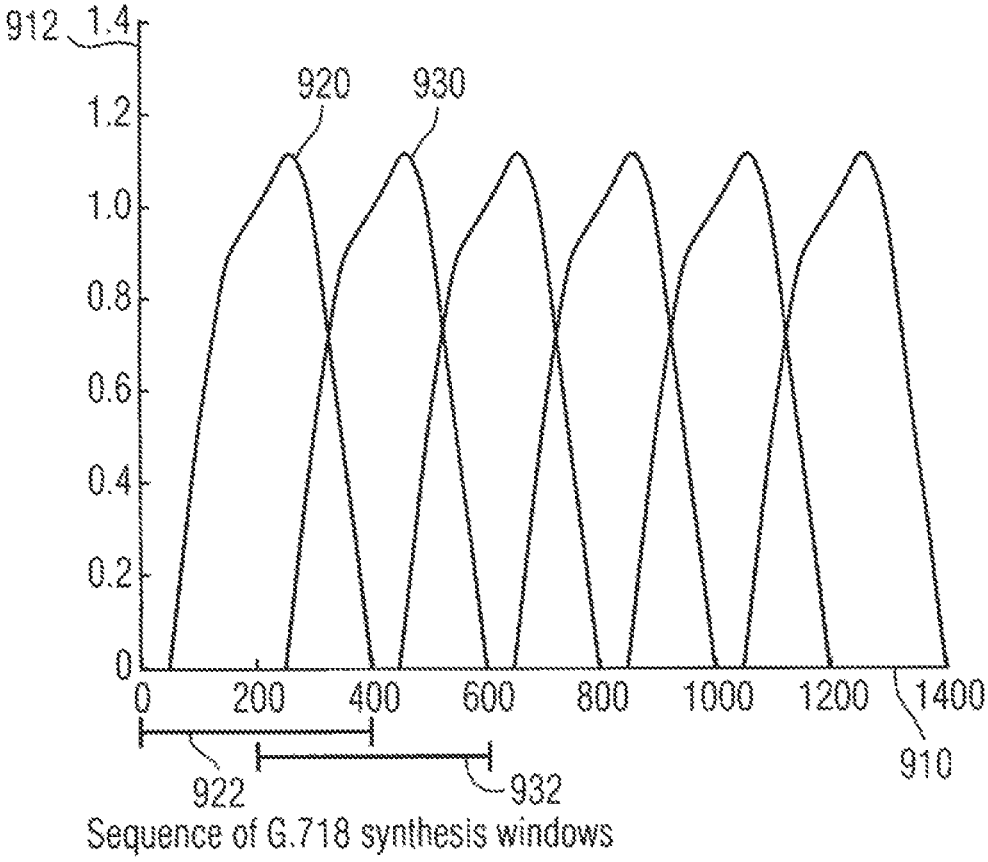
FIG. 9 shows a graphic representation of a sequence of G.718 synthesis windows.

FIG. 9 shows a graphic representation of a sequence of G.718 synthesis windows. An abscissa 910 describes a time in terms of time domain audio samples, and an ordinate 912 describes normalized values of the synthesis windows.

The sequence of G.718 synthesis windows according to FIG. 9 comprises a first G.718 synthesis window 920 and a second G.718 synthesis window 930. The first G.718 synthesis window 920 is associated to a first frame 922 (audio samples 0 to 399), wherein the left-sided zero portion of the G.718 synthesis window 920 (which corresponds to the left-sided zero portion 622) covers a plurality of, for example, approximately 50 samples at the beginning of the first frame 922. Accordingly, a non-zero portion of the first G.718 synthesis window extends, approximately, from sample 50 to sample 399. The second G.718 synthesis window 930 is associated with a second audio frame 932, which extends from audio sample 200 to audio sample 599. As can be seen, a left-sided zero portion of the second G.718 synthesis window 930 extends from samples 200 to 249 and consequently covers a plurality of, for example, approximately 50 samples at the beginning of the second audio frame 932. A non-zero region of the second G.718 synthesis window 930 extends from sample 250 to sample 599. As can be seen, there is overlap region from sample 250 to sample 399 between non-zero regions of the first G.718 synthesis window and the second G.718 synthesis window 930. The additional G.718 synthesis windows are evenly spaced as can be seen in FIG. 9.

3.2. Sequence of Sine Windows and ACELP

Figure 10:
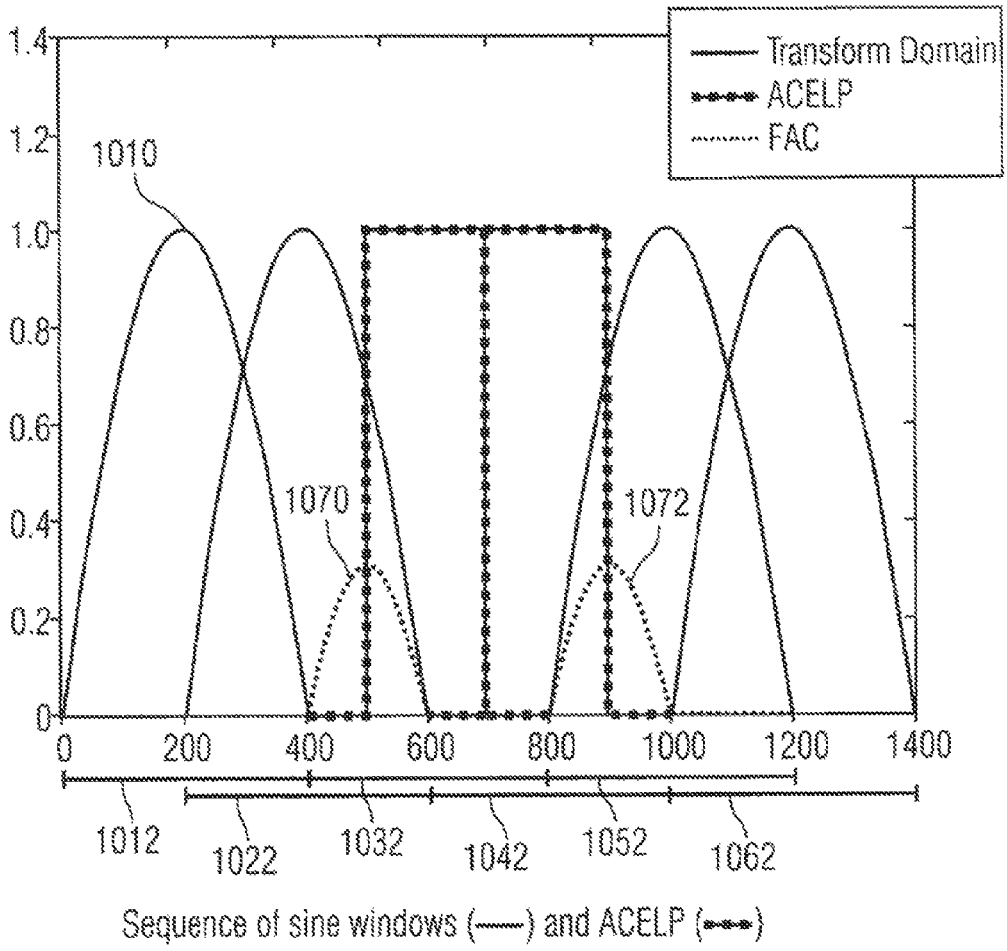
FIG. 10 shows a graphic representation of a sequence of sine windows (solid line) and ACELP (line marked with squares)

FIG. 10 shows a graphic representation of a sequence of sine windows (solid line) and ACELP (line marked with squares). As can be seen, a first transform-domain frame 1012 extends from samples 0 to 399, a second transform-domain audio frame 1022 extends from samples 200 to 599, a first ACELP audio frame 1032 extends from samples 400 to 799, with non-zero values between samples 500 and 700, a second ACELP audio frame 1042 extends from sample 600 to sample 999, with non-zero values between samples 700 and 900, a third transform-domain audio frame 1052 extends from sample 800 to sample 1199, and a fourth transform-domain audio frame 1062 extends from sample 1000 to sample 1399. As can be seen, there is a temporal overlap between the second transform-domain audio frame 1022 and a non-zero portion of the first ACELP audio frame 1032 (between samples 500 and 600). Similarly, there is an overlap between a non-zero portion of the second ACELP audio frame 1042 and the third transform-domain audio frame 1052 (between samples 800 and 900).

A forward aliasing cancellation signal 1070 (shown by a dotted line, and briefly designated with FAC) is provided at a transition from the second transform-domain audio frame 1022 to the first ACELP audio frame 1032, and also at a transition from the second ACELP audio frame 1042 to the third transform-domain audio frame 1052.

As can be seen from FIG. 10, the transitions allow a perfect reconstruction (or at least approximately perfect reconstruction) with the help of the forward aliasing cancellation 1070, 1072 (FAC) which is illustrated by a dotted line. It should be noted that the shape of the forward aliasing cancellation window 1070, 1072 is just an illustration and does not reflect the correct values. For symmetric windows (such as sine windows) this technique is similar, or even identical to, a technique which is also used in the MPEG unified-speech-and-audio coding (USAC).

3.3. Windowing of Mode Transitions—First Option

In the following, a first option for a transition between audio frames encoded in the transform-domain mode and audio frames encoded in the ACELP mode will be described taking reference to FIGS. 11 and 12.

Figure 11:
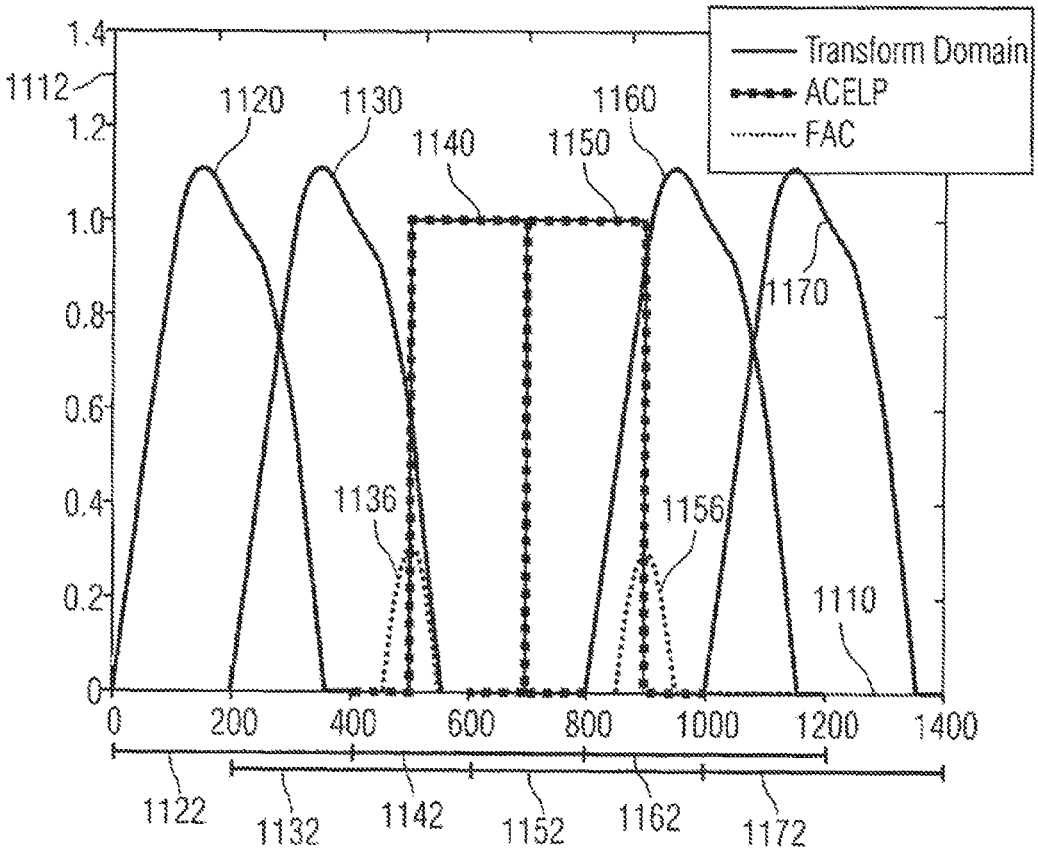
FIG. 11 shows a graphic representation of a first option for a low delay unified-speech-and-audio-coding (USAC) comprising a sequence of G.718 analysis windows (solid line) ACELP (line marked with squares) and forward aliasing cancellation ("FAC") (dotted line)

FIG. 11 shows a schematic representation of a windowing according to a first option for low delay unified-speech-and-audio coding (USAC). FIG. 11 shows a graphic representation of a sequence of G.718 analysis window (solid line), ACELP (line marked with squares) and forward aliasing cancellation (dotted line).

In FIG. 11, an abscissa 1110 describes a time in terms of (time-domain) audio samples and an ordinate 1112 describes normalized window values. A first audio frame, which is encoded in the transform-domain mode, extends from samples 0 to 399 and is designated with reference numeral 1122. A second audio frame, which is encoded in the transform-domain mode, and which extends from samples 200 to 599, is designated with 1132. A third audio frame, which is encoded in the ACELP mode, extends from audio samples 400 to 799 and is designated with 1142. A fourth audio frame, which is also encoded in the ACELP mode, extends from samples 600 to 999 and is designated with 1152. A fifth audio frame, which extends from audio samples 800 to 1199, is encoded in the transform-domain mode and is designated with 1162. A sixth audio frame, which is encoded in the transform-domain mode, and which extends from audio samples 1000 to 1399, is designated with 1172.

As can be seen, the audio samples of the first audio frame 1122 are windowed using a G.718 analysis window 1120, which may, for example, be identical to the G.718 analysis window 520 shown in FIG. 5. Similarly, the audio samples (time domain samples) of the second audio frame 1132 are windowed using the G.718 analysis window 1130, which comprises a non-zero overlap region with the G.718 analysis window 1120 between samples 200 and 350 as can be seen in FIG. 11. For the audio frame 1142, a block of audio samples having sample indices between 500 and 700 are encoded in the ACELP mode. However, audio samples having sample indices between 400 and 500 and also between 700 and 800 are not considered in the ACELP parameters (algebraic code excitation information and linear-prediction-domain parameter information) associated to the third audio frame 1142. Thus, the ACELP information (algebraic code excitation information 144 and linear-prediction-domain parameter information 146) associated to the third audio frame 1142 merely allows the reconstruction of audio samples having sample indices between 500 and 700. Similarly, a block of audio samples having sample indices between 700 and 900 are encoded in the ACELP information associated to the fourth audio frame 1152. In other words, for the audio frames 1142, 1152 encoded in the ACELP mode, only a temporally limited block of audio samples at the center of the respective audio frames 1142, 1152 is considered in the ACELP coding. In contrast, an extended left-sided zero portion (for example, approximately 100 samples) and an extended right-sided zero portion (for example, about 100 samples) are left unconsidered in the ACELP coding for an audio frame encoded in the ACELP mode. Thus, it should be noted that the ACELP coding of an audio frame encodes approximately 200 non-zero time domain samples (for example, samples 500 to 700 for the third frame 1142 and samples 700 to 900 for the fourth frame 1152). In contrast, a higher number of non-zero audio samples are encoded per audio frame in the transform-domain mode. For example, approximately 350 audio samples are encoded for an audio frame encoded in the transform-domain mode (for example, audio samples 0 to 349 for the first audio frame 1122 and audio samples 200 to 549 for the second audio frame 1132). Moreover, a G.718 analysis window 1160 is applied to window the time domain samples for a transform-domain encoding of the fifth audio frame 1162. A G.718 analysis window 1170 is applied to window the time domain samples for a transform domain encoding of the sixth audio frame 1172.

As can be seen, the right-sided transition slope (non-zero portion) of the G.718 analysis window 1130 temporally overlaps with a block 1140 of (non-zero) audio samples encoded for the third audio frame 1142. However, the fact that the right-sided transition slope of the G.718 window 1130 does not overlap with a left-sided transition slope of a subsequent G.718 analysis window would result in the occurrence of time domain aliasing components. However, such time domain aliasing components are determined using a forward-aliasing-cancellation windowing (FAC window 1136) and encoded in the form of the aliasing cancellation information 164. In other words, a time domain aliasing, which appears at a transition from an audio frame encoded in the transform-domain mode and a subsequent audio frame encoded in the ACELP mode is determined using a FAC window 1136 and encoded to obtain the aliasing cancellation information 164. The FAC window 1136 may be applied in the error computation 172 or in the error encoding 174 of the audio signal encoder 100. Thus, the aliasing cancellation information 164 may represent, in an encoded form, an aliasing which appears at a transition from the second audio frame 1132 to the third audio frame 1142, wherein the forward aliasing cancellation window 1136 may be used to weight the aliasing (for example, the estimate of the aliasing obtained in an audio signal encoder).

Similarly, an aliasing may appear at a transition from the fourth audio frame 1152 encoded in the ACELP mode to the fifth audio frame 1162 encoded in the transform-domain mode. The aliasing at this transition, which is caused by the fact that the left-sided transition portion of the G.718 analysis window 1162 does not overlap with a right-sided transition slope of a preceding G.718 analysis window, but rather with a block of time domain audio samples encoded in the ACELP mode, is determined (for example, using the synthesis result computation 170 and the error computation 172) and encoded, for example, using the error encoding 174, to obtain an aliasing cancellation information 164. In the encoding 174 of the aliasing signal, a forwards aliasing cancellation window 1156 may be applied.

To summarize, an aliasing cancellation information is selectively provided at the transition from the second frame 1132 to the third frame 1142 and also at the transition from the fourth frame 1152 to the fifth frame 1162.

To further summarize, FIG. 11 shows a first option for a low delay unified-speech-and-audio coding. FIG. 11 shows a sequence of G.718 analysis windows (solid line), ACELP (line marked with squares) and FAC (dotted line). It has been found that for asymmetric windows such as the G.718 window, a combination with FAC brings along significant improvements over the conventional concepts. In particular, a good tradeoff between coding delay, audio quality and coding efficiency is achieved.

Figure 12:
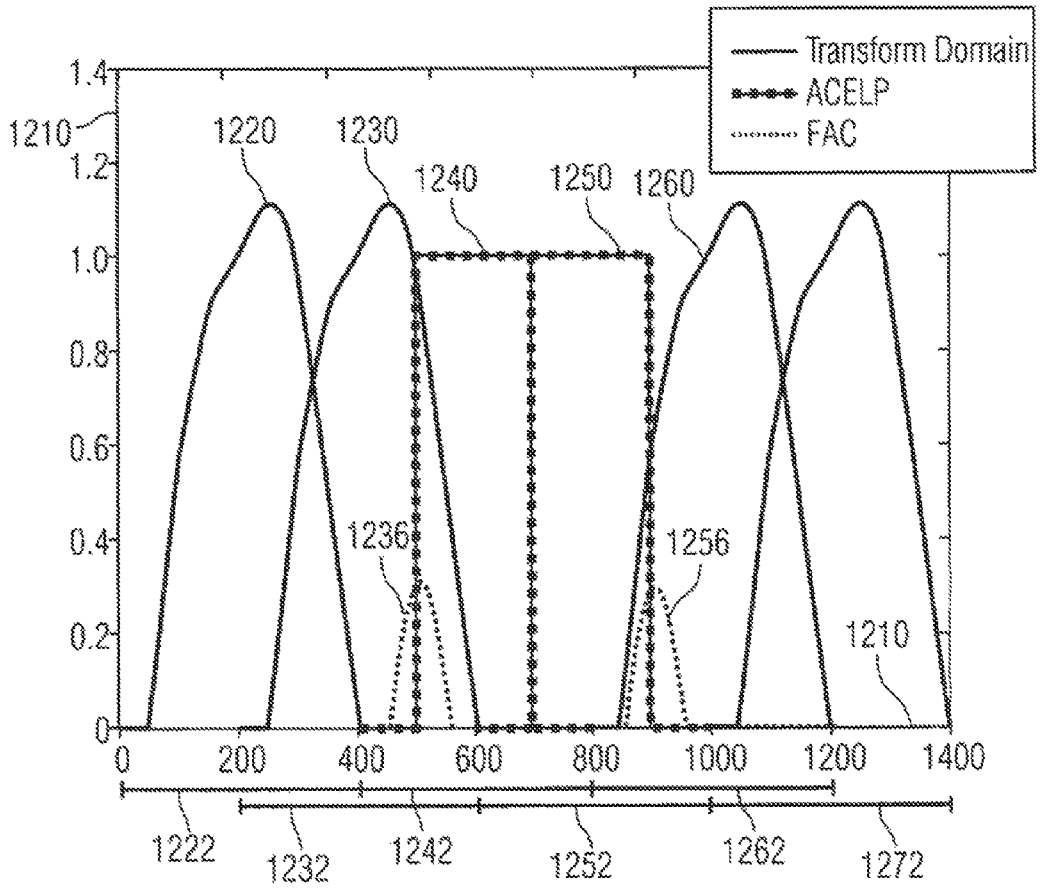
FIG. 12 shows a graphic representation of a sequence for the synthesis corresponding to the first option for low delay unified-speech-and-audio-coding according to FIG. 11.

FIG. 12 shows a graphic representation of a sequence for the synthesis corresponding to the concept according to FIG. 11. In other words, FIG. 12 shows a graphic representation of a framing and windowing, which can be used in an audio signal decoder 300 according to FIG. 3.

An abscissa 1210 describes a time in terms of (time-domain) audio samples, and an ordinate 1212 describes normalized window values. The first audio frame 1222, which is encoded in the transform-domain mode, extends from audio samples 0 to 399, a second audio frame 1232 which is encoded in the transform-domain mode extends from audio samples 200 to 599, a third audio frame 1242, which is encoded in the ACELP mode, extends from audio samples 400 to 799, a fourth audio frame 1252, which is encoded in the ACELP mode, extends from audio samples 600 to 999, a fifth audio frame 1262, which is encoded in the transform domain mode, extends from audio samples 800 to 1199 and a sixth audio frame 1272, which is encoded in the transform-domain mode, extends from audio samples 1000 to 1399. Audio samples provided for the first audio frame 1222 by the frequency-domain-to-time-domain conversion 423, 451, 484 are windowed using a first G.718 synthesis window 1220, which may be identical to the G.718 synthesis window 620, according to FIG. 6. Similarly, audio samples provided for the second audio frame 1232 are windowed using the G.718 synthesis window 1230. Accordingly, audio samples having audio sample indices between 0 and 399 or, more precisely, non-zero audio samples having audio sample indices between 50 and 399) are provided for the first audio frame 1222 (i.e. on the basis of the set of spectral coefficients 322 associated to the first audio frame 1222 and the noise shaping information 324 associated to the first audio frame 1222). Similarly, audio samples having audio sample indices between 200 and 599 are provided for the second audio frame 1232 (with non-zero audio sample having a sample indices between 250 and 599). Thus, there is a temporal overlap between (non-zero) audio samples provided for the first audio frame 1222 and (non-zero) audio samples provided for the second audio frame 1232. Audio samples provided for the first audio frame 1222 are overlapped-and-added with audio samples provided for the second audio frame 1232, to thereby cancel an aliasing. However, audio samples having audio sample indices between 200 and 599, which are provided for the second audio frame 1232, are windowed using the second G.718 synthesis window 1230. For the third audio frame 1242, which is encoded in the ACELP mode, (non-zero) time domain audio samples are provided only within a limited block 1240, as it is typical for an ACELP encoding. However, time domain samples provided for the second audio frame 1232 and windowed using the right-sided transition slope of the G.718 synthesis window 1230 extend into a temporal region defined by the block 1240, for which (non-zero) time domain samples are provided by the ACELP path 340. However, the time domain samples provided by the ACELP path 340 are not sufficient to cancel an aliasing within a right-window half of the G.718 synthesis window 1230. However, an aliasing cancellation signal is provided for canceling an aliasing at the transition from the second frame 1232 encoded in the transform domain mode to the third audio frame 1242 encoded in the ACELP mode (i.e. within the overlap region between the second audio frame 1232 and the third audio frame 1242, which extends from sample 400 to sample 599, or at least within a part of said overlap region). The aliasing cancellation signal is provided on the basis of an aliasing cancellation information 362, which may be extracted from a bitstream representing the encoded audio content. The aliasing cancellation information is decoded (step 370) and the aliasing cancellation signal is reconstructed (step 372) on the basis of the decoded aliasing cancellation information 362. A forward-aliasing-cancellation window 1236 is applied in the reconstruction of the aliasing cancellation signal 364. Accordingly, the aliasing cancellation signal reduces, or even eliminates, an aliasing at a transition between the second audio frame 1232 encoded in the transform-domain mode and the third audio frame 1242 encoded in the ACELP mode, which aliasing would normally be canceled (in the absence of a transition) by (windowed) time domain samples of a subsequent audio frame encoded in the transform domain.

The fourth audio frame 1252 is encoded in the ACELP mode. Accordingly, a block 1250 of time domain samples is provided for the fourth audio frame 1252. However, it should be noted that non-zero audio samples are only provided for a center portion of the fourth audio frame 1252 by the ACELP branch 340. In addition, an extended left-sided zero portion (audio samples 600 to 700) and an extended right-sided zero portion (audio samples 900 to 1000) are provided by the ACELP path for the fourth audio frame 1152.

A time domain representation provided for the fifth audio frame 1262 is windowed using a G.718 synthesis window 1260. A left-sided non-zero portion (transition slope) of the G.718 synthesis window 1260 overlaps temporally with a time portion for which non-zero audio samples are provided by the ACELP path 340 for the fourth audio frame 1252. Thus, audio samples provided by the ACELP path 340 for the fourth audio frame 1252 are overlapped-and-added with audio samples provided by the transform domain path for the fifth audio frame 1262.

In addition, an aliasing cancellation signal 364 is provided at the transition from the fourth audio frame 1252 to the fifth audio frame 1262 (for example, during the temporal overlap between the fourth audio frame 1252 and the fifth audio frame 1262) by the aliasing cancellation signal provider 360 on the basis of the aliasing cancellation information 362. In the reconstruction of the aliasing cancellation signal, an aliasing cancellation window 1256 may be applied. Accordingly, the aliasing cancellation, signal 364 is well-adapted to cancel an aliasing while maintaining the possibility to overlap-and-add time-domain samples of the fourth audio frame 1252 and of the fifth audio frame 1262.

3.4. Windowing of Mode Transitions—Second Option

In the following, a modified windowing of transitions between audio frames encoded in different modes will be described.

Figure 13:
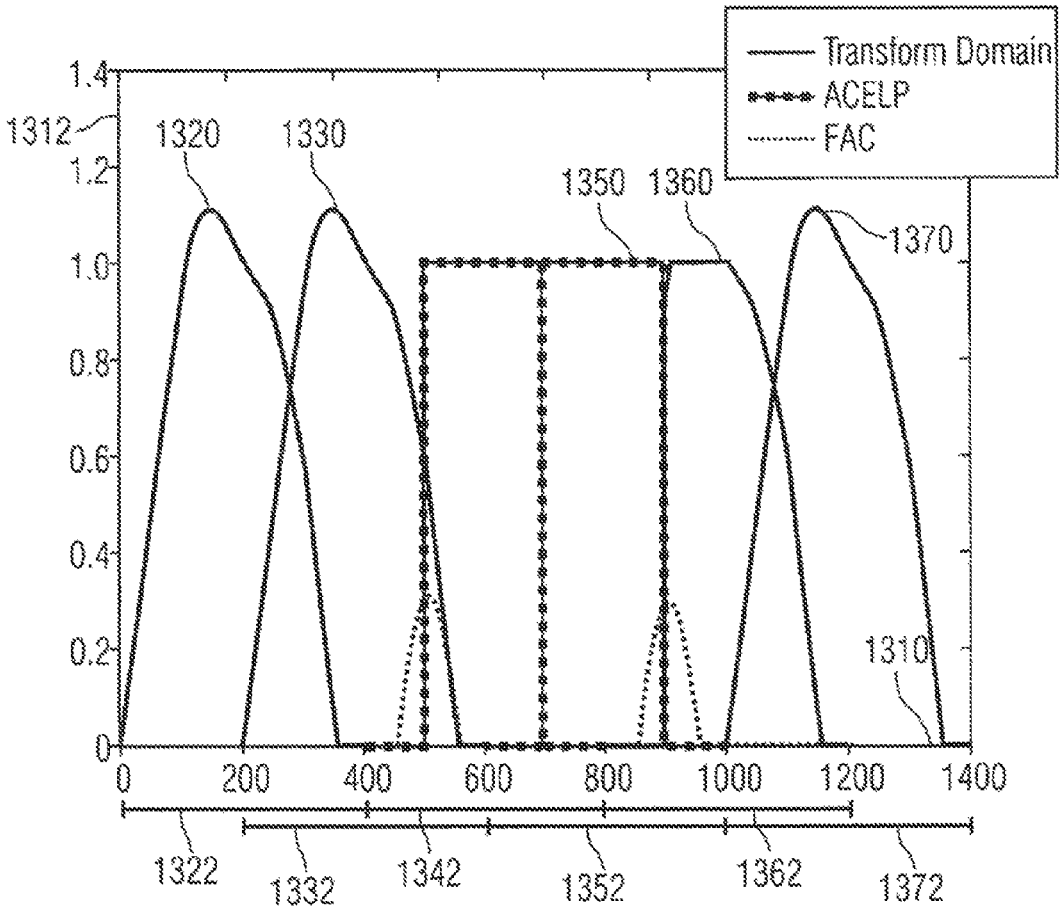
FIG. 13 shows a graphic representation of a second option for a low delay unified-speech-and-audio-coding using a sequence of G.718 analysis windows (solid line), ACELP (line marked with squares) and FAC (dotted line)
Figure 14:
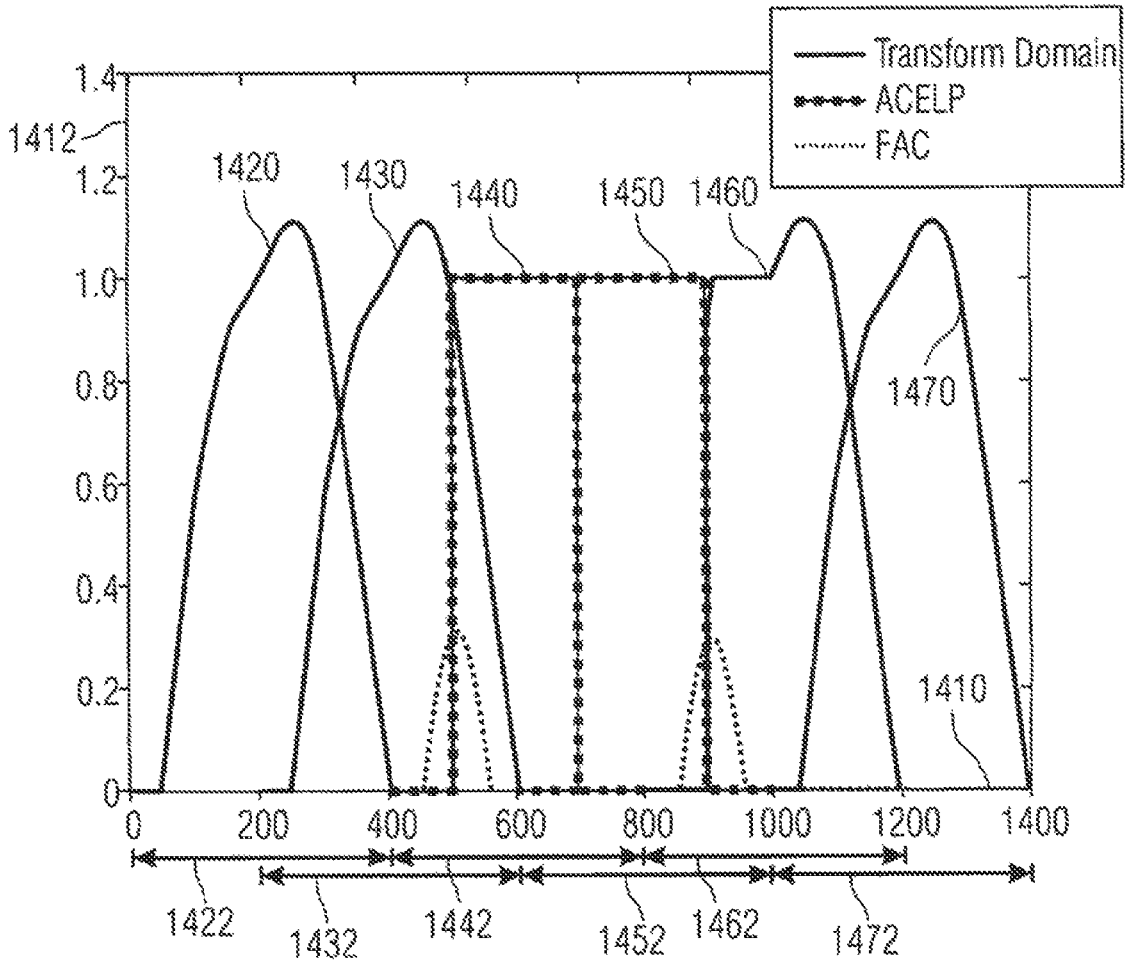
FIG. 14 shows a graphic representation of a sequence for the synthesis corresponding to the second option for low delay unified-speech-and-audio-coding according to FIG. 13.

It should be noted that the windowing scheme according to FIGS. 13 and 14 is identical to the windowing scheme according to FIGS. 11 and 12 in the transition from the transform domain mode to the ACELP mode. However, the windowing scheme according to the FIGS. 13 and 14 is different from the windowing scheme according to the FIGS. 11 and 12 at the transition from the ACELP mode to the transform domain mode.

FIG. 13 shows a graphic representation of the second option for low-delay unified-speech-and-audio coding. FIG. 13 shows a graphic representation of a sequence of G.718 analysis windows (solid line), ACELP (line marked with squares) and forward aliasing cancellation (dotted line).

Forward aliasing cancellation is used only for the transition from the transform coder to ACELP. For the transition from ACELP to the transform coder, a rectangular window shape is used for the left side of the transition window to the transform coding mode.

Taking reference now to FIG. 13, an abscissa 1310 describes a time in terms of time domain audio samples and an ordinate 1312 describes normalized window values. A first audio frame 1322 is encoded in the transform domain mode, a second audio frame 1332 is encoded in the transform domain mode, a third audio frame 1342 is encoded in the ACELP mode, a fourth audio frame 1352 is encoded in the ACELP mode, a fifth audio frame 1362 is encoded in the transform domain mode and a sixth audio frame 1372 is also encoded in the transform domain mode.

It should be noted that the encoding of the first frame 1322, of the second frame 1332 and of the third frame 1342 is identical to the encoding of the first frame 1122, of the second frame 1132 and of the third frame 1142 described with reference to FIG. 11. However, it should be noted that audio samples of the center portion 1350 of the fourth audio frame 1352 are encoded using the ACELP branch 140 only, as can be seen in FIG. 13. In other words, time-domain samples having sample indices between 700 and 900 are considered for the provision of the ACELP information 144, 146 of the fourth audio frame 1352. For the provision of the transform domain information 124, 126 associated with the fifth audio frame 1362, a dedicated transition analysis window 1360 is applied in the time-domain-to-frequency-domain converter 130 (for example, for the windowing 221, 263, 283). Accordingly, time-domain samples, which are encoded by the ACELP path 140 when encoding the fourth audio frame 1352 (preceding the transition from the ACELP coding mode to the transform domain coding mode), are left out of consideration when encoding the fifth audio frame 1362 using the transform domain path 120.

The dedicated transition analysis window 1360 comprises a left-sided transition slope (which may be a step increase in some embodiments, and a very steep increase in some other embodiments), a constant (non-zero) window portion and a right-sided transition slope. However, the dedicated transition analysis window 1360 does not comprise an overshoot portion. Rather, the window values of the dedicated transition analysis window 1360 are limited to the window center value of one of the G.718 analysis windows. It should also be noted that the right window half or the right-sided transition slope of the dedicated transition analysis window 1360 may be identical to the right window half or the right-sided transition slope of the other G.718 analysis window.

The sixth audio frame 1372, which follows the fifth audio frame 1362, is windowed using the G.718 analysis window 1370, which is identical to the G.718 analysis windows 1320, 1330, used for the windowing of the first audio frame 1322 and the second audio frame 1332. In particular, the left-sided transition slope of the G.718 analysis window 1370 overlaps temporally with the right-sided transition slope of the dedicated transition analysis window 1360.

To summarize the above, a dedicated transition window 1360 applied for the windowing of an audio frame encoded in the transform domain following a previous audio frame encoded in the ACELP domain. In this case, audio samples of the previous frame 1352 encoded in the ACELP domain (for example, audio samples having sample indices between 700 and 900) are left out of consideration for the encoding of the subsequent frame 1362 encoded in the transform domain due to the shape of the dedicated transition analysis window 1360. For this purpose, the dedicated transition analysis window 1360 comprises a zero portion for audio samples encoded in the ACELP mode (for example, for the audio samples of the ACELP block 1350).

Accordingly, there is no aliasing at the transition from the ACELP mode to the transform domain mode. However, a dedicated window type, namely the dedicated transition analysis window 1360, has to be applied.

Taking reference now to FIG. 14, a decoding concept will be described, which is adapted to the encoding concept discussed with reference to FIG. 13.

FIG. 14 shows a graphic representation of a sequence for the synthesis corresponding to the analysis according to FIG. 13. In other words, FIG. 14 shows a graphic representation of the sequence of synthesis windows, which may be used in an audio signal decoder 300 according to FIG. 3. An abscissa 1410 describes a time in terms of audio samples and an ordinate 1412 describes normalized window values. A first audio frame 1422 is encoded in the transform domain mode and decoded using a G.718 synthesis window 1420, a second audio frame 1432 is encoded in the transform domain mode and decoded using a G.718 synthesis window 1430, a third audio frame 1442 is encoded in the ACELP mode and decoded to obtain an ACELP block 1440, a fourth audio frame 1452 is encoded in the ACELP mode and decoded to obtain an ACELP block 1450, a fifth audio frame 1462 is encoded in the transform domain mode and decoded using a dedicated transition synthesis window 1460, and a sixth audio frame 1472 is encoded in the transform domain mode and decoded using a G.718 synthesis window 1470.

It should be noted that the decoding of the first audio frame 1422, of the second audio frame 1432 and of the third audio frame 1442 is identical to the decoding of the audio frames 1222, 1232, 1242, which has been described with reference to FIG. 12. However, the decoding at the transition from the fourth audio frame 1452 encoded in the ACELP mode to the fifth audio frame 1462 encoded in the transform domain mode is different.

The dedicated transition synthesis window 1460 differs from the G.718 synthesis window 1260 in that the left window half of the dedicated transition synthesis window 1460 is adapted such that the dedicated transition synthesis window 1460 takes zero values for (non-zero) audio samples, which are provided by the ACELP path 340. In other words, the dedicated transition synthesis window 1460 comprises zero values, such that the transform domain path 320 only provides zero time-domain samples for sample time instances for which the ACELP path provides zero time-domain samples (i.e. for the block 1450). Accordingly, an overlap between (non-zero) time-domain samples provided by the ACELP path for the audio frame 1452 (block of non-zero time domain samples 1450) and time-domain samples provided by the transform domain path 320 for the audio frame 1462 is avoided.

Moreover, it should be noted that, in addition to the left-sided zero portion (samples 800 to 899), the dedicated transition synthesis window 1460 comprises a left-sided constant portion (samples 900 to 999), in which the window values take the center window value (for example, of one). Accordingly, aliasing artifacts are avoided or at least reduced, in the left-sided portion of the dedicated transition synthesis window 260. The right window half of the dedicated transition synthesis window 1460 is identical to the right window half of a G.718 synthesis window.

To summarize the above, a dedicated transition synthesis window 260 is used for the windowing 424, 452, 485, when providing the time-domain representation 326 of the portion of the audio content encoded in the transform-domain mode using the transform-domain path 320 for an audio frame encoded in the transform-domain mode and following a previous audio frame encoded in the ACELP mode. The dedicated transition synthesis window 1460 comprises a left-sided zero portion, which may, for example, make up 50% of the left half of the window (samples 800 to 899) and a left-sided constant portion, which may make up the remaining 50% (+/−1 sample) of the left half of the dedicated transition synthesis window 1460 (samples 900 to 999). The right half of the dedicated transition synthesis window 1460 may be identical to the right half of the G.718 synthesis window and may comprise an overshoot portion and a right-sided transition slope. Accordingly, an aliasing-free transition between the frame 1452 encoded in the ACELP mode and the frame 1462 encoded in the transform-domain mode may be obtained.

Further summarizing, FIG. 13 shows a second option for low-delay unified-speech-and-audio coding. FIG. 13 shows a graphic representation of a sequence of G.718 analysis windows (solid line), ACELP (line marked with squares) and forward aliasing cancellation (dotted line). Forward aliasing cancellation is used only for the transitions from the transform coder (transform-domain path) to ACELP (ACELP path). For the transition from ACELP to the transform coder, a rectangular (or step-like) window shape (for example, samples 800 to 999) is used for the left side of the transition window 1360 to the transform coding mode.

FIG. 14 shows a graphic representation of a sequence for the synthesis corresponding to the analysis of FIG. 13.

3.5. Discussion of the Options

Both options (i.e. the option according to FIGS. 11 and 12 and the option according to FIGS. 13 and 14) are currently considered in the development of a low-delay unified-speech-and-audio coding. The first option (according to FIGS. 11 and 12) has the advantage that the same window with a good frequency response is used for all blocks of the transform coding. However, the disadvantage is that additional data (for example, the forward aliasing cancellation information) has to be coded for the FAC part.

The second option has the advantage that no additional data is necessitated for the forward aliasing cancellation (FAC) in the transition from ACELP to the transform coder. This is especially an advantage if a constant bitrate is necessitated. However, the disadvantage is that the frequency response of the transition window (1360 or 1460) is worse than that of the normal window (1320, 1330, 1370; 1420, 1430, 1470).

3.6. Windowing of Mode Transitions—Third Option

In the following, another option will be discussed. A third option is to use a rectangular window also for the transition of the transform coder to ACELP. However, this third option would cause an additional delay, as the decision between the transform coder and ACELP has to be known one frame in advance then. Thus, this option is not optimal for low-delay unified-speech-and-audio coding. Nevertheless, the third option may be used in some embodiments where delay is not of highest relevance.

4. Alternative Embodiments

4.1. Overview

In the following, another new coding scheme for unified-speech-and-audio-coding (USAC) with low-delay will be described. Specifically, it can be based on switching between the frequency-domain codec AAC-ELD and the time-domain codec AMR-WB or AMR-WB+. The system (or, embodiments according to the invention) maintains the advantage of content-dependent switching between an audio codec and a speech codec, while keeping the delay low enough for communication applications. The low-delay filterbank (LD-MDCT) used in AAC-ELD is utilized and amended by transition windows, which allow a cross-fade to and from a time-domain codec, without introducing any additional delay compared to AAC-ELD.

It should be noted that the concept described in the following may be used in the audio signal encoder 100 according to FIG. 1 and/or in the audio signal decoder 300 according to FIG. 3.

4.2. Reference Example 1

Unified-Speech-and-Audio-Coding (USAC)

A so-called USAC codec allows switching between a music mode and a speech mode. In the music mode, a MDCT-based codec similar to advanced audio coding (AAC) is utilized. In the speech mode, a codec similar to adaptive-multi-rate-wideband+ (AMR-WB+) is utilized, which is called "LPD-mode" in the USAC codec. Special care is taken to allow smooth and efficient transitions between the two modes, as described in the following.

Figure 15:
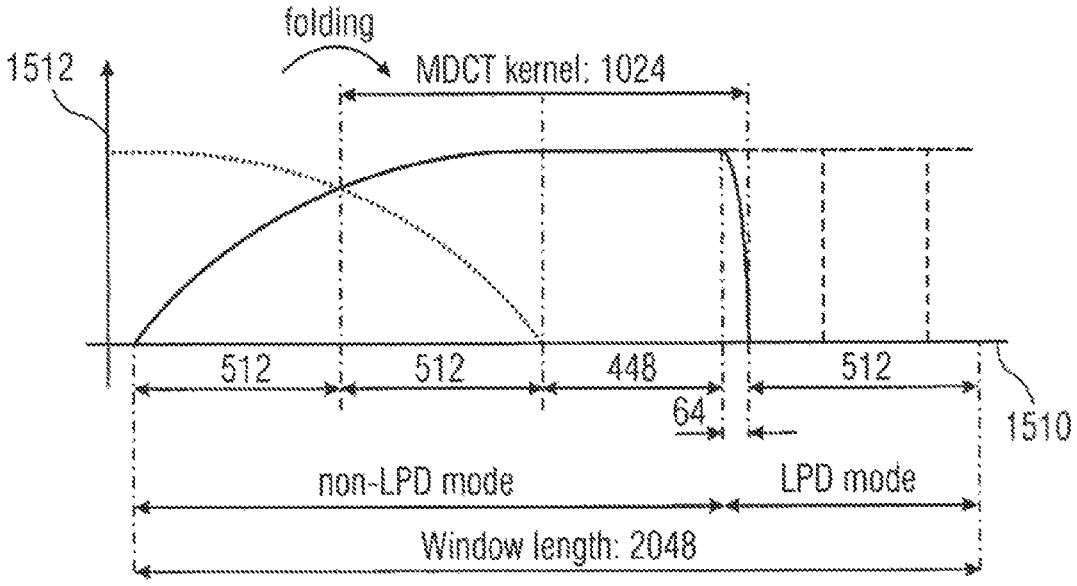
FIG. 15 shows a graphic representation of a transition from advanced-audio-coding (AAC) to adaptive-multi-rate-wideband-plus coding (AMR-WB+)

In the following, a concept for a transition from AAC to AMR-WB+ will be described. Using this concept, the last frame before switching to AMR-WB+ is windowed with a window similar to a "start" window in advanced audio coding (AAC), but with no time-domain aliasing on the right side. A transition area of 64 samples is available, in which the AAC-coded samples are cross-faded to the AMR-WB+-coded samples. This is illustrated in FIG. 15. FIG. 15 shows a graphical representation of a window used at a transition from AAC to AMR-WB+ in a unified-speech-and-audio coding. An abscissa 1510 describes a time, and an ordinate 1512 describes a window value. For details, reference is made to FIG. 15.

Figure 16:
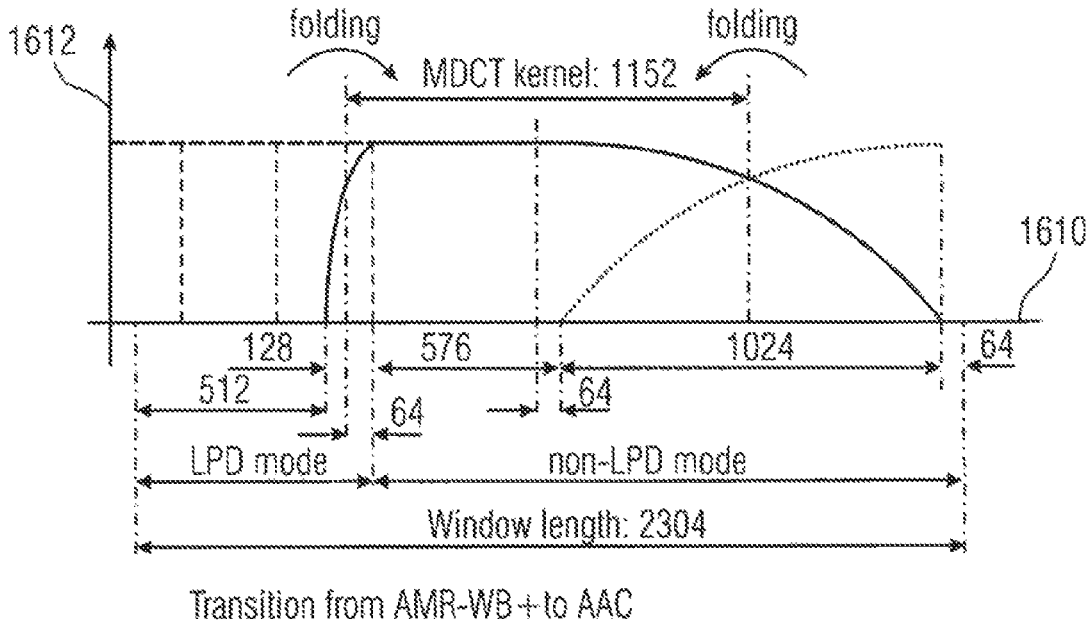
FIG. 16 shows a graphic representation of a transition from adaptive-multi-rate-wideband-plus coding (AMR-WB+) to advanced-audio-coding (AAC)

In the following, a concept for a transition from AMR-WB+ to AAC will be described briny. When switching back to advanced audio coding (AAC), the first AAC frame is windowed with a window identical to the "stop" window of AAC. In this way, time-domain aliasing is introduced in the cross-fade range, which is canceled by intentionally adding the corresponding negative time-domain aliasing in the time-domain-coded AMR-WB+ signal. This is illustrated in FIG. 16, which shows a graphic representation of a concept for a transition from AMR-WB+ to AAC. An abscissa 1610 describes a time in terms of audio samples, and an ordinate 1612 describes window values. For further details, reference is made to FIG. 16.

4.3. Reference Example 2

MPEG-4 Enhanced Low-Delay AAC (AAC-ELD)

Figure 17:
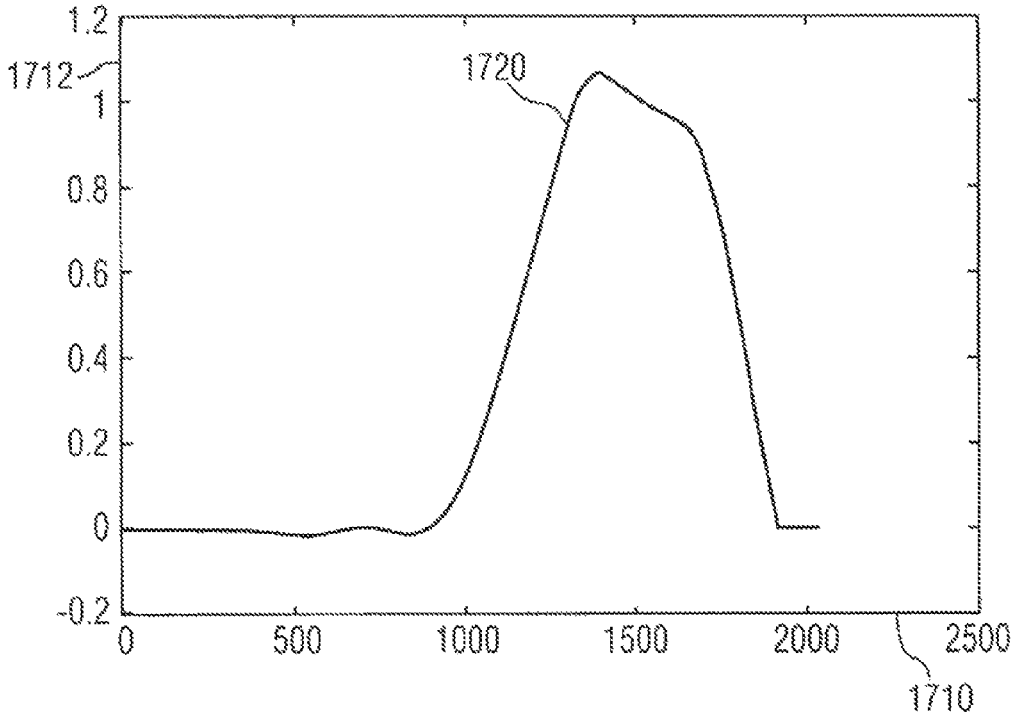
FIG. 17 shows a graphic representation of an analysis window of a low-delay modified-discrete-cosine-transform (LD-MDCT) in advanced-audio-coding with enhanced-low-delay (AAC-ELD)
Figure 18:
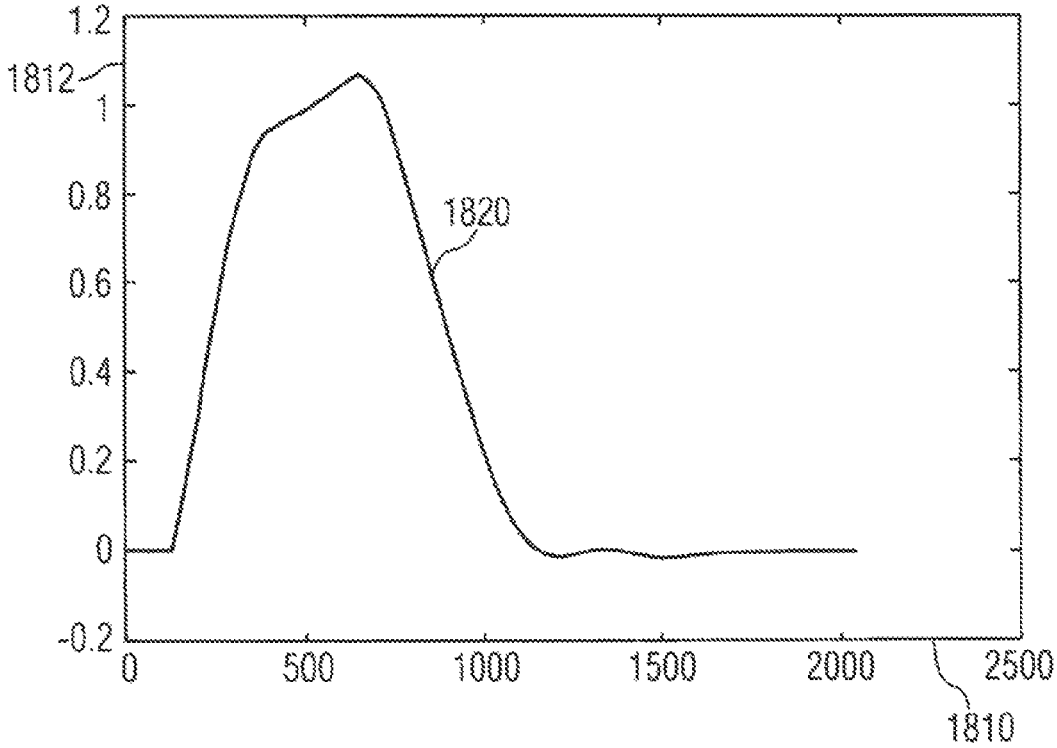
FIG. 18 shows a graphic representation of a synthesis window of low-delay modified-discrete-cosine-transform (LD-MDCT) in advanced-audio-coding-enhanced-low-delay (AAC-ELD)

The so-called "enhanced low-delay AAC" (also briefly designated as "AAC-ELD" or "advanced-audio-coding-enhanced-low-delay") codec is based on a special low-delay flavor of the modified-discrete-cosine transform (MDCT), also called "LD-MDCT". In the LD-MDCT, the overlap is extended to a factor of four, instead of a factor of two for the MDCT. This is achieved without additional delay, as the overlap is added in an unsymmetrical way and it only utilizes samples from the past. On the other hand, the look-ahead to the future is reduced by some zero values on the right side of the analysis window. The analysis and synthesis windows are illustrated in FIGS. 17 and 18, wherein FIG. 17 shows a graphic representation of an analysis window of LD-MDCT in AAC-ELD, and wherein FIG. 18 shows a graphic representation of a synthesis window of LD-MDCT in AAC-ELD. In FIG. 17, an abscissa 1710 describes a time in terms of audio samples, and an ordinate 1712 describes window values. A line 1720 describes the window values of the analysis window. In FIG. 18, an abscissa 1810 describes the time in terms of audio samples, an ordinate 1812 describes window values and a line 1820 describes the synthesis window.

The AAC-ELD coding utilizes only this window and does not utilize any switching of window shape or block length, which would introduce delay. This one window (e.g., the analysis window 1720 according to FIG. 17 for the case of an audio signal encoder, and the synthesis window 1820 according to FIG. 18 for the case of an audio signal decoder) serves well for any type of audio signal, both for stationary and for transient signals.

4.4. Discussion of the Reference Examples

In the following, a brief discussion of the reference examples described in sections 4.2 and 4.3 will be provided.

The USAC codec allows switching between an audio codec and a speech codec, but this switching introduces delay. As there is a transition window necessitated to perform the transition to the speech mode, a look-ahead is necessitated in order to determine whether the following frame is speech-like. If yes, the current frame has to be windowed with the transition window. Thus, this concept is not appropriate for a coding system with a low-delay, which is necessitated for communication applications.

The AAC-ELD codec allows a low-delay for communication applications, but for speech signals coded at low bit rates the performance of this codec lags behind that of dedicated speech codecs (for example, AMR-WB), which also has low delay.

In view of this situation, it has been found that it would therefore be desirable to switch between AAC-ELD and a speech codec in order to have the most efficient coding mode available for both speech and music signals. It has also been found that this switching should ideally not add any additional delay to the system.

It has been found that for the LD-MDCT as used in AAC-ELD such a switching to a speech codec is not possible in a straightforward way. It has also been found that a possible solution of coding the entire time-domain portion covered by the LD-MDCT windows of the speech segment would result in a huge overhead due to the four-times (4×) overlap of the LD-MDCT. In order to replace one frame of frequency-domain coded samples (for example, 512 frequency values), 4×512 time-domain samples would have to be coded in a time-domain coder.

In view of this situation, there is a desire to create a concept which provides a better tradeoff between coding efficiency, delay and audio quality.

4.5. Windowing Concept According to FIGS. 19 to 23*b*

In the following, an approach according to an embodiment of the invention will be described, which allows for an efficient and delay-free switching between AAC-ELD and a time-domain codec.

In the proposed approach presented in this section, the LD-MDCT of the AAC-ELD is utilized (for example, in the time-domain-to-frequency-domain converter 130 or in the frequency-domain-to-time-domain converter 330) and amended by transition windows which allow efficient switching to a time-domain codec, without introducing any additional delay.

Figure 19:
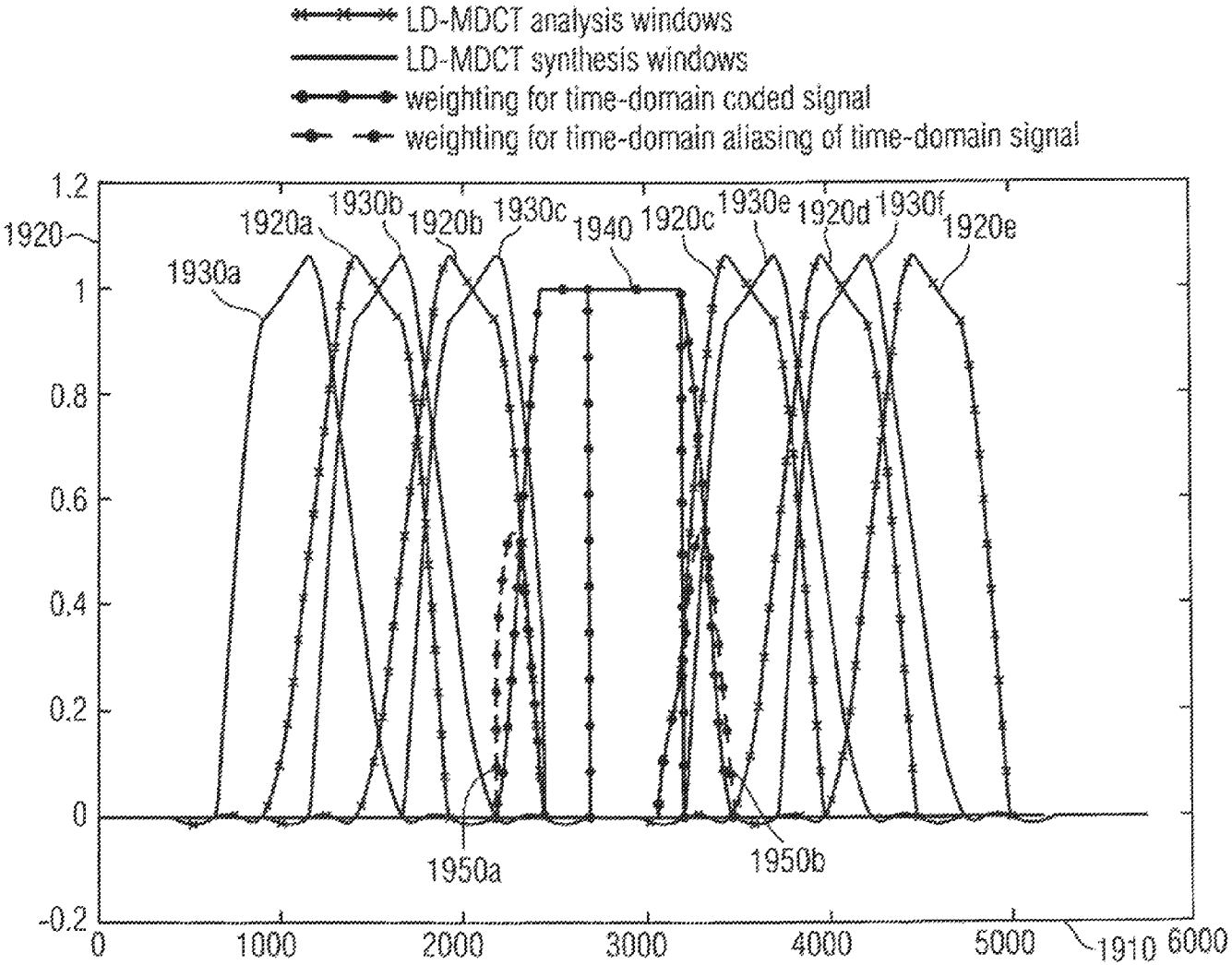
FIG. 19 shows a graphic representation of an example window sequence for switching between advanced-audio-coding-enhanced-low-delay (AAC-ELD) and a time-domain codec.

An example window sequence is shown in FIG. 19. FIG. 19 shows an example window sequence for switching between AAC-ELD and a time-domain codec. In FIG. 19, an abscissa 1910 describes a time in terms of audio samples and an ordinate 1912 describes window values. For details regarding the meaning of the curves, reference is made to the legend of FIG. 19.

For example, FIG. 19 shows LD-MDCT analysis windows 1920*a*-1920*e*, LD-MDCT synthesis windows 1930*a*-1930*e*, a weighting 1940 for a time-domain coded signal and a weighting 1950*a*, 1950*b* for a time-domain aliasing of a time-domain signal.

Figure 20:
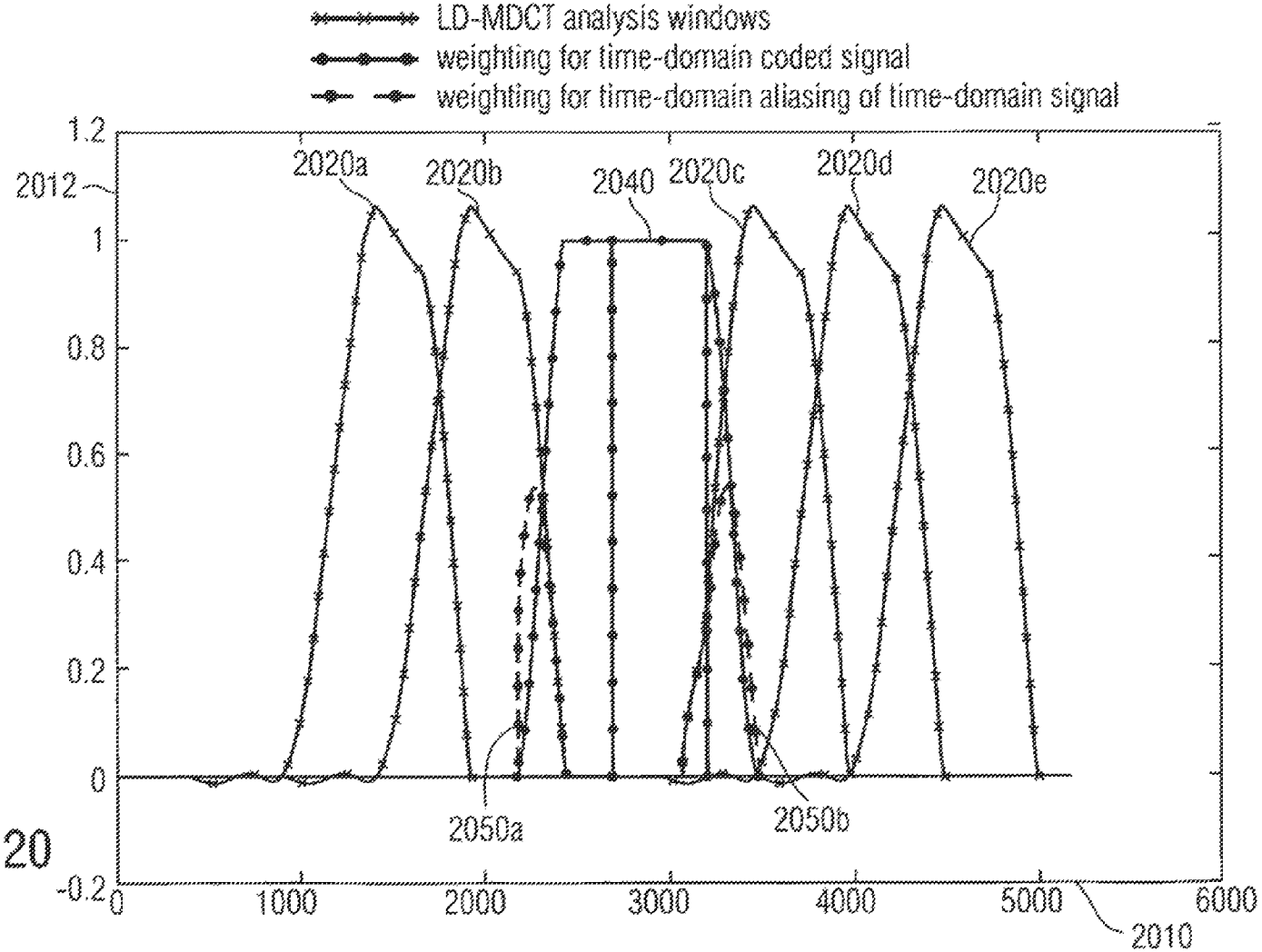
FIG. 20 shows a graphic representation of an example analysis window sequence for switching between advanced-audio-coding-enhanced-low-delay (AAC-ELD) and a time-domain codec.

In the following, details on the analysis windowing will be described. To further explain the sequence of analysis windows, FIG. 20 shows the same sequence (or window sequence) (for example, the same window sequence is shown in FIG. 19) without the synthesis windows. An abscissa 2010 describes a time in terms of audio samples and an ordinate 2012 describes window values. In other words, FIG. 20 shows an example analysis window sequence for switching between AAC-ELD and a time-domain codec. For details regarding the meaning of the lines, reference is made to the legend of FIG. 20.

FIG. 20 shows LD-MDCT analysis windows 2020*a*-2020*e*, a weighting 2040 for a time-domain coded signal, and a weighting 2050*a*, 2050*b* for time-domain aliasing of the time-domain signal.

It can be seen in FIG. 20 that the sequence consists of normal LD-MDCT windows 2020*a*, 2020*b* (as shown in FIG. 17) up to the point where the time-domain codec takes over. There is no special transition window necessitated for the transition from AAC-ELD to the time-domain codec. Thus, no look-ahead is n necessitated for the decision to switch to the time-domain codec, and therefore no additional delay is necessitated.

In the transition from the time-domain codec to AAC-ELD, there is a special transition window 2020*c* necessitated, but only the left part of this window, which overlaps with the time-domain coded signal (indicated by the weighting 2040 for the time-domain coded signal), is different from the normal AAC-ELD windows 2020*a*, 2020*b*, 2020*d*, 2020*e*. This transition window 2020*c* is illustrated in FIG. 21*a*, and compared to the normal AAC-ELD analysis window in FIG. 21*b*.

Figure 21A:
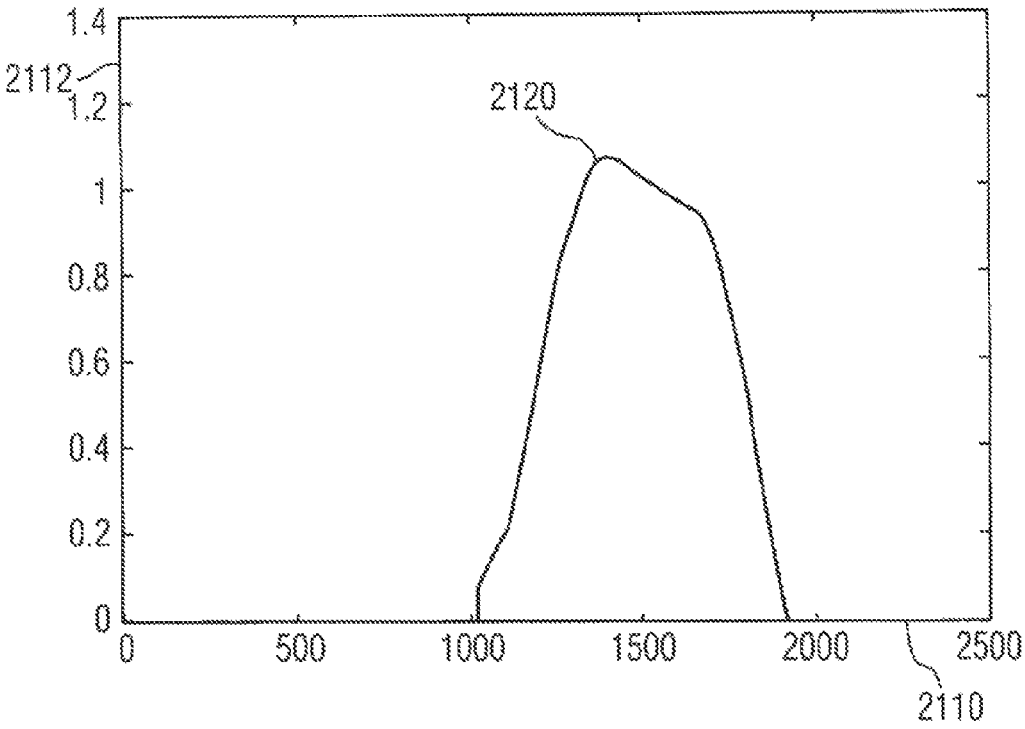
FIG. 21*a* shows a graphic representation of an analysis window for a transition from a time-domain codec to advanced-audio-coding-enhanced-low-delay (AAC-ELD)

FIG. 21*a* shows a graphic representation of an analysis window 2020*c* for a transition from a time-domain codec to AAC-ELD. An abscissa 2110 describes a time in terms of audio samples, and an ordinate 2112 describes window values.

A line 2120 describes window values of the analysis window 2020*c* as a function of the position within the window.

Figure 21B:
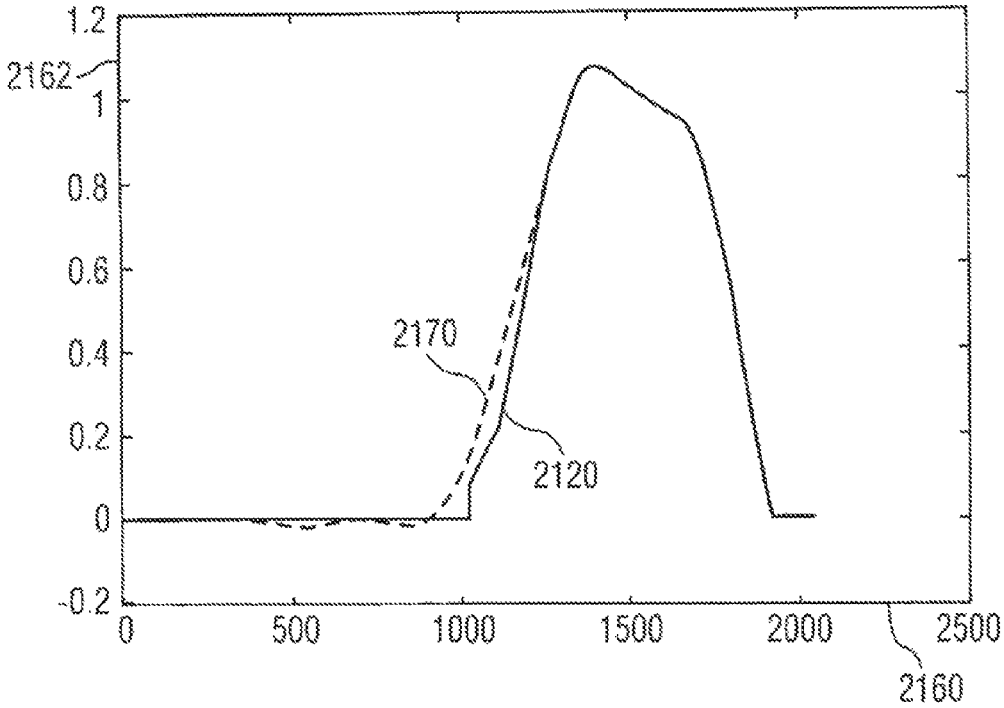
FIG. 21*b* shows a graphic representation of an analysis window for a transition from a time-domain codec to advanced-audio-coding-enhanced-low-delay (AAC-ELD) compared to a normal advanced-audio-coding-enhanced-low-delay (AAC-ELD) analysis window.

FIG. 21*b* shows a graphic representation of the analysis window 2020*c*, 2120 for a transition from time-domain codec to AAC-ELD (solid line) compared to the normal AAC-ELD analysis window 2020*a*, 2020*b*, 2020*d*, 2020*e*, 2170 (dashed line). An abscissa 2160 describes a time in terms of audio samples, and an ordinate 2162 describes (normalized) window values.

For the sequence of an analysis windows in FIG. 20 it should further be noted that all the analysis windows which follow the transition window 2020*c* do not make use of the input samples left of the non-zero part of the transition window 2020*c*. Although these window coefficients (or window values) are plotted in FIG. 20, in the actual processing they are not applied to the input signal. This is achieved by zeroing the analysis windowing input buffer left of the non-zero part of the transition window 2020*c*.

Figure 22:
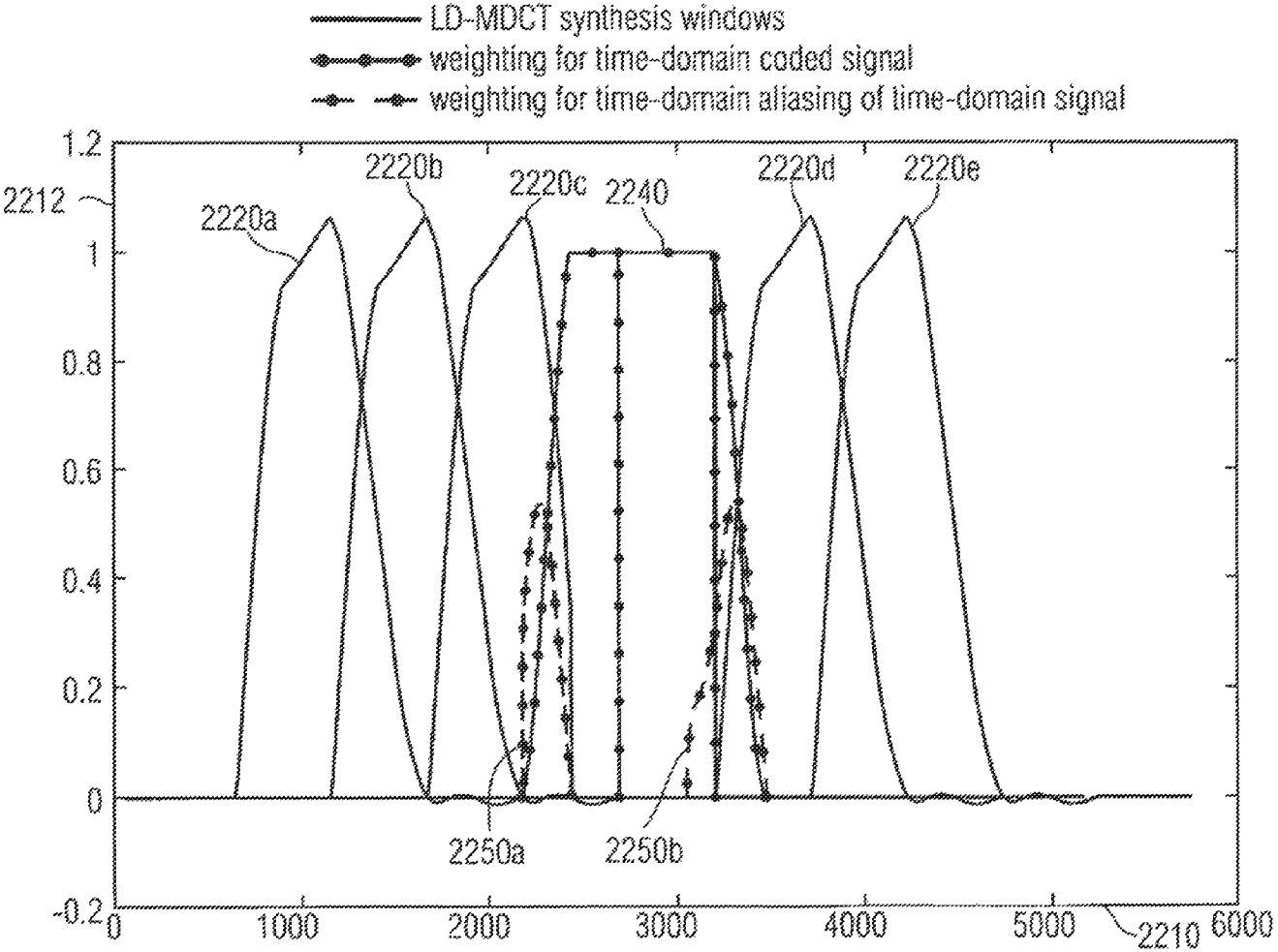
FIG. 22 shows a graphic representation of an example synthesis window sequence for switching between advanced-audio-coding-enhanced-low-delay (AAC-ELD) and a time-domain codec.

In the following, details on synthesis windowing will be described. The synthesis windowing may be used in the audio decoder described above. For the synthesis windowing, FIG. 22 shows the corresponding sequence. The sequence looks similar to a time-reversed version of the analysis windowing, but due to the delay considerations it deserves some individual description here.

In other words, FIG. 22 shows a graphic representation of an example synthesis window sequence for switching between AAC-ELD and time-domain codec. For details regarding the meaning of the lines, reference is made to the legend of FIG. 22.

In FIG. 22, an abscissa 2210 describes a time in terms of audio samples, and an ordinate 2212 describes window values. FIG. 22 shows LD-MDCT synthesis windows 2220*a* to 2220*e*, a weighting 2240 for a time-domain coded signal and a weighting 2250*a*, 2250*b* for time-domain aliasing of time-domain signal.

Figure 23A:
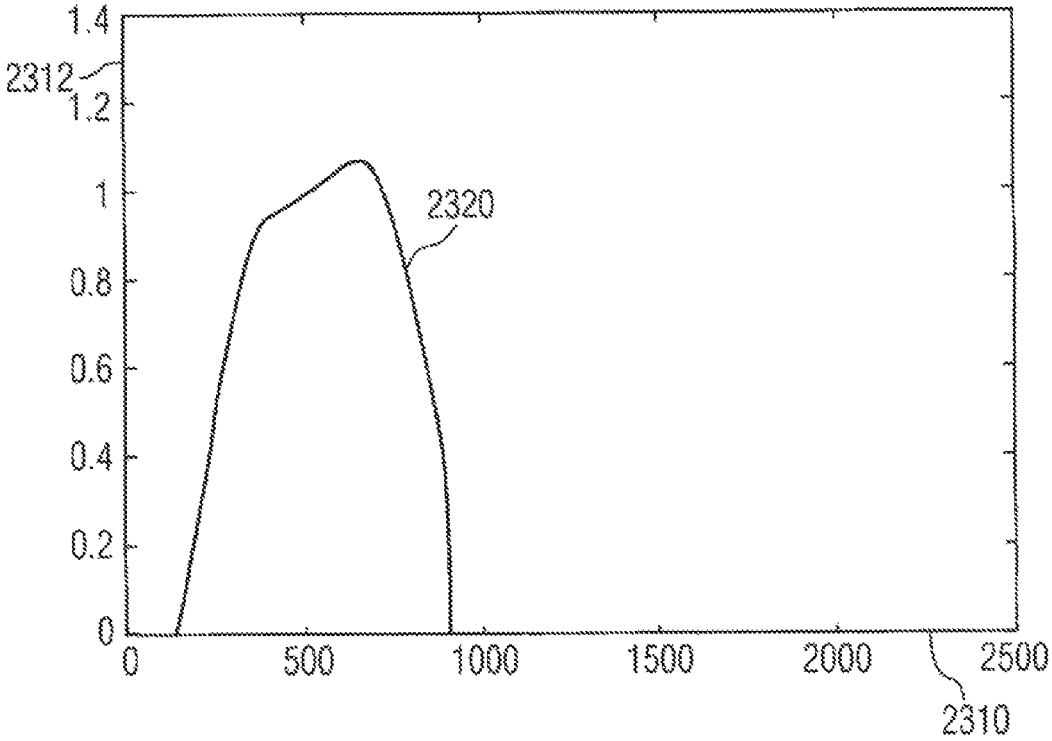
FIG. 23*a* shows a graphic representation of a synthesis window for a transition from advanced audio-coding-enhanced-low-delay (AAC-ELD) to a time-domain codec.

Before switching from AAC-ELD to the time-domain codec, there is one transition window 2220*c*, which is plotted in detail in FIG. 23*a*. This transition window 2220*c* does, however, not introduce any additional delay in the decoder, because the left part of this window, which is the part for the overlap-add to be completed, and thus for the perfect reconstruction of the time-domain output of the inverse LD-MDCT, is identical to the left part of the normal AAC-ELD synthesis window (for example, of the synthesis windows (2220*a*, 2220*b*, 2220*d*, 2220*e*), as can be seen from FIG. 23*b*. Similar to the analysis window sequence, it should also be noted here that the parts of the synthesis windows 2220*a*, 2220*b* preceding the transition window 2220*c*, which are visible right of the non-zero part of the transition window 2220*c*, actually do not contribute to the output signal. In a practical implementation, this is achieved by zeroing the output of these windows right to the non-zero part of the transition window 2220*c*.

When switching back from the time-domain codec to AAC-ELD, no special windows are necessitated. The normal AAC-ELD synthesis window 2220*e* can be used right from the beginning of the AAC-ELD coded signal portion.

FIG. 23*a* shows a graphic representation of a synthesis window 2220*c*, 2320 for a transition from AAC-ELD to time-domain codec. In FIG. 23*a*, an abscissa 2310 describes a time in terms of audio samples, and an ordinate 2312 describes window values. A line 2320 describes values of the synthesis window 2220*c* as a function of the ideal sample position.

Figure 23B:
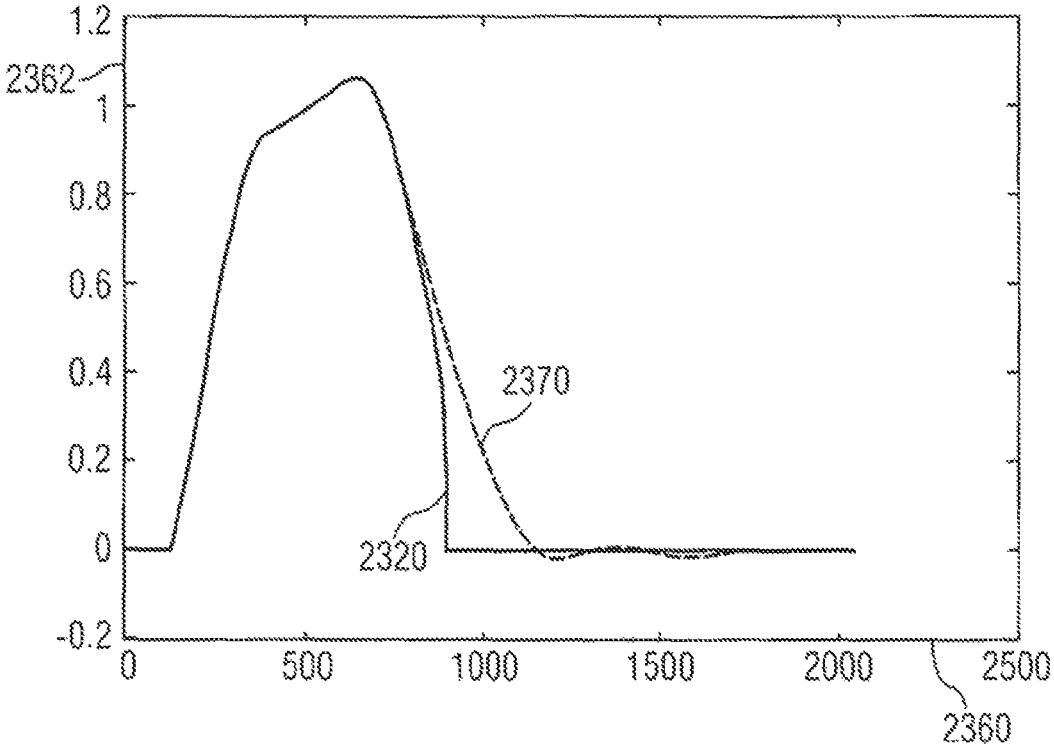
FIG. 23*b* shows a graphic representation of a synthesis window for a transition from advanced-audio-coding-enhanced-low-delay (AAC-ELD) to a time-domain codec compared to a normal advanced-audio-coding-enhanced-low-delay (AAC-ELD) synthesis window.

FIG. 23*b* shows a graphic representation of a synthesis window 2220*c* for a transition from AAC-ELD to time-domain codec (solid line) compared to a normal AAC-ELD synthesis window 2020*a*, 2020*b*, 2020*d*, 2020*e*, 2370 (dashed line). An abscissa 2360 describes a time in terms of audio samples and an ordinate 2362 describes (normalized) window values.

In the following, a weighting of the time-domain coded signal will be described.

Although shown both in FIG. 20 (analysis window sequence) and FIG. 22 (synthesis window sequence), a weighting of the time-domain coded signal is only applied once, and after the time-domain coding and decoding, i.e. in the decoder 300. It could, however, also be applied alternatively in the encoder, i.e. before the time-domain coding, or both in the encoder and in the decoder, such that the resulting overall weighting corresponds to the weighting function employed in FIGS. 19, 20 and 22.

It can further be seen from these figures that the overall range of time-domain samples covered by the weighting function (solid line marked with dots, line 1940, 2040, 2240) is slightly longer than two frames of input samples. More precisely, in this example 2*N+0.5*N samples coded in time-domain are needed to fill the gap introduced by two frames (with N new input samples per frame) not coded by the LD-MDCT-based codec. If, for example, N=512, then 2*512+256 time-domain samples have to be coded in time-domain instead of 2*512 spectral values. Thus, an overhead of only half a frame is introduced by switching to the time-domain codec and back.

In the following, some details regarding the time-domain aliasing will be described. In the transitions to the time-domain codec and back to the transform codec, time-domain aliasing is introduced intentionally in order to cancel the time-domain aliasing introduced by the neighboring LD-MDCT-coded frames. For example, the time-domain aliasing may be introduced by the aliasing cancellation signal provider 360. The dashed lines marked with dots and designated with 1950*a*, 1950*b*, 2050*a*, 2050*b*, 2250*a*, 2250*b* represent the weighting function for this operation. The time-domain coded signal is multiplied with this weighting function and then added respectively subtracted to/from the windowed time-domain signal in a time-reversed fashion.

4.6. Windowing Concept According to FIG. 24

In the following, an alternative design of lengths of transitions will be described.

Having a closer look at the analysis sequence in FIG. 20 and the synthesis sequence in FIG. 22, it can be seen that the transition windows are not exactly time-reversed versions of each other. The synthesis transition windows are not exactly time-reversed versions of each other. The synthesis transition window (FIG. 23*a*) has a shorter non-zero part than the analysis transition window (FIG. 21*a*). Both for the analysis and for the synthesis, the longer as well as the shorter versions would be possible and could be chosen independently. However, they are chosen in this way (as shown in FIGS. 20 and 22) due to several reasons. To further elaborate on this, the version with both choices made differently as plotted in FIG. 24.

Figure 24:
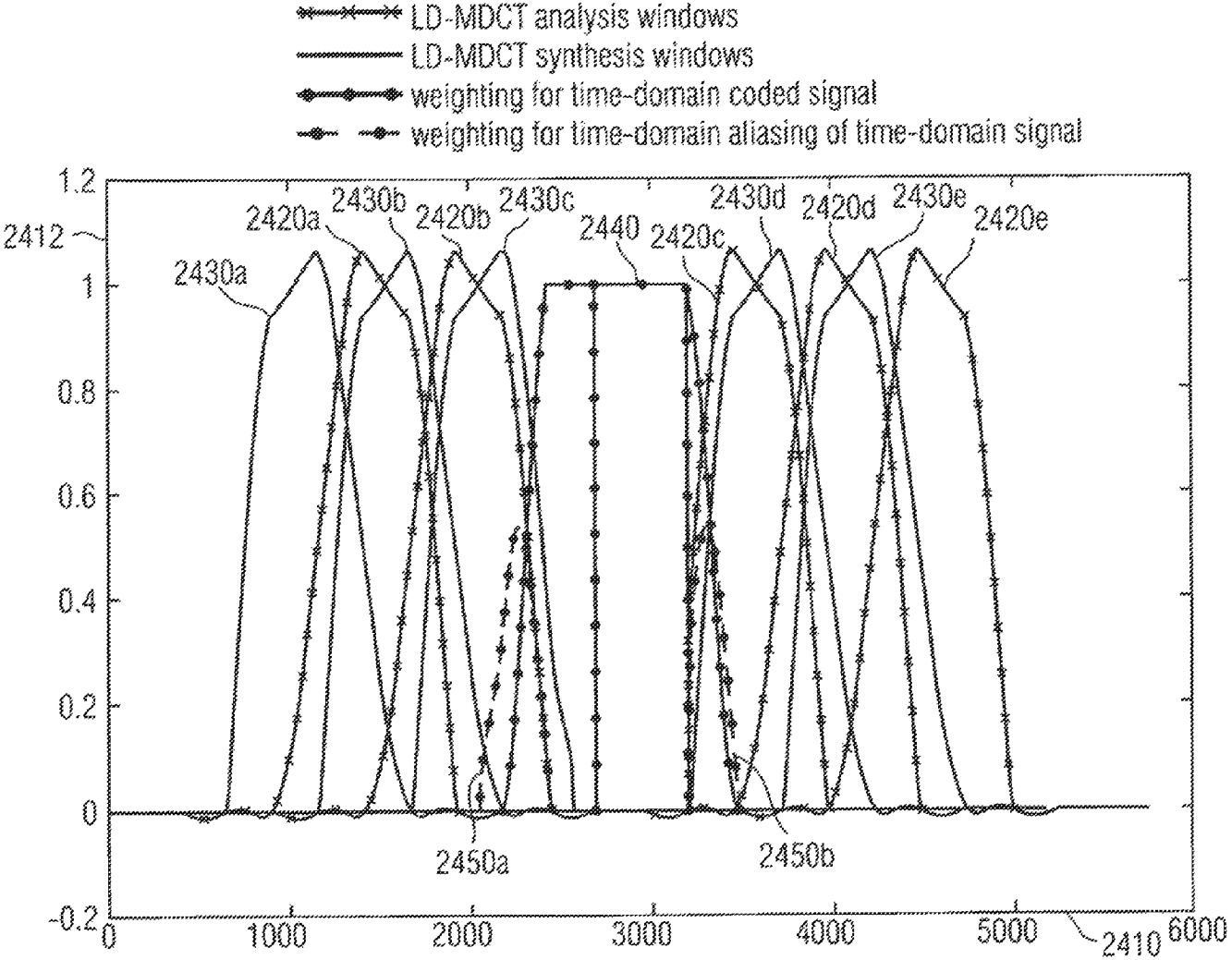
FIG. 24 shows a graphic representation of alternative choices of transition windows for window sequence switching between advanced-audio-coding-enhanced-low-delay (AAC-ELD) and a time-domain codec.

FIG. 24 shows a graphic representation of alternative choices of transition windows for window sequence switching between AAC-ELD and time-domain codec. In FIG. 24, an abscissa 2410 describes a time in terms of audio samples, and in ordinate 2412 describes window values. FIG. 24 shows LD-MDCT analysis windows 2420*a* to 2420*e*, LD-MDCT synthesis windows 2430*a* to 2430*e*, a weighting 2440 for time-domain coded signals and a weighting 2450*a* to 2450*b* for a time-domain aliasing of the time-domain signal. For details regarding the line types, reference is made to the legend of FIG. 24.

It can be seen that in this alternative, which is shown in FIG. 24, the weighting functions for the time-domain aliasing in the AAC-ELD to time-domain codec transition is extended to the left. This means that an additional portion of time-domain signals is needed, just for the sake of the intentional time-domain aliasing (or time-domain aliasing cancellation), not for the actual cross-fade. This is assumed to be inefficient and unnecessary. Therefore, the alternative of a shorter synthesis transition window and correspondingly a shorter time-domain aliasing region (as shown in FIG. 19) is advantageous for the transition from AAC-ELD to the time-domain codec.

On the other hand, for the transition from the time-domain codec to AAC-ELD, the shorter analysis transition window in FIG. 24 (compared to FIG. 19) results in a worse frequency response for this window. Also, the longer time-domain aliasing region in FIG. 19 does in this transition not necessitate any additional samples to be coded by the time-domain codec, as these samples are available from the time-domain codec anyhow. Therefore, the alternative of a longer transition window and correspondingly a longer time-domain aliasing region (as in FIG. 19) is advantageous for the transition from the time-domain codec to AAC-ELD.

However, it should be noted that in some embodiments of the encoder 100 and the decoder 300, the windowing scheme according to FIG. 24 may be applied, even though the application of the windowing scheme of FIG. 19 in an audio encoder 100 or an audio decoder 300 appears to bring along some advantages.

4.7. Windowing Concept According to FIG. 25

In the following, an alternative windowing of the time-domain signal and an alternative framing will be described.

In the description so far, the time-domain signal is considered to be windowed only once, after applying the time-domain encoding and decoding. This windowing process can also be split into two stages, one before the time-domain encoding and one after the time-domain decoding. This is illustrated in FIG. 25, in the transition from AAC-ELD to the time-domain codec.

Figure 25:
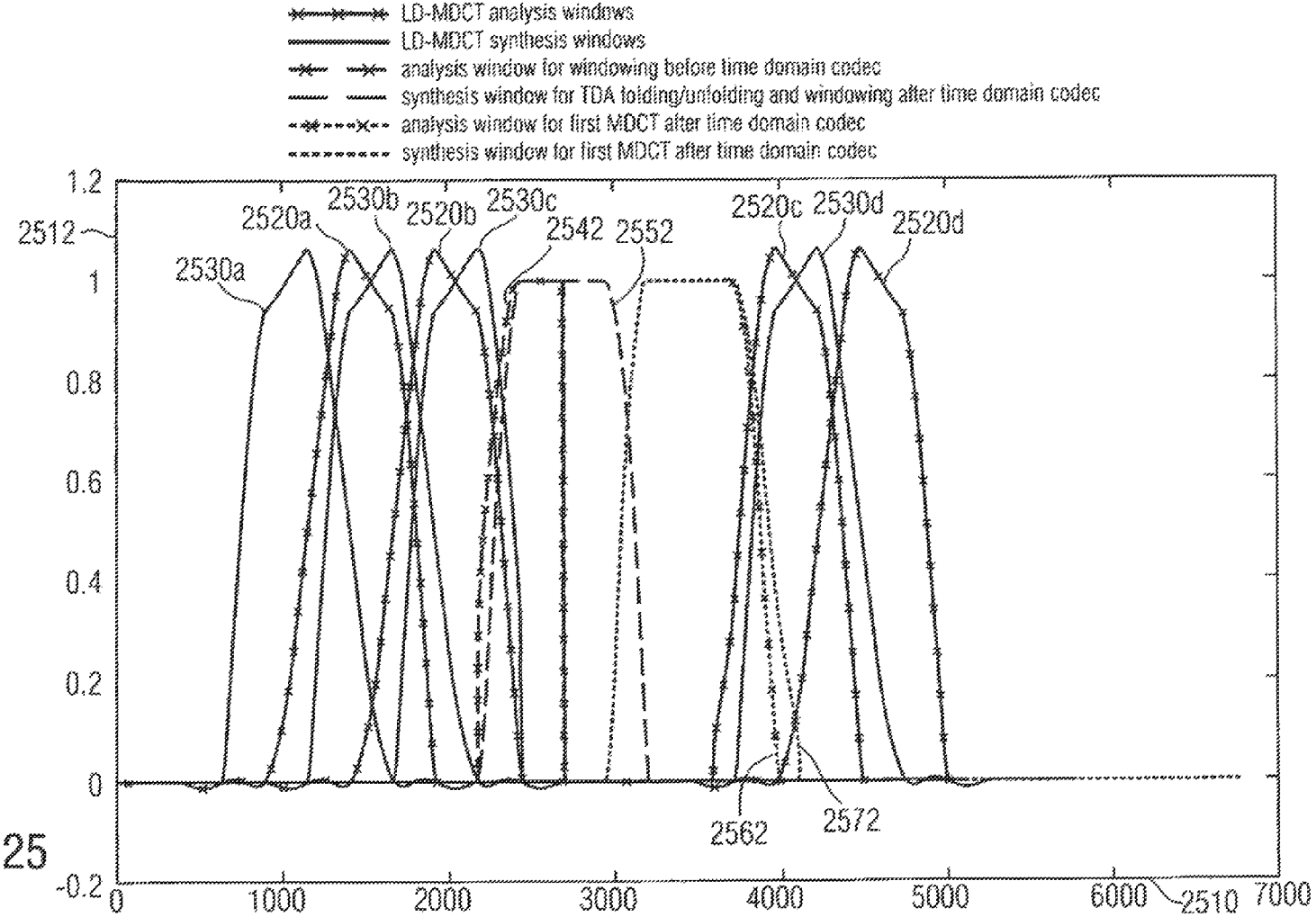
FIG. 25 shows a graphic representation of an alternative windowing of time-domain signal and alternative framing.

FIG. 25 shows a graphic representation of the alternative windowing of the time-domain signal and the alternative framing. An abscissa 2510 describes a time in terms of audio samples and an ordinate 2512 describes (normalized) window values. FIG. 25 shows LD-MDCT analysis windows value 2520*a*-2520*e*, LD-MDCT synthesis windows 2530*a*-2530*d*, an analysis window 2542 for a windowing before the time-domain codec, a synthesis window 2552 for TDA folding/unfolding and windowing after the time-domain codec, an analysis window 2562 for a first MDCT after the time-domain codec and a synthesis window 2572 for the first MDCT after the time-domain codec.

FIG. 25 also shows an alternative for the framing of the time-domain codec. In the time-domain codec, all frames can have the same length, without the need to compensate for missing samples due to the non-critical sampling in the transition. Then, however, the MDCT-codec may need to compensate for that by having a first MDCT after the time-domain codec which has more spectral values than the other MDCT frames (lines 2562 and 2572).

Overall, this alternative, which is shown in FIG. 25, makes the codec very similar to the unified-speech-and-audio coding codec (USAC codec) but with a much lower delay.

A further small modification of this alternative is to replace the windowed transition from the time-domain codec to AAC-ELD (lines 2542, 2552, 2562, 2572) by a rectangular transition, as done in AMR-WB+ when going from ACELP to TCX. In a codec using AMR-WB+ as the "time-domain codec", this can also mean that after an ACELP frame there is no direct transition from ACELP to AAC-ELD, but there is a TCX frame in between. In this way, a potential additional delay due to this specific transition is eliminated and the whole system has a delay as small as the delay of AAC-ELD. Furthermore, this makes the switching more flexible, as an efficient switching back to AAC-ELD in case of speech-like signals is more efficient than switching from AAC-ELD to ACELP, as both ACELP and TCX share the same LPC filtering.

4.8. Windowing Concept According to FIG. 26

In the following, an alternative to feed the time-domain codec with TDA signals and achieve a critical sampling will be described.

Figure 26:
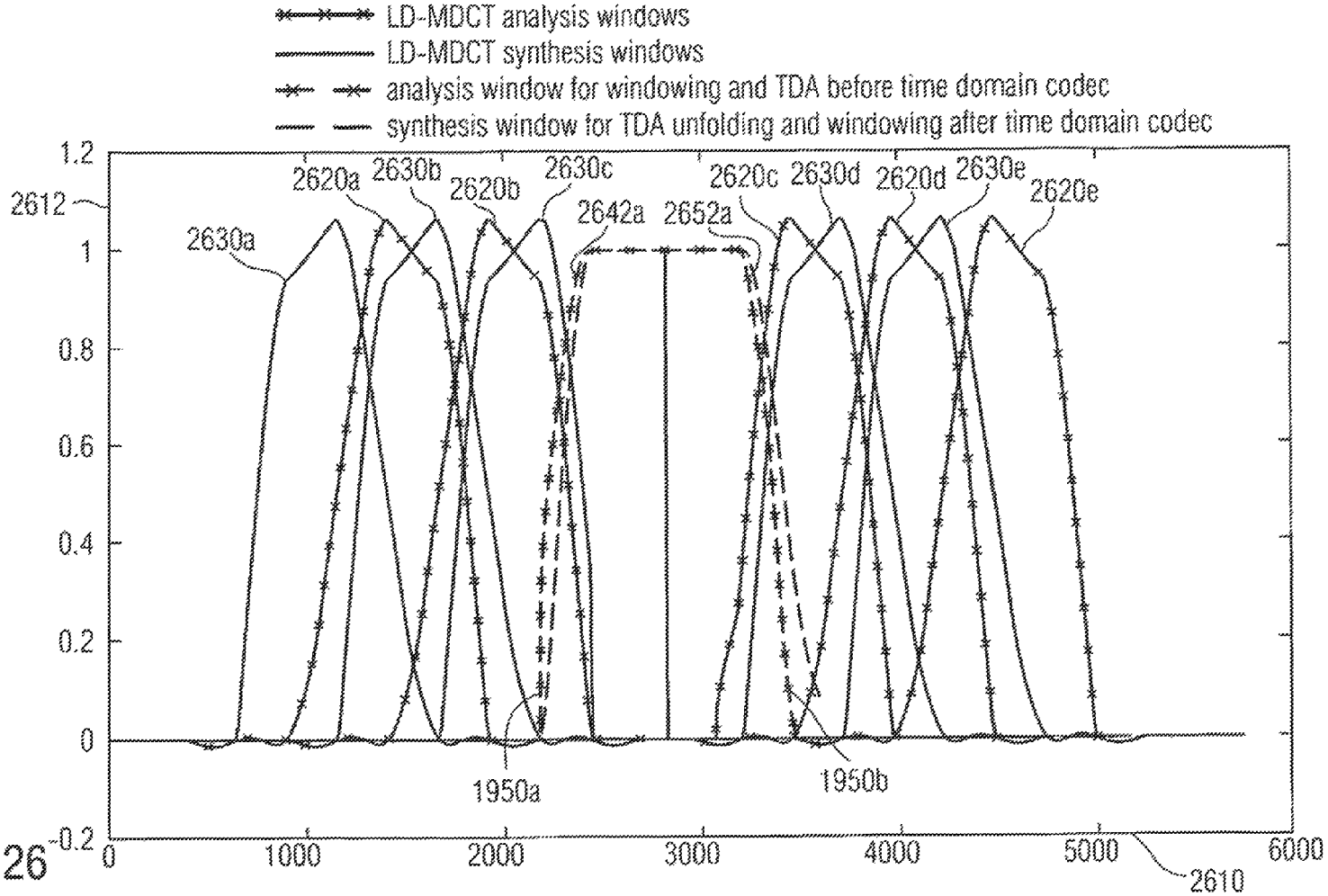
FIG. 26 shows a graphic representation of an alternative for feeding the time-domain codec with TDA signals and thereby achieving critical sampling.

FIG. 26 shows an alternative variant. To be more precise, FIG. 26 shows an alternative for feeding the time-domain codec with TDA signals and thereby achieving critical sampling. In FIG. 26, an abscissa 2610 describes a time in terms of audio samples, and an ordinate 2612 describes (normalized) window values. FIG. 12 shows LD-MDCT analysis windows 2620*a* to 2620*e*, LD-MDCT synthesis windows 2630*a* to 2630*e*, an analysis window 2642*a* for windowing and TDA before time-domain codec, and a synthesis window 2652*a* for TDA unfolding and windowing after time-domain codec. For details regarding the lines, reference is made to the legend of FIG. 26.

In this variant, the input signal for the time-domain codec is processed by the same windowing and TDA mechanism as the LD-MDCT and the time-domain aliasing signal is fed to the time-domain codec. After decoding the TDA, unfolding and windowing is applied to the output signal of the time-domain codec.

The advantage of this alternative is that critical sampling is achieved in the transitions. The disadvantage is that the time-domain codes the TDA signal instead of the time-domain signal. After unfolding the decoded TDA signal, coding errors are mirrored and thus might cause pre-echo artifacts.

4.9. Other Alternatives

In the following, some further alternatives will be described which can be used for an improvement of the encoding and decoding.

For the USAC codec currently under development at MPEG, an effort on unification of the AAC and TCX part is ongoing. This unification is based on the techniques of forward aliasing cancellation (FAC) and frequency-domain noise-shaping (FDNS). These techniques can also be applied in the context of switching between AAC-ELD and an AMR-WB+ like codec while keeping the low-delay of AAC-ELD.

Some details regarding this concept are discussed with reference to FIGS. 1 to 14.

In the following, a so-called "lifting implementation" will be briefly described, which may be applied in some embodiments. The LD-MDCT of AAC-ELD can also be implemented with an efficient lifting structure. For the transition windows described here, this lifting implementation can also be utilized and the transition windows are obtained by simply omitting some of the lifting coefficients.

5. Possible Modifications

Regarding the above-described embodiments, it should be noted that a number of modifications may be applied. In particular, a different window length may be chosen in dependence on the requirements. Also, the scaling of the windows may be modified. Naturally, the scaling between the windows applied in the transform-domain branch and the windowing applied in the ACELP branch may be changed. Also, some preprocessing steps and/or post-processing steps may be introduced at the input of the processing blocks described above and also between the processing blocks described above without modifying the general concept of the invention. Naturally, other modifications may also be made.

6. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An audio signal encoder for providing an encoded representation of an audio content on the basis of an input representation of the audio content, the audio signal encoder comprising:

a transform-domain path configured to acquire a set of spectral coefficients and noise-shaping information on the basis of a time-domain representation of a portion of the audio content to be encoded in a transform-domain mode, such that the spectral coefficients describe a spectrum of a noise-shaped version of the audio content;

wherein the transform-domain path comprises a time-domain-to-frequency-domain converter configured to window a time-domain representation of the audio content, or a pre-processed version thereof, to acquire a windowed representation of the audio content, and to apply a time-domain-to-frequency-domain conversion, to derive a set of spectral coefficients from the windowed time-domain representation of the audio content; and an code-excited linear-prediction-domain path (CELP path) configured to acquire an code-excitation information and a linear-prediction-domain parameter information on the basis of a portion of the audio content to be encoded in an code-excited linear-prediction-domain mode (CELP mode);

wherein the time-domain-to-frequency-domain converter is configured to apply a predetermined asymmetric analysis window for a windowing of a current portion of the audio content to be encoded in the transform-domain mode and following a portion of the audio content encoded in the transform-domain mode both if the current portion of the audio content is followed by a subsequent portion of the audio content to be encoded in the transform-domain mode and if the current portion of the audio content is followed by a subsequent portion of the audio content to be encoded in the CELP mode; and wherein the audio signal encoder is configured to selectively provide an abasing cancellation information, which represents aliasing cancellation signal components which would be represented by a transform-domain mode representation of the subsequent portion of the audio content, if the current portion of the audio content is followed by a subsequent portion of the audio content to be encoded in the CELP mode.

2. The audio signal encoder according to claim 1, wherein the time-domain-to-frequency-domain converter is configured to apply the same window for a windowing of a current portion of the audio content to be encoded in the transform-domain mode and following a previous portion of the audio content encoded in the transform-domain mode, both if the current portion of the audio content is followed by a subsequent portion of the audio content to be encoded in the transform-domain mode and if the current portion of the audio content is followed by a subsequent portion of the audio content to be encoded in the CELP mode.

3. The audio signal encoder according to claim 1, wherein the predetermined asymmetric analysis window comprises a left window half and a right window half, wherein the left window half comprises a left-sided transition slope, in which the window values monotonically increase from zero to a window center value, and an overshoot portion in which the window values are larger than the window center value and in which the window comprises a maximum, and wherein the right window half comprises a right-sided transition slope in which the window values monotonically decrease from the window center value to zero, and a right-sided zero portion.

4. The audio signal encoder according to claim 3, wherein the left window half comprises no more than one percent of zero window values, and wherein the right-sided zero portion comprises a length of at least 20% of the window values of the right window half.

5. The audio signal encoder according to claim 3, wherein the window values of the right window half of the predetermined asymmetric analysis window are smaller than the window center value, such that there is no overshoot portion in the right window half of the predetermined asymmetric analysis window.

6. The audio signal encoder according to claim 1, wherein a non-zero portion of the predetermined asymmetric analysis window is shorter, at least by 10%, than a frame length.

7. The audio signal encoder according to claim 1, wherein the audio signal encoder is configured such that subsequent portions of the audio content to be encoded in the transform-domain-mode comprise a temporal overlap of at least 40%; and wherein the audio signal encoder is configured such that a current portion of the audio content to be encoded in the transform-domain mode and a subsequent portion of the audio content to be encoded in the code-excited linear-prediction-domain mode comprise a temporal overlap; and wherein the audio signal encoder is configured to selectively provide the aliasing cancellation information, such that the aliasing cancellation information allows for a provision of an aliasing cancellation signal for canceling aliasing artifacts at a transition from a portion of the audio content encoded in the transform domain mode to a portion of the audio content encoded in the CELP mode in an audio signal decoder.

8. The audio signal encoder according to claim 1, wherein the audio signal encoder is configured to select a window for a windowing of a current portion of the audio content independent from a mode which is used for an encoding of a subsequent portion of the audio content which overlaps temporally with the current portion of the audio content, such that the windowed representation of the current portion of the audio content overlaps with a subsequent portion of the audio content even if the subsequent portion of the audio content is encoded in the CELP mode; and wherein the audio signal encoder is configured to provide, in response to a detection that the subsequent portion of the audio content is to be encoded in an CELP mode, an aliasing cancellation information which represents aliasing cancellation signal components which would be represented by a transform-domain mode representation of the subsequent portion of the audio content.

9. The audio signal encoder according to claim 1, wherein the time-domain-to-frequency-domain converter is configured to apply the predetermined asymmetric analysis window for a windowing of a current portion of the audio content to be encoded in the transform domain mode and following a portion of the audio content encoded in the CELP mode, such that a windowed representation of the current portion of the audio content to be encoded in the transform-domain mode temporally overlaps with the previous portion of the audio content encoded in the CELP mode, and such that portions of the audio content to be encoded in the transform domain mode are windowed using the same predetermined asymmetric analysis window independent from a mode in which a previous portion of the audio content is encoded and independent from a mode in which a subsequent portion of the audio content is encoded.

10. The audio signal encoder according to claim 9, wherein the audio signal encoder is configured to selectively provide an aliasing cancellation information if the current portion of the audio content follows a previous portion of the audio content encoded in the CELT mode.

11. The audio signal encoder according to claim 1, wherein the time-domain-to-frequency-domain converter is configured to apply a dedicated asymmetric transition analysis window, which is different from the predetermined asymmetric analysis window, for a windowing of a current portion of the audio content to be encoded in the transform domain mode and following a portion of the audio content encoded in the CELP mode.

12. The audio signal encoder according to claim 1, wherein the code-excited linear-prediction-domain path (CELP path) is an algebraic-cede-excited-linear-prediction-domain path configured to acquire an algebraic code-excitation information and a linear-prediction-domain parameter information on the basis of a portion of the audio content to be encoded in an algebraic-code-excited linear-prediction-domain mode (CELP mode).

13. An audio signal decoder for providing a decoded representation of an audio content on the basis of an encoded representation of the audio content, the audio signal decoder comprising:

a transform-domain path configured to acquire a time-domain-representation of a portion of the audio content encoded in the transform-domain mode on the basis of a set of spectral coefficients and a noise-shaping information;

wherein the transform domain path comprises a frequency-domain-to-time-domain converter configured to apply a frequency-domain-to-time-domain conversion and a windowing, to derive a windowed time-domain representation of the audio content from the set of spectral coefficients or from a pre-processed version thereof;

an code-excited linear-prediction-domain path configured to acquire a time-domain representation of the audio content encoded in an code-excited linear-prediction-domain mode (CELP mode) on the basis of an code-excitation information and a linear-prediction-domain parameter information; and wherein the frequency-domain-to-time-domain converter is configured to apply a predetermined asymmetric synthesis window for a windowing of a current portion of the audio content encoded in the transform-domain mode and following a previous portion of the audio content encoded in the transform-domain mode both if the current portion of the audio content is followed by a subsequent portion of the audio content encoded in the transform-domain mode and if the current portion of the audio content is followed by a subsequent portion of the audio content encoded in the CELP mode; and wherein the audio signal decoder is configured to selectively provide an aliasing cancellation signal on the basis of an abasing cancellation information, which is comprised in the encoded representation of the audio content, and which represents aliasing cancellation signal components which would be represented by a transform-domain mode representation of the subsequent portion of the audio content, if the current portion of the audio content encoded in the transform-domain mode is followed by a subsequent portion of the audio content encoded in the CELP mode.

14. The audio signal decoder according to claim 13, wherein the frequency-domain-to-time-domain converter is configured to apply the same window for a windowing of a current portion of the audio content encoded in the transform-domain mode and following a previous portion of the audio content encoded in the transform-domain mode both if the current portion of the audio content is followed by a subsequent portion of the audio content encoded in the transform-domain mode and if the current portion of the audio content is followed by a subsequent portion of the audio content encoded in the CELP mode.

15. The audio signal decoder according to claim 13, wherein the predetermined asymmetric synthesis window comprises a left window half and a right window half, wherein the left window half comprises a left-sided zero portion and a left-sided transition slope, in which the window values monotonically increase from zero to a window center value; and wherein the right window half comprises an overshoot portion in which the window values are larger than the window center value and in which the window comprises a maximum, and a right-sided transition slope in which the window values monotonically decrease from the window center value to zero.

16. The audio signal decoder according to claim 15, wherein the left-sided zero portion comprises a length of at least 20% of the window values of the left window half, and wherein the right window half comprises no more than one percent of zero window values.

17. The audio signal decoder according to claim 15, wherein the window values of the left window half of the predetermined asymmetric synthesis window are smaller than the window center value, such that there is no overshoot portion in the left window half of the predetermined asymmetric synthesis window.

18. The audio signal decoder according claim 13, wherein a non-zero portion of the predetermined asymmetric synthesis window is shorter, at least by 10%, than a frame length.

19. The audio signal decoder according to claim 13, wherein the audio signal decoder is configured such that subsequent portions of the audio content encoded in the transform-domain mode comprise a temporal overlap of at least 40%; and wherein the audio signal decoder is configured such that a current portion of the audio content encoded in the transform-domain mode and a subsequent portion of the audio content encoded in the code-excited linear-prediction-domain mode comprise a temporal overlap; and wherein the audio signal decoder is configured to selectively provide the aliasing cancellation signal on the basis of the aliasing cancellation information, such that the aliasing cancellation signal reduces or cancels aliasing artifacts at a transition from the current portion of the audio content encoded in the transform-domain mode to a subsequent portion of the audio content encoded in the CELP mode.

20. The audio signal decoder according to claim 13, wherein the audio signal decoder is configured to select a window for a windowing of a current portion of the audio content independent from a mode which is used for an encoding of a subsequent portion of the audio content, which overlaps temporally with the current portion of the audio content, such that the windowed representation of the current portion of the audio content overlaps temporally with the subsequent portion of the audio content even if the subsequent portion of the audio content is encoded in the CELP mode; and wherein the audio signal decoder is configured to provide, in response to a detection that the subsequent portion of the audio content is encoded in the CELP mode, an aliasing cancellation signal to reduce or cancel aliasing artifacts at a transition from the current portion of the audio content encoded in the transform-domain mode to the subsequent portion of the audio content encoded in the CELP mode.

21. The audio signal decoder according to claim 13, wherein the frequency-domain-to-time-domain converter is configured to apply the predetermined asymmetric synthesis window for a windowing of a current portion of the audio content to be encoded in the transform-domain mode and following a previous portion of the audio content encoded in the CELP mode, such that portions of the audio content encoded in the transform-domain mode are windowed using the same predetermined asymmetric synthesis window independent from a mode in which a previous portion of the audio content is encoded and independent from a mode in which a subsequent portion of the audio content is encoded, and such that a windowed time-domain representation of the current portion of the audio content encoded in the transform-domain mode temporally overlaps with the previous portion of the audio content encoded in the CELP mode.

22. The audio signal decoder according to claim 21, wherein the audio signal decoder is configured to selectively provide an aliasing cancellation signal on the basis of aliasing cancellation information if the current portion of the audio content follows a previous portion of the audio content encoded in the CELP mode.

23. The audio signal decoder according to claim 13, wherein the frequency-domain-to-time-domain converter is configured to apply a dedicated asymmetric transition synthesis window, which is different from the predetermined asymmetric synthesis window, for a windowing of a current portion of the audio content encoded in the transform-domain mode and following a portion of the audio content encoded in the CELP mode.

24. The audio signal decoder according to claim 13, wherein the code-excited linear-prediction-domain path is an algebraic-code-excited linear-prediction-domain path configured to acquire a time-domain representation of the audio content encoded in an algebraic-code-excited linear-prediction-domain mode (CELP mode) on the basis of an algebraic-code-excitation information and a linear-prediction-domain parameter information.

25. A method for providing an encoded representation of an audio content on the basis of an input representation of the audio content, the method comprising:

acquiring a set of spectral coefficients and a noise-shaping information on the basis of a time-domain representation of a portion of the audio content to be encoded in the transform-domain mode, such that the spectral coefficients describe a spectrum of a noise-shaped version of the audio content, wherein a time-domain representation of the audio content to be encoded in the transform-domain mode, or a pre-processed version thereof, is windowed, and wherein a time-domain-to-frequency-domain conversion is applied to derive a set of spectral coefficients from the windowed time-domain representation of the audio content;

acquiring an code-excitation information and a linear-prediction-domain information on the basis of a portion of the audio content to be encoded in an code-excited linear-prediction-domain mode (CELP mode);

wherein a predetermined asymmetric analysis window is applied for the windowing of a current portion of the audio content to be encoded in the transform-domain mode and following a portion of the audio content encoded in the transform-domain mode both if the current portion of the audio content is followed by a subsequent portion of the audio content to be encoded in the transform-domain mode and if the current portion of the audio content is followed by a subsequent portion of the audio content to be encoded in the CELT mode; and wherein an aliasing cancellation information, which represents aliasing cancellation signal components which would be represented by a transform-domain mode representation of the subsequent portion of the audio content, is selectively provided if the current portion of the audio content is followed by a subsequent portion of the audio content to be encoded in the CELP mode.

26. A method for providing a decoded representation of an audio content on the basis of an encoded representation of the audio content, the method comprising:

acquiring a time-domain representation of a portion of the audio content encoded in a transform-domain mode on the basis of a set of spectral coefficients and a noise-shaping information, wherein a frequency-domain-to-time-domain conversion and a windowing are applied to derive a windowed time-domain-representation of the audio content from the set of spectral coefficients or from a pre-processed version thereof; and acquiring a time-domain representation of the audio content encoded in an code-excited linear-prediction-domain mode on the basis of an code-excitation information and a linear-prediction-domain parameter information;

wherein a predetermined asymmetric synthesis window is applied for a windowing of a current portion of the audio content encoded in the transform-domain mode and following a previous portion of the audio content encoded in the transform-domain mode both if the current portion of the audio content is followed by a subsequent portion of the audio content encoded in the transform-domain mode and if the current portion of the audio content is followed by a subsequent portion of the audio content encoded in the CELP mode; and wherein an aliasing cancellation signal is selectively provided on the basis of an aliasing cancellation information, which is comprised in the encoded representation of the audio content, and which represents aliasing cancellation signal components which would be represented by a transform-domain mode representation of the subsequent portion of the audio content, if the current portion of the audio content is followed by a subsequent portion of the audio content encoded in the CELP mode.

27. A non-transitory computer readable medium comprising a computer program for performing a method for providing an encoded representation of an audio content on the basis of an input representation of the audio content, the method comprising:

acquiring a set of spectral coefficients and a noise-shaping information on the basis of a time-domain representation of a portion of the audio content to be encoded in the transform-domain mode, such that the spectral coefficients describe a spectrum of a noise-shaped version of the audio content, wherein a time-domain representation of the audio content to be encoded in the transform-domain mode, or a pre-processed version thereof, is windowed, and wherein a time-domain-to-frequency-domain conversion is applied to derive a set of spectral coefficients from the windowed time-domain representation of the audio content;

acquiring an code-excitation information and a linear-prediction-domain information on the basis of a portion of the audio content to be encoded in an code-excited linear-prediction-domain mode (CELP mode);

wherein a predetermined asymmetric analysis window is applied for the windowing of a current portion of the audio content to be encoded in the transform-domain mode and following a portion of the audio content encoded in the transform-domain mode both if the current portion of the audio content is followed by a subsequent portion of the audio content to be encoded in the transform-domain mode and if the current portion of the audio content is followed by a subsequent portion of the audio content to be encoded in the CELP mode; and wherein an aliasing cancellation information, which represents aliasing cancellation signal components which would be represented by a transform-domain mode representation of the subsequent portion of the audio content, is selectively provided if the current portion of the audio content is followed by a subsequent portion of the audio content to be encoded in the CELP mode, when the computer program runs on a computer.

28. A non-transitory readable medium comprising a computer program for performing a method for providing a decoded representation of an audio content on the basis of an encoded representation of the audio content, the method comprising:

acquiring a time-domain representation of a portion of the audio content encoded in a transform-domain mode on the basis of a set of spectral coefficients and a noise-shaping information, wherein a frequency-domain-to-time-domain conversion and a windowing are applied to derive a windowed time-domain-representation of the audio content from the set of spectral coefficients or from a pre-processed version thereof; and acquiring a time-domain representation of the audio content encoded in an code-excited linear-prediction-domain mode on the basis of an code-excitation information and a linear-prediction-domain parameter information;

wherein a predetermined asymmetric synthesis window is applied for a windowing of a current portion of the audio content encoded in the transform-domain mode and following a previous portion of the audio content encoded in the transform-domain mode both if the current portion of the audio content is followed by a subsequent portion of the audio content encoded in the transform-domain mode and if the current portion of the audio content is followed by a subsequent portion of the audio content encoded in the CELP mode; and wherein an aliasing cancellation signal is selectively provided on the basis of an aliasing cancellation information, which is comprised in the encoded representation of the audio content, and which represents aliasing cancellation signal components which would be represented by a transform-domain mode representation of the subsequent portion of the audio content, if the current portion of the audio content is followed by a subsequent portion of the audio content encoded in the CELP mode, when the computer program runs on a computer.

* * * * *

UNITED STATES PATENT AND TRADEMARK OFFICE

CERTIFICATE OF CORRECTION

PATENT NO. : 8,630,862 B2
APPLICATION NO. : 13/450792
DATED : January 14, 2014
INVENTOR(S) : Ralf Geiger et al.

It is certified that error appears in the above-identified patent and that said Letters Patent is hereby corrected as shown below:

In the claims

Claim 1, column 49, line 55 the word "abasing" should read --aliasing--.

Claim 10, column 51, line 24 the word "CELT" should read --CELP--.

Claim 12, column 51, line 35 the phrase "algebraic-cede-excited-linear-prediction-domain" should read --algebraic-code-excited-linear-prediction-domain--.

Claim 13, column 52, line 8 the word "abasing" should read --aliasing--.

Claim 25, column 54, line 25 the word "CELT" should read --CELP--.

Claim 28, column 56, line 1 the word computer should be added between the words non-transitory and readable. Line 1 should read --A non-transitory computer readable medium comprising a com- --.

Signed and Sealed this
Eleventh Day of November, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,630,862 B2
APPLICATION NO. : 13/450792
DATED : January 14, 2014
INVENTOR(S) : Ralf Geiger et al.

It is certified that error appears in the above-identified patent and that said Letters Patent is hereby corrected as shown below:

On the title page, item 73 Assignee:

"Fraunhofer-Gesellschaft zur Foerderung der Angewandten Forschung E.V."

should read:

"Fraunhofer-Gesellschaft zur Foerderung der angewandten Forschung e.V."

Signed and Sealed this
Twenty-fourth Day of November, 2015

Michelle K. Lee

Michelle K. Lee
*Director of the United States Patent and Trademark Office*